US008498547B2

(12) United States Patent
Mitsuoka et al.

(10) Patent No.: US 8,498,547 B2
(45) Date of Patent: Jul. 30, 2013

(54) FIXING DEVICE, IMAGE FORMING APPARATUS, AND METHOD OF CONNECTING WIRES IN FIXING DEVICE

(75) Inventors: Tetsunori Mitsuoka, Osaka (JP); Akihiko Taniguchi, Osaka (JP); Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 333 days.

(21) Appl. No.: 12/897,979

(22) Filed: Oct. 5, 2010

(65) Prior Publication Data

US 2011/0081157 A1 Apr. 7, 2011

(30) Foreign Application Priority Data

Oct. 5, 2009 (JP) ..... 2009-231842

(51) Int. Cl.
*G03G 15/20* (2006.01)

(52) U.S. Cl.
USPC ..... 399/69; 219/216

(58) Field of Classification Search
USPC ..... 399/69, 320, 328, 329; 219/216
See application file for complete search history.

(56) References Cited

U.S. PATENT DOCUMENTS

| | | | | |
|---|---|---|---|---|
| 6,243,559 | B1 | 6/2001 | Kurotaka et al. | 399/329 |
| 8,224,222 | B2 * | 7/2012 | Mitsuoka | 399/329 |
| 2003/0183610 | A1 | 10/2003 | Okabayashi et al. | 219/216 |
| 2005/0271408 | A1 | 12/2005 | Hayashi | 399/70 |
| 2005/0276624 | A1 | 12/2005 | Fujino | 399/69 |
| 2006/0133836 | A1 | 6/2006 | Nakayama | 399/68 |
| 2007/0140718 | A1 * | 6/2007 | Mulder et al. | 399/69 |
| 2007/0217803 | A1 | 9/2007 | Nakayama | 399/68 |
| 2007/0242959 | A1 | 10/2007 | Aono et al. | 399/13 |
| 2007/0258725 | A1 | 11/2007 | Hayashi | 399/70 |
| 2009/0208262 | A1 | 8/2009 | Osada et al. | 399/329 |
| 2010/0303525 | A1 * | 12/2010 | Mitsuoka et al. | 399/329 |

FOREIGN PATENT DOCUMENTS

| | | | |
|---|---|---|---|
| CN | 1790186 | A | 6/2006 |
| JP | 04-093874 | | 3/1992 |
| JP | 10-307496 | A | 11/1998 |
| JP | 2001-023732 | A | 1/2001 |
| JP | 2002-333788 | A | 11/2002 |
| JP | 2004-61718 | A | 2/2004 |
| JP | 2004-341003 | | 12/2004 |
| JP | 2005-258317 | A | 9/2005 |
| JP | 2005-345969 | | 12/2005 |
| JP | 2005-352389 | | 12/2005 |
| JP | 2006-058440 | A | 3/2006 |
| JP | 2006-139146 | | 6/2006 |
| JP | 2007-240623 | | 9/2007 |
| JP | 2007-279636 | | 10/2007 |
| JP | 2009-69565 | | 4/2009 |
| JP | 2009-210690 | | 9/2009 |

OTHER PUBLICATIONS

Machine translation of JP 2004-341003 dated Nov. 20, 2012.*

* cited by examiner

*Primary Examiner* — Sophia S Chen
(74) *Attorney, Agent, or Firm* — Renner, Otto, Boisselle & Sklar, LLP

(57) ABSTRACT

A fixing device of belt fixing type is provided. A fixing device includes a connector to be connected to wires provided therein. The connector includes integrally primary-side wiring connector terminals to be connected to primary-side wires each leading to a heat generating resistor, and secondary-side wiring connector terminals to be connected to secondary-side wires including wires each leading to a heat generating element-side thermistor, the secondary-side wires flowing current smaller than the primary-side wires.

10 Claims, 19 Drawing Sheets

FIXING DEVICE, IMAGE FORMING APPARATUS, AND METHOD OF CONNECTING WIRES IN FIXING DEVICE

CROSS-REFERENCE TO RELATED APPLICATION

This application claims priority to Japanese Patent Application No. 2009-231842, which was filed on Oct. 5, 2009, the content of which is incorporated herein by reference in its entirety.

BACKGROUND OF THE INVENTION

1. Field of the Invention

The present invention relates to a fixing device that fixes a toner image onto a recording medium under application of heat and pressure, to an image forming apparatus including the fixing device, and to a method of connecting wires in the fixing device.

2. Description of the Related Art

There has been widely used a fixing device of heat-roller fixing type as a fixing device for use in an electrophotographic image forming apparatus such as a copying machine and a printer. The fixing device of heat-roller fixing type includes a pair of rollers (a fixing roller and a pressure roller) that are brought into contact with each other under pressure. By means of a heating section composed for example of a halogen lamp, which is placed in each of or one of the pair of rollers interiorly thereof, the pair of rollers are heated to a predetermined temperature (a fixing temperature). With the pair of rollers kept in a heated state, such as a recording paper sheet, which is a recording medium having formed thereon an unfixed toner image, is fed to a region where the pair of rollers make pressure-contact with each other (a fixing nip region). Upon the recording paper sheet passing through the pressure-contact region, the toner image is fixed to the recording paper sheet under application of heat and pressure.

Incidentally, a fixing device for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixing on the unfixed color toner image that is larger in toner adherent amount than a monochromatic toner image. Moreover, by virtue of a deflection-releasing effect exerted by the elastic layer in the fixing nip region, it is possible to provide enhanced releasability for a color toner that is more susceptible to occurrence of offset than a monochromatic toner. Further, since the fixing nip region is convexly curved in a radially-outward direction so as to define a so-called reverse nip configuration, it is possible to attain higher paper-stripping capability. That is, a paper stripping action can be produced without using a stripping portion such as a stripping pawl (self-stripping action), wherefore image imperfection caused by the provision of the stripping portion can be eliminated.

In the fixing device provided in such a color image forming apparatus, for high speed, it is necessary to widen the nip width of the fixing nip region. As a method for widening the nip width, there is a method in which the thickness of the elastic layer of the fixing roller increases, or a method in which the diameter of the fixing roller increases. However, in the fixing roller having the elastic layer, the thermal conductivity of the elastic layer is very low. For this reason, when a heating section is provided in the fixing roller, if the process speed increases, the temperature of the fixing roller may not follow the process speed. Meanwhile, when the diameter of the fixing roller increases, the warm-up time may be extended or power consumption may be increased.

As a fixing device provided in a color image forming apparatus to solve such problems, Japanese Unexamined Patent Publication JP-A 10-307496 (1998) discloses a fixing device of belt fixing type that is configured so that a fixing belt is supported around a fixing roller and a heating roller, and the fixing roller and a pressure roller are brought into pressure-contact with each other with the fixing belt interposed therebetween. In the fixing device of belt fixing type, since the fixing belt with a small heat capacity is heated, it takes short time to warm up and it is not necessary to incorporate a heat source such as a halogen lamp in the fixing roller, thus making it possible to provide a thick elastic layer with low hardness made of sponge rubber and the like and to secure a wide nip width.

Furthermore, JP-A 2002-333788 discloses, as a fixing device of belt fixing type, a fixing device of planar heat generating belt fixing type with a heating section as a planar heat generating element (i.e., a heat generating element which is configured such that a heat generating resistor forms a predetermined shaped plane as a whole). In the fixing device of planar heat generating belt fixing type, since a heat capacity of the heating section is reduced and the planar heat generating element as the heating section directly generates heat, a thermal response speed is also enhanced compared to a system in which a heating roller is heated indirectly using a halogen lamp or the like and it is possible to attain further shortening of a time for warm up and more energy saving.

The fixing device of belt fixing type also includes a temperature detection element, such as a thermistor, which detects the surface temperature of the fixing belt, and an overheat preventing element (a thermostat, a temperature fuse, a thermal protector, or the like) which detects an abnormal temperature rise of the planar heat generating element being in an overheat state. In such a fixing device, electrical conduction to the planar heat generating element is controlled on the basis of temperature data detected by the temperature detection element and abnormal temperature rising data detected by the overheat preventing element such that the surface temperature of the fixing belt is at a predetermined temperature (fixing temperature).

In the fixing device of belt fixing type using a high-power-density planar heat generating element, when the temperature detection element is not operated normally due to the wires of the temperature detection element being loosened, and electrical conduction to the planar heat generating element is not controlled normally, abnormal electrical conduction is provided to the planar heat generating element. The high-power-density planar heat generating element has a high temperature rising speed. Thus, if abnormal electrical conduction is provided to the planar heat generating element even in a short time, the planar heat generating element may be in the overheat state and may result in smoke generation or burnout, or may result in smoke generation or ignition due to heat generation caused by electrical conduction in an incomplete connection state and a half-short-circuit state. Further, if abnormal electrical conduction to the planar heat generating element in a short time is repeated, the overheat state of the planar heat generating element is continued, the fixing belt may be damaged and then deteriorated, or may result in smoke generation or ignition.

SUMMARY OF THE INVENTION

Accordingly, an object of the invention is to provide a fixing device of belt fixing type configured to heat a fixing belt with heat of a heat generating resistor, which generates heat due to electrical conduction, which is capable of preventing electrical conduction to the heat generating resistor in a state where a temperature detection element is not electrically connected, preventing the heat generating resistor from being in an overheat state and preventing the heat generating resistor from resulting in smoke generation or burnout, and high safety is able to be secured. Another object of the invention is to provide an image forming apparatus comprising the fixing device. A further object of the invention is to provide a method of connecting wires in the fixing device.

The invention provides a fixing device which is detachably provided in a main body of an image forming apparatus for forming an image on a recording medium, and applies heat and pressure to a toner image borne on the recording medium to fix the toner image onto the recording medium, the fixing device comprising:

a first fixing member;

a heating section having a heat generating layer including a heat generating resistor which generates heat due to electrical conduction;

a fixing belt which is an endless belt member, the fixing belt being supported around the first fixing member and the heating section with tension;

a second fixing member provided to be opposite to the first fixing member with the fixing belt interposed therebetween;

a temperature detection element which detects a temperature of a surface of the fixing belt;

a control section which controls electrical conduction to the heat generating resistor on a basis of the temperature detected by the temperature detection element such that a surface temperature of the fixing belt is at a predetermined temperature; and a connector which connects the heat generating resistor and the temperature detection element to the control section, the connector comprising integrally primary-side wiring connector terminals to be connected to primary-side wires each leading to the heat generating resistor, and secondary-side wiring connector terminals to be connected to secondary-side wires including wires each leading to the temperature detection element, the secondary-side wires flowing current smaller than the primary-side wires.

According to the invention, the fixing device is provided with a control section which controls electrical conduction to the heat generating resistor on a basis of temperature data detected by the temperature detection element such that the surface temperature of the fixing belt is at the predetermined temperature, applies heat and pressure to the toner image borne on the recording medium to fix the toner image onto the recording medium, and comprises a connector which connects the heat generating resistor and the temperature detection element to the control section. The connector of the fixing device comprises integrally the primary-side wiring connector terminals to be connected to the primary-side wires each leading to the heat generating resistor, and the secondary-side wiring connector terminals to be connected to the secondary-side wires including wires each leading to the temperature detection element, the secondary-side wires flowing current smaller than the primary-side wires.

In the fixing device, the primary-side wires each leading to the heat generating resistor with a large current flowing therein and the secondary-side wires including the wires each leading to the temperature detection element with a small current flowing therein are connected to the same connector. Thus, it is possible to prevent electrical conduction to the heat generating resistor in a state where the temperature detection element is not operated normally due to the wires of the temperature detection element being loosened (forgetting to connect), half-short-circuit connection caused by incomplete connection, or the like, and electrical conduction to the heat generating resistor is not controlled normally. For this reason, in the fixing device, it is possible to suppress abnormal electrical conduction to the heat generating resistor even in a short time, preventing the heat generating resistor from being in the overheat state. Therefore, in the fixing device, it is possible to prevent the heat generating resistor from resulting in smoke generation or burnout, and high safety is able to be secured. Further, in the fixing device, it is possible to suppress abnormal electrical conduction to the heat generating resistor even in a short time. Thus, it is possible to prevent the overheat state of the heat generating resistor from being continued due to repetitive abnormal electrical conduction to the heat generating resistor in a short time. Therefore, it is possible to prevent the fixing belt from being thermally damaged and then deteriorated, or to prevent the fixing belt from resulting in smoke generation or burnout.

In the invention, it is preferable that the connector is arranged such that the primary-side wiring connector terminals are sandwiched between the secondary-side wiring connector terminals, and when it is detected that there is a connection fault between the secondary-side wires and the secondary-side wiring connector terminals, the control section controls such that electrical conduction to the heat generating resistor is suppressed.

According to the invention, the connector of the fixing device is configured such that the primary-side wiring connector terminals are sandwiched between the secondary-side wiring connector terminals. When it is detected that there is a connection fault between the secondary-side wires and the secondary-side wiring connector terminals, the control section controls such that electrical conduction to the heat generating resistor is suppressed. Therefore, even when the connector is inserted obliquely, there is a connection fault between the secondary-side wires and the secondary-side wiring connector terminals arranged outside the primary-side wiring connector terminals in the connector, and the temperature detection element is not operated normally, since the control section suppresses electrical conduction to the heat generating resistor, it is possible to prevent the heat generating resistor from being in the overheat state.

Furthermore, in the invention, it is preferable that the secondary-side wiring connector terminals are arranged at point-symmetrical positions with respect to a center of the connector.

According to the invention, the secondary-side wiring connector terminals of the connector of the fixing device are arranged at the point-symmetrical positions with respect to a center of the connector. Therefore, even when the connector is inserted obliquely, there is a connection fault between the secondary-side wires and the secondary-side wiring connector terminals arranged outside the primary-side wiring connector terminals in the connector, and the temperature detection element is not operated normally, it is possible to suppress abnormal electrical conduction to the heat generating resistor, preventing the heat generating resistor from being in the overheat state.

In the invention, it is preferable that the fixing device further comprises a mounting determining section which determines whether or not the fixing device is mounted in a main body of an image forming apparatus, and wires to be connected to the mounting determining section are connected to secondary-side wiring connector terminals as the secondary-side wires.

According to the invention, the fixing device further comprises a mounting determining section which determines whether or not the fixing device is mounted in the main body of the image forming apparatus. Wires to be connected to the mounting determining section are connected to the secondary-side wiring connector terminals as the secondary-side wires. Thus, when it is detected that there is a connection fault between the secondary-side wires and the secondary-side wiring connector terminals, the control section suppresses electrical conduction to the heat generating resistor. Therefore, when the mounting determining section is not operated normally due to a connection fault of the wire of the mounting determining section or the like, and it is not determined accurately whether or not the fixing device is mounted in the main body of the image forming apparatus, it is possible to prevent electrical conduction to the heat generating resistor.

In the invention, it is preferable that the fixing device further comprises a recording medium passage determining section which determines whether or not a recording medium has passed through a fixing nip region which is formed in an area where the second fixing member comes into contact with the fixing belt, and wires to be connected to the recording medium passage determining section are connected to the secondary-side wiring connector terminals as the secondary-side wires.

According to the invention, the fixing device further comprises a recording medium passage determining section which determines whether or not a recording medium has passed through the fixing nip region. Wires to be connected to the recording medium passage determining section are connected to the secondary-side wiring connector terminals as the secondary-side wires. Thus, when it is detected that there is a connection fault between the secondary-side wires and the secondary-side wiring connector terminals, the control section suppresses electrical conduction to the heat generating resistor. Therefore, when the recording medium passage determining section is not operated normally due to a connection fault of the wire of the recording medium passage determining section or the like, and it is not determined accurately whether or not the recording medium has passed through the fixing nip region, it is possible to prevent electrical conduction to the heat generating resistor.

In the invention, it is preferable that the second fixing member comprises a pressure belt which is an endless belt member supported around a pressure member and a support member with tension, and the pressure member is provided to be opposite to the first fixing member with the fixing belt and the pressure belt interposed therebetween.

According to the invention, the second fixing member comprises a pressure belt which is an endless belt member rotatably supported around the pressure member and the support member with tension. The pressure member is provided to be opposite to the first fixing member with the fixing belt and the pressure belt interposed therebetween, and the fixing nip region is formed at portion where the fixing belt and the pressure belt come into contact with each other. Therefore, it is possible to obtain a wide fixing nip region without increasing the size of the apparatus, and to suppress a mounting fault.

The invention provides a fixing device of two-stage fixing type, comprising:

a first fixing unit that performs primary fixing in which a toner image borne on a recording medium being fed is fixed on the recording medium under application of heat and pressure; and a second fixing unit which performs secondary fixing in which the toner image after the primary fixing is fixed on the recording medium under application of heat and pressure, the second fixing unit being arranged on a downstream side in a feeding direction of the recording medium with respect to the first fixing unit, at least one of the first fixing unit and the second fixing unit being the fixing device mentioned above.

According to the invention, a fixing device of two-stage fixing type comprises a first fixing unit that performs primary fixing in which the toner image borne on the recording medium being fed is fixed on the recording medium under application of heat and pressure, and a second fixing unit that performs secondary fixing in which the toner image after the primary fixing is fixed on the recording medium under application of heat and pressure, the second fixing unit being arranged on a downstream side in a feeding direction of the recording medium with respect to the first fixing unit. At least one of the first fixing unit and the second fixing unit are the fixing device mentioned above which includes the connector comprising integrally the primary-side wiring connector terminals and the secondary-side wiring connector terminals. In the fixing device of two-stage fixing type configured as above, in a state where the temperature detection elements in the first fixing unit and the second fixing unit are not operated normally, and electrical conduction to the heat generating resistor is not controlled normally, it is possible to prevent electrical conduction to the heat generating resistor. For this reason, it is possible to suppress abnormal electrical conduction to the heat generating resistors provided in the first fixing unit and the second fixing unit, preventing the heat generating resistors from being in the overheat state. Therefore, it is possible to prevent the heat generating resistors provided in the first fixing unit and the second fixing unit from resulting in smoke generation or burnout, and high safety is able to be secured.

Further, the invention provides a fixing device of two-stage fixing type, comprising:

a first fixing unit that performs primary fixing in which a toner image borne on a recording medium being fed is fixed on the recording medium under application of heat and pressure; and a second fixing unit that performs secondary fixing in which the toner image after the primary fixing is fixed on the recording medium under application of heat and pressure, the second fixing unit being configured by a pair of heating and pressure rollers that are provided with a heating section in an interior thereof, and are in pressure-contact with each other, and being arranged on a downstream side of a feeding direction of the recording medium with respect to the first fixing unit, and the first fixing unit being the fixing device mentioned above.

According to the invention, a fixing device of two-stage fixing type comprises a first fixing unit that performs primary fixing in which the toner image borne on the recording medium being fed is fixed on the recording medium under application of heat and pressure, and a second fixing unit that performs secondary fixing in which the toner image after the primary fixing is fixed on the recording medium under application of heat and pressure, the second fixing unit being configured by a pair of heating and pressure rollers that are provided with a heating section in an interior thereof, and are in pressure-contact with each other, and being arranged on a downstream side in a feeding direction of the recording medium with respect to the first fixing unit. The first fixing unit is the fixing device mentioned above which includes the connector comprising integrally the primary-side wiring connector terminals and the secondary-side wiring connector terminals. In the fixing device of two-stage fixing type configured as above, in a state where the temperature detection element in the first fixing unit is not operated normally, and electrical conduction to the heat generating resistor is not controlled normally, it is possible to prevent electrical conduction to the heat generating resistor. For this reason, it is possible to suppress electrical conduction to the heat generating resistor provided in the first fixing unit, preventing the heat generating resistor from being in the overheat state. Therefore, it is possible to prevent the heat generating resistor provided in the first fixing unit from resulting in smoke generation or burnout, and high safety is able to be secured.

The invention provides an image forming apparatus comprising the fixing device mentioned above.

According to the invention, an image forming apparatus comprises the fixing device which is capable of preventing electrical conduction to the heat generating resistor in a state where electrical conduction to the heat generating resistor is not controlled normally. For this reason, the image forming apparatus can form images in a state where high safety is secured over a long period of time.

The invention provides a method of connecting wires in a fixing device comprising a first fixing member, a heating section which has a heat generating layer including a heat generating resistor which generates heat due to electrical conduction, a fixing belt which is an endless belt member, the fixing belt being supported around the first fixing member and the heating section with tension, a second fixing member, a temperature detection element which detects a temperature of a surface of the fixing belt, and a control section which controls electrical conduction to the heat generating resistor on a basis of temperature data detected by the temperature detection element such that a surface temperature of the fixing belt is at a predetermined temperature, the method comprising:

connecting primary-side wires leading to the heat generating resistor and secondary-side wires including wires leading to the temperature detection element with the same connector such that the primary-side wires are sandwiched between the secondary-side wires, the secondary-side wires flowing current smaller than the primary-side wires.

According to the invention, the primary-side wires leading to the heat generating resistor and secondary-side wires including the wires leading to the temperature detection element with the same connector such that the primary-side wires are sandwiched between the secondary-side wires, the secondary-side wires flowing current smaller than the primary-side wires. Thus, in a state where the temperature detection element is not operated normally due to a connection fault of the wire of the temperature detection element or the like, and electrical conduction to the heat generating resistor is not controlled normally, it is possible to prevent electrical conduction to the heat generating resistor. For this reason, in the fixing device, abnormal electrical conduction to the heat generating resistor even in a short time can be suppressed, preventing the heat generating resistor from being in the overheat state.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
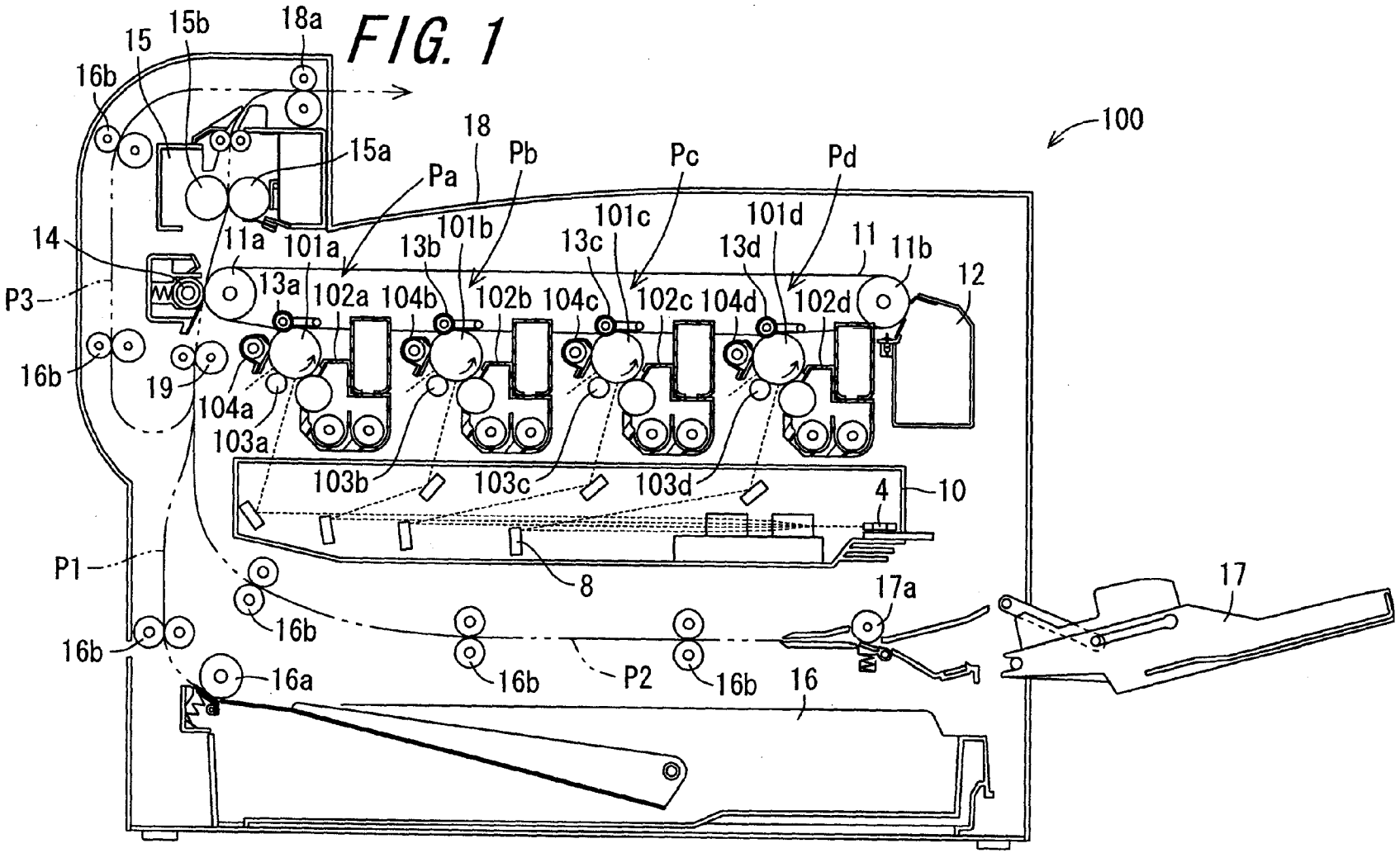
FIG. 1 is a view showing a structure of an image forming apparatus according to an embodiment of the invention.

Now referring to the drawings, preferred embodiments of the invention are described below.

FIG. 1 is a view showing a structure of an image forming apparatus 100 according to an embodiment of the invention. The image forming apparatus 100 is an apparatus that forms a color or monochrome image on a recording paper sheet based on image data read from a document or on image data transmitted through a network and the like. The image forming apparatus 100 includes an exposure unit 10, photoreceptor drums 101 (101*a*, 101*b*, 101*c* and 101*d*), developing devices 102 (102*a*, 102*b*, 102*c* and 102*d*), charging rollers 103 (103*a*, 103*b*, 103*c* and 103*d*), cleaning units 104 (104*a*, 104*b*, 104*c* and 104*d*), an intermediate transfer belt 11, primary transfer rollers 13 (13*a*, 13*b*, 13*c* and 13*d*), a secondary transfer roller 14, a fixing device 15, paper feeding paths P1, P2, and P3, a paper supply cassette 16, a manual paper supply tray 17, and a catch tray 18.

The image forming apparatus 100 performs image formation by using image data corresponding to each of the four colors of black (K), as well as cyan (C), magenta (M), and yellow (Y), which are the three primary subtractive colors obtained by separating colors of a color image, in image forming sections Pa, Pb, Pc and Pd corresponding to the respective colors. The respective image forming sections Pa to Pd are similar to one another in configuration, and for example, the image forming section Pa for black (K) is constituted by the photoreceptor drum 101*a*, the developing device 102*a*, the charging roller 103*a*, the primary transfer roller 13*a*, the cleaning unit 104*a*, and the like. The image forming sections Pa to Pd are arranged in alignment along a direction in which the intermediate transfer belt 11 moves (sub-scanning direction).

The charging rollers 103 are contact-type charging devices for charging surfaces of the photoreceptor drums 101 uniformly to a predetermined potential. Instead of the charging rollers 103, contact-type charging devices using a charging brush, or noncontact-type charging devices using a charging wire is also usable.

The exposure unit 10 includes a semiconductor laser (not shown), a polygon mirror 4, a first reflection mirror, a second reflection mirror 8, and the like, and irradiates each of the photoreceptor drums 101*a* to 101*d* with each light beam such as a laser beam modulated according to image data of the respective colors of black (K), cyan (C), magenta (M), and yellow (Y). Each of the photoreceptor drums 101*a* to 101*d* forms thereon an electrostatic latent image corresponding to the image data of the respective colors of black (K), cyan (C), magenta (M), and yellow (Y).

The developing devices 102 supply toner as developer to the surfaces of the photoreceptor drums 101 on which the electrostatic latent images are formed, to develop the electrostatic latent images to a toner image. The respective developing devices 102*a* to 102*d* contain toner of the respective colors of black (K), cyan (C), magenta (M), and yellow (Y), and visualize the electrostatic latent images of the respective colors formed on the respective photoreceptor drums 101*a* to 101*d* into toner images of the respective colors. The cleaning units 104 remove and collect residual toner on the surfaces of the photoreceptor drums 101 after development and image transfer.

The intermediate transfer belt 11 provided above the photoreceptor drums 101 is supported around a driving roller 11*a* and a driven roller 11*b* with tension, and forms a loop-shaped moving path. An outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* with the intermediate transfer belt 11 interposed therebetween. The respective positions at which the intermediate transfer belt 11 faces the photoreceptor drums 101*a* to 101*d* are primary transfer positions. In addition, the intermediate transfer belt 11 is formed of a film having thickness of 100 to 150 μm.

A primary transfer bias voltage having an opposite polarity to the polarity of the toner is applied under constant voltage control to the primary transfer rollers 13*a* to 13*d* in order to transfer the toner images borne on the surfaces of the photoreceptor drums 101*a* to 101*d* onto the intermediate transfer belt 11. Thus, the toner images of the respective colors formed on the photoreceptor drums 101*a* to 101*d* are transferred and overlapped onto the outer circumferential surface of the intermediate transfer belt 11 on top of each other to form a full-color toner image on the outer circumferential surface of the intermediate transfer belt 11.

Here, when image data for only a part of the colors of yellow (Y), magenta (M), cyan (C) and black (B) is inputted, electrostatic latent images and toner images are formed at only a part of the photoreceptor drums 101 corresponding to the colors of the inputted image data among the four photoreceptor drums 101*a* to 101*d*. For example, during monochrome image formation, an electrostatic latent image and a toner image are formed only at the photoreceptor drum 101*a* corresponding to black color, and only a black toner image is transferred onto the outer circumferential surface of the intermediate transfer belt 11.

The respective primary transfer rollers 13*a* to 13*d* have a structure comprising a shaft having a diameter of 8 to 10 mm, made of a metal such as stainless steel and serving as a substrate, and a conductive elastic material (for example, EPDM or urethane foam) with which a surface of the shaft is coated, and uniformly apply a high voltage to the intermediate transfer belt 11 by the conductive elastic material.

The toner image transferred onto the outer circumferential surface of the intermediate transfer belt 11 at each of the primary transfer positions is fed to a secondary transfer position, which is a position facing the secondary transfer roller 14, by the rotation of the intermediate transfer belt 11. The secondary transfer roller 14 is brought into pressure-contact with, at a predetermined nip pressure, the outer circumferential surface of the intermediate transfer belt 11 whose inner circumferential surface is in contact with a circumferential surface of the driving roller 11*a* during image formation. While a recording paper sheet supplied from the paper supply cassette 16 or the manual paper supply tray 17 passes between the secondary transfer roller 14 and the intermediate transfer belt 11, a high voltage with the opposite polarity to the charging polarity of the toner is applied to the secondary transfer roller 14. Thus, the toner image is transferred from the outer circumferential surface of the intermediate transfer belt 11 to the surface of the recording paper sheet.

Note that, of the toner attached from the photoreceptor drums 101 to the intermediate transfer belt 11, toner that has not been transferred onto the recording paper sheet and remains on the intermediate transfer belt 11 is collected by a transfer cleaning unit 12 in order to prevent color mixture in the following process.

The recording paper sheet to which the toner image is transferred is guided to the fixing device 15 described below according to an embodiment of the invention, passes through the fixing nip region, and is subjected to heat and pressure. Thus, the toner image is solidly fixed onto the surface of the recording paper sheet. The recording paper sheet onto which the toner image is fixed is discharged onto the catch tray 18 by paper discharge rollers 18*a*.

Moreover, the image forming apparatus 100 is provided with the paper feeding path P1 extending in a substantially vertical direction, for supplying a recording paper sheet contained in the paper supply cassette 16 through a region between the secondary transfer roller 14 and the intermediate transfer belt 11, and by way of the fixing device 15, to the catch tray 18. The paper feeding path P1 is provided with a pickup roller 16*a* for picking up recording paper sheets in the paper supply cassette 16 in the paper feeding path P1 sheet by sheet, feeding rollers 16*b* for feeding the supplied recording paper sheet upward, registration rollers 19 for guiding the fed recording paper sheet between the secondary transfer roller 14 and the intermediate transfer belt 11 at a predetermined timing, and the paper discharge rollers 18*a* for discharging the recording paper sheet onto the catch tray 18.

Moreover, inside the image forming apparatus 100, the paper feeding path P2 on which a pickup roller 17*a* and feeding rollers 16*b* are disposed is formed between the manual paper supply tray 17 and the registration rollers 19. In addition, the paper feeding path P3 is formed between the paper discharge rollers 18*a* and the upstream side of the registration rollers 19 in the paper feeding path P1.

The paper discharge rollers 18*a* freely rotate in both forward and reverse directions, and are driven in the forward direction to discharge a recording paper sheet onto the catch tray 18 during single-sided image formation in which images are formed on one side of the recording paper sheets, and during second side image formation of double-sided image formation in which images are formed on both sides of the recording paper sheet. On the other hand, during first side image formation of double-sided image formation, the paper discharge rollers 18*a* are driven in the forward direction until a tail edge of the recording paper sheet passes through the fixing device 15, and are then driven in the reverse direction to bring the recording paper sheet into the paper feeding path P3 in a state where the tail edge of the recording paper sheet is held. Thus, the recording paper sheet on which an image has been formed only on one side during double-sided image formation is brought into the paper feeding path P1 in a state where the recording paper sheet is turned over and upside down.

The registration rollers 19 bring the recording paper sheet that has been supplied from the paper supply cassette 16 or the manual paper supply tray 17, or has been fed through the paper feeding path P3 between the secondary transfer roller 14 and the intermediate transfer belt 11 at a timing synchronized with the rotation of the intermediate transfer belt 11. Thus, the rotation of the registration rollers 19 is stopped when the operation of the photoreceptor drums 101 or the intermediate transfer belt 11 is started, and the movement of the recording paper sheet that has been supplied or fed prior to the rotation of the intermediate transfer belt 11 is stopped in the paper feeding path P1 in a state where a leading edge thereof abuts against the registration rollers 19. Then, the rotation of the registration rollers 19 is started at a timing when the leading edge of the recording paper sheet faces a leading edge of a toner image formed on the intermediate transfer belt 11 at a position where the secondary transfer roller 14 is brought into pressure-contact with the intermediate transfer belt 11.

Note that, during full-color image formation in which image formation is performed by all of the image forming sections Pa to Pd, all of the primary transfer rollers 13*a* to 13*d* bring the intermediate transfer belt 11 into pressure-contact with the photoreceptor drums 101*a* to 101*d*. On the other hand, during monochrome image formation in which image formation is performed only by the image forming section Pa, only the primary transfer roller 13*a* brings the intermediate transfer belt 11 into pressure-contact with the photoreceptor drum 101*a*.

Figure 2:
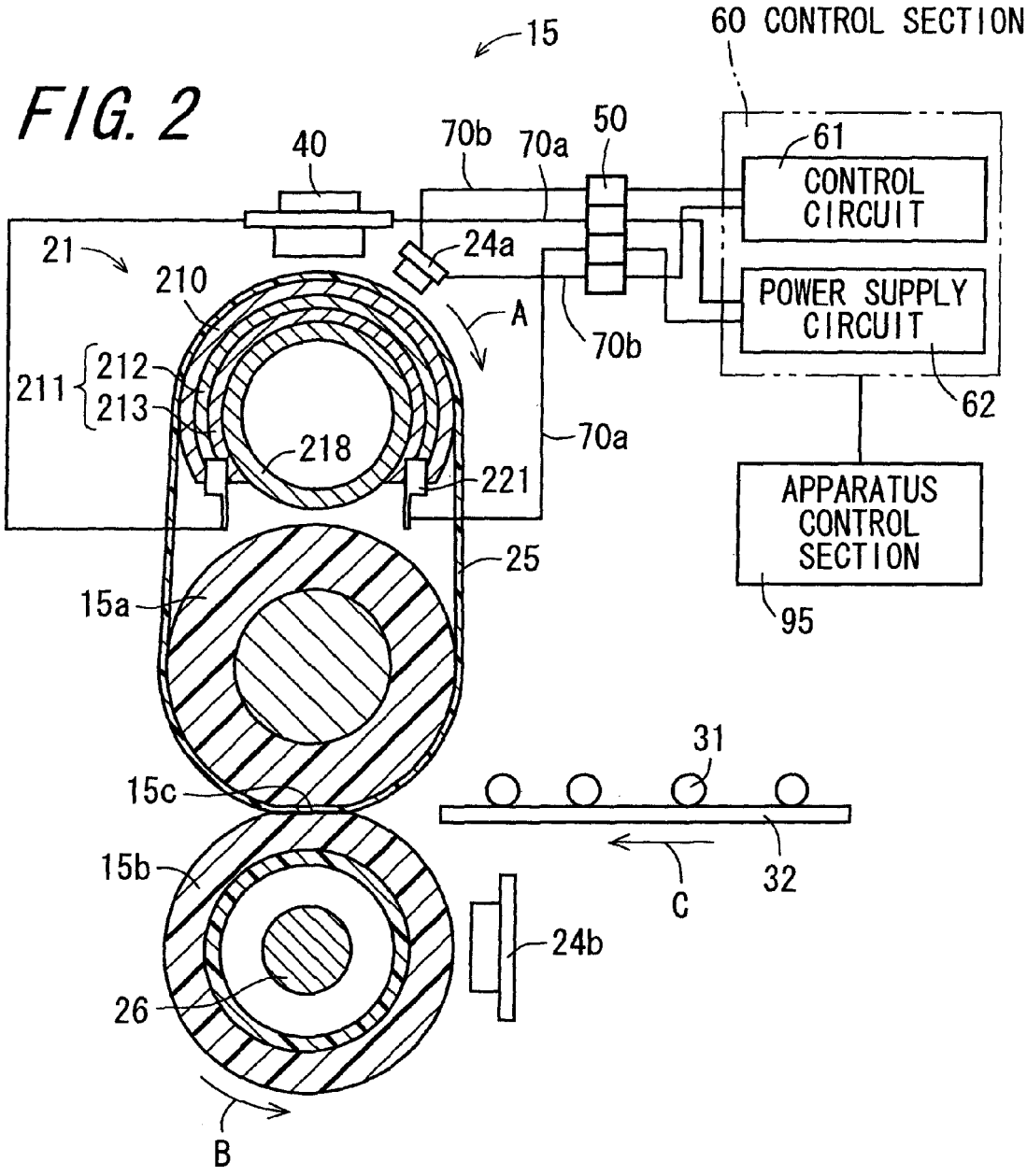
FIG. 2 is a diagram showing a configuration of a fixing device according to a first embodiment of the invention.

FIG. 2 is a diagram showing a configuration of the fixing device 15 according to a first embodiment of the invention. The fixing device 15, which is detachably provided in a main body of the image forming apparatus 100, includes a fixing roller 15*a* serving as a first fixing member, a pressure roller 15*b* serving as a second fixing member, a fixing belt 25 serving as an endless belt member, a heating section 21, a connector 50, and a control section 60. In the fixing device 15, the fixing belt 25 is supported around the fixing roller 15*a* and the heating section 21 with tension, and the pressure roller 15*b* is arranged to be opposite to the fixing roller 15*a* with the fixing belt 25 interposed therebetween. The fixing roller 15*a* and the heating section 21 are substantially arranged in parallel in the axial direction of the fixing roller 15*a*. For this reason, when the fixing belt 25 which is supported around the fixing roller 15*a* and the heating section 21 with tension slides, it is possible to prevent snaking of the fixing belt 25, thereby maintaining high durability of the fixing belt 25.

The fixing device 15 is a fixing device of belt fixing type in which the heating section 21 comes into contact with the fixing belt 25 to heat the fixing belt 25, and when a recording paper sheet 32 serving as a recording medium is fed in a feeding direction C, and passes through a fixing nip region 15*c* formed by the fixing belt 25 and the pressure roller 15*b* at predetermined fixing speed and copy speed, an unfixed toner imager 31 borne on the recording paper sheet 32 is fixed onto the recording paper sheet 32 under application of heat and pressure. In such a fixing device 15 of belt fixing type, the fixing belt 25 having a small heat capacity is heated by the heating section 21 having a heat generating layer 212 including a high-power-density heat generating resistor. Therefore, the warm-up time is short, thus, it is possible to suppress an increase in power consumption, thereby achieving power saving.

Note that the unfixed toner image 31 is formed of, for example, a developer (toner) such as a non-magnetic one-component developer (non-magnetic toner), a non-magnetic two-component developer (non-magnetic toner and carrier), or a magnetic developer (magnetic toner). Moreover, the "fixing speed" corresponds to a so-called process speed, and the "copying speed" corresponds to the number of copies obtained per minute. Further, when the recording paper sheet 32 passes through the fixing nip region 15*c*, the fixing belt 25 abuts against a toner image-bearing surface of the recording paper sheet 32.

The fixing roller 15*a* is brought into pressure-contact with the pressure roller 15*b* with the fixing belt interposed therebetween to thereby form the fixing nip region 15*c*, and at the same time, is rotated in a rotation direction A about a rotation axis by a drive motor (driving section) (not shown) to thereby cause the fixing belt 25 to run. The fixing roller 15*a* has a diameter of mm and has a two-layered structure consisting of a core metal and an elastic layer, which are formed in this order from inside. For the core metal, for example, a metal such as iron, stainless steel, aluminum, and copper, an alloy thereof, or the like are used. Moreover, for the elastic layer, a rubber material having heat resistance such as silicone rubber and fluorine rubber is suitable. Note that, in this embodiment, a force when the fixing roller 15*a* is brought into pressure-contact with the pressure roller 15*b* with the fixing belt 25 interposed therebetween is about 216 N.

The pressure roller 15*b* is provided to be opposite and in pressure-contact with the fixing roller 15*a* with the fixing belt 25 interposed therebetween. The pressure roller 15*b* is freely rotate about its rotation axis. The pressure roller 15*b* is rotated in a rotation direction B by rotation of the fixing roller 15*a*. The pressure roller 15*b* has a three-layered structure consisting of a core metal, an elastic layer, and a release layer, which are formed in this order from inside. For the core metal, for example, a metal, such as iron, stainless steel, aluminum, or copper, or an alloy thereof is used. For the elastic layer, a heat resistant rubber material such as silicone rubber or fluorine rubber is suitable. For the release layer, fluorine resin such as PFA (a copolymer of tetrafluoroethylene and perfluoroalkyl vinyl ether) or PTFE (polytetrafluoroethylene) is suitable. For the pressure roller 15*b*, for example, a roller may be used in which the diameter of the roller is 30 mm, an iron (STKM) pipe having a diameter of 24 mm (thickness 2 mm) is used for the core metal, solid silicone rubber having a thickness of 3 mm is used for the elastic layer, and a PFA tube having a thickness of 30 μm is used for the release layer.

The pressure roller 15*b* is provided with a heater lamp 26 (for example, rated power 400 W) in an interior thereof to heat the pressure roller 15*b*. A control circuit 61 of the control section 60 causes power to be supplied (energized) from a power supply circuit 62 to the heater lamp 26, the heater lamp 26 emits light, and infrared rays are radiated from the heater lamp 26. Thus, the inner circumferential surface of the pressure roller 15*b* absorbs the infrared rays and is heated, such that the entire pressure roller 15*b* is heated. Although the above-described heater lamp 26 heats the pressure roller 15*b* from the inner surface, the pressure roller 15*b* may be heated by a roller for outer circumference heating, from a surface thereof.

The fixing belt 25 is heated to a predetermined temperature by the heating section 21 and heats the recording paper sheet 32 having the unfixed toner image 31 formed thereon that passes through the fixing nip region 15*c*. The fixing belt 25 is an endless-shaped belt and is supported around the heating section 21 and the fixing roller 15*a* and wound up by the fixing roller 15*a* with a predetermined angle. During rotation of the fixing roller 15*a*, the fixing belt 25 is rotated in the rotation direction A by rotation of the fixing roller 15*a*. The fixing belt 25 has a three-layered structure consisting of a substrate having a hollow cylindrical shape made of a heat resistant resin such as polyimide or a metal material such as stainless steel and nickel, an elastic layer formed on a surface of the substrate, made of an elastomer material (for example, silicone rubber) having excellent heat resistance and elasticity, and a release layer formed on a surface of the elastic layer, made of a synthetic resin material (for example, a fluorine resin such as PFA or PTFE) having excellent heat resistance and releasing property. Moreover, a fluorine resin may be added into polyimide constituting the substrate. This makes it possible to reduce a slide load with the heating section 21.

Figure 3:
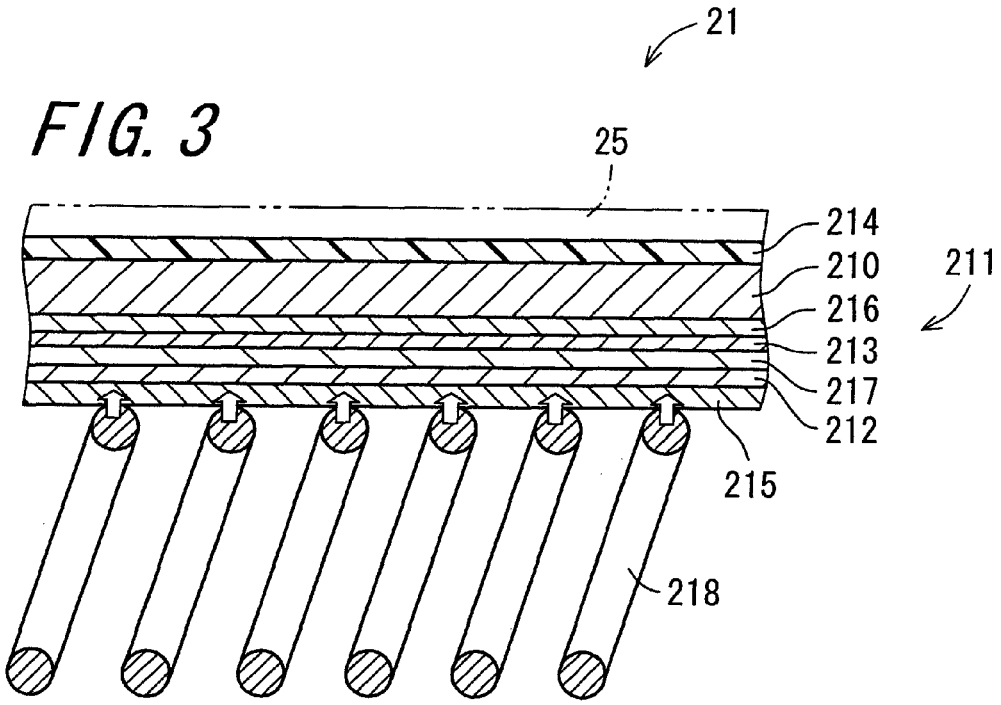
FIG. 3 is a diagram showing the configuration of a heating section provided in the fixing device.

The heating section 21 comes into contact with the fixing belt 25 to heat the fixing belt 25 at a predetermined temperature. FIG. 3 is a diagram showing a configuration of the heating section 21 provided in the fixing device 15. The heating section 21 is formed into a semicylindrical shape, and includes a heat radiating member 210, a heat generating member 211, and an inside securing member 218.

The heat radiating member 210 is a member which extends in a width direction of the fixing belt 25 (an axial direction of the fixing roller 15*a*) and has a curved shape along a surface of the fixing belt 25, and is arranged to come into contact with the fixing belt 25 on the outer circumferential surface thereof so as to transmit heat generated from the heat generating member 211 to the fixing belt 25. Although a material that constitutes the heat radiating member 210 is not particularly limited, a metal material having high thermal conductivity is preferable, and as the metal material, iron, aluminum, copper or the like is able to be included, however, stainless steel is also usable. Then, in the heat radiating member 210, a coat layer 214 is formed on the outer circumferential surface thereof in contact with the fixing belt 25.

The coat layer 214 should be formed by a material having thermal conductivity for conducting heat generated from the heat generating member 211 to the fixing belt 25, and capable of reducing the frictional force with the fixing belt 25. By forming such a coat layer 214, heat is conducted to the fixing belt 25 as well as wear of the fixing belt 25 that slides in contact with the heat radiating member 210 is prevented so that excellent durability is able to be secured. Moreover, since the frictional force with the fixing belt 25 is able to be reduced, load to the fixing roller 15*a* and the pressure roller 15*b* which drive the fixing belt 25 is able to be reduced, and durability of the respective rollers 15*a* and 15*b* is ensured, thus enables driving by a lower torque. Examples of the material constituting the coat layer 214 include a fluorine resin such as a PFA or a PTFE. In the embodiment, the coat layer 214 is a layer formed of a PTFE and having a thickness of 20 μm.

The inside securing member 218 is a member that holds the heat generating member 211 by being in line-contact with or in point-contact with one surface of a thickness direction of the heat generating member 211 so as to elastically press the heat generating member 211 toward a direction moving closer to the heat radiating member 210 and by allowing another surface of the thickness direction of the heat generating member 211 to be in surface-contact with the inside surface of the heat radiating member 210. The inside securing member 218 allows the heat generating layer 212 including the heat generating resistor such as a ceramic heat generating element or a metallic heat generating resistor to contact an inner surface of the heat radiating member 210 stably so that heat generated from the heat generating layer 212 is heat-transferred effectively to the heat radiating member 210, and thereby prevents that only the heat generating resistor of the heat generating layer 212 is regionally overheated and breakage thereof is caused.

In the embodiment, the inside securing member 218 is a spiral-shaped member formed to be a spiral shape using a wire. Specifically, a wire formed of stainless steel and having a wire diameter of 1 mm is formed to be a spiral shape and an outer diameter of the coil in a stationary placed state is 29.5 mm, and a space between respective spires is 5 mm. A material constituting the wire may be, other than stainless steel, for example, copper, iron, nickel, alloy thereof, or heat resistant resin. In a case where the inside securing member 218 is formed of the heat resistant resin, the member is able to be caused to be more excellent in heat insulation compared with a case of being formed by metal, and it is possible to increase an effect to suppress heat loss caused by transmitting heat generated in the heat generating layer 212 to the inside securing member 218 and dissipated. On the other hand, in a case where the inside securing member 218 is formed of metal, the member is able to be caused to be more excellent in heat resistance and elastic coefficient thereof is higher compared with a case of being formed by the resin, and it is possible to increase an effect of elastically pressing the heat generating member 211 toward the direction moving closer to the heat radiating member 210 so as to hold stably at a predetermined position.

In addition, the wire diameter, the coil outer diameter, the space of spires, and constituent material of the wire are not limited to the above-described configuration, and setting may be performed such that spring elasticity is able to be exerted under high temperature environment when formed into a spiral shape.

A fixing method of holding and fixing the heat generating member 211 using the inside securing member 218 at a predetermined position which faces the inside surface of the heat radiating member 210 is as follows. First, another surface of the thickness direction of the heat generating member 211 is arranged to face the inside surface of the heat radiating member 210. Next, the inside securing member 218 formed to be a spiral shape is fixed so that, of an outer circumferential part of each of the spires of the spiral shaped part which lies outwardly in a radial direction thereof, an entire part facing a surface of the thickness direction of the heat generating member 211 is to be in line-contact with an entire region across a circumferential direction (short-side direction) of the heat generating member 211. At this time, in the inside securing member 218 formed to be a spiral shape, force to restore acts by the elasticity generated by the change of the coil outer diameter in the spiral shaped part, and the restoring force to restore acts as force to elastically press the heat generating member 211 toward the direction moving closer to the heat radiating member 210. In this manner, since the restoring force of the inside securing member 218 acts to hold the heat generating member 211 on the inside surface of the heat radiating member 210, the heat generating member 211 is held in a state where another surface of the thickness direction thereof is in surface-contact with the inside surface of the heat radiating member 210.

Since the heat generating member 211 is elastically pressed and held toward the direction moving closer to the heat radiating member 210 by the restoring force of the inside securing member 218, even though the heat radiating member 210 and the heat generating member 211 expand and contract by heating, or the inside securing member 218 itself expands and contracts by heat, the spiral shaped part of the inside securing member 218 shifts in accordance with the expansion and contraction, and thereby the heat generating member 211 is able to be stably held at a predetermined position on the inside surface of the heat radiating member 210. Moreover, by changing the space and the arranged position of each of the spires in the spiral shaped part of the inside securing member 218, pressing force distribution of the heat generating member 211 against the inside surface of the heat radiating member 210 is able to be changed.

As above, the heating section 21 can be obtained in which the inside securing member 218 is in line-contact with a surface of the thickness direction of the heat generating member 211 to elastically press the heat generating member 211 toward the direction moving closer to the heat radiating member 210, and the heat generating member 211 is held so that another surface of the thickness direction thereof is in surface-contact with the inside surface of the heat radiating member 210.

Note that, in the inside securing member 218, other than forming into a spiral shape by using a wire whose cross-section is a circular shape, an extra fine plate-like member whose cross-section is an elliptical shape or a polygonal shape may be used to form a spiral shape. Furthermore, a shape of each of the spires when viewed from the axial direction in a state where the inside securing member 218 formed to be a spiral shape is stationary placed is able to be set to various shapes. Additionally, in the embodiment, although the inside securing member 218 formed into a spiral shape is used, it is not limited thereto, and may be configured by various shapes and material, when the configuration is such that holding the heat generating member 211 by being in line-contact with or in point-contact with the surface of the thickness direction of the heat generating member 211 so as to elastically press the heat generating member 211 toward the direction moving closer to the heat radiating member 210 and thereby allows another surface of the thickness direction of the heat generating member 211 to be in surface-contact with the inside surface of the heat radiating member 210.

The heat generating member 211 is held so that the inside securing member 218 is in line-contact or in point-contact with a surface of the thickness direction thereof and thereby allows another surface of the thickness direction thereof to be in surface-contact with the heat radiating member 210. The heat generating member 211 has a layered structure in which on the surface of a second insulating layer 215, a heat generating layer 212, second good thermal conductor layer 217, a first insulating layer 213, and a first good thermal conductor layer 216 are layered in this order, and a surface of a side on which the second insulating layer 215 is formed is a surface of a side in contact with the inside securing member 218, and a surface of a side on which the first good thermal conductor layer 216 is formed is a surface of a side in contact with the inside surface of the heat radiating member 210. Then, the heat generating member 211 extends in the longitudinal direction of the heat radiating member 210 (width direction of the fixing belt 25), and is held by the inside securing member 218 so as to be in surface-contact with the heat radiating member 210 along a curved inside surface thereof. Then, at both end portions in the longitudinal direction of the heat generating member 211 (longitudinal direction of the heat radiating member 210), power feeding terminal sections 221 are formed.

The first insulating layer 213 and the second insulating layer 215 are layers formed by a material having both the heat resistance and the electrical insulation properties. As the material having both the heat resistance and the electrical insulation properties, although not particularly limited, examples thereof include a heat resistant polymer material such as a polyimide resin and ceramics material such as alumina. In the embodiment, the first insulating layer 213 and the second insulating layer 215 are layers formed of a polyimide resin and having a thickness of 30 μm. The first insulating layer 213 is interposed between the heat generating layer 212 and the heat radiating member 210 to ensure insulation therebetween, and the second insulating layer 215 is interposed between the heat generating layer 212 and the inside securing member 218 to ensure insulation therebetween. In this manner, since the first insulating layer 213 and the second insulating layer 215 electrically insulate the heat generating layer 212 including the heat generating resistor that generates heat due to electrical conduction, it is possible obtain the heating section 21 being free from danger. Furthermore, in the embodiment, although it is configured that two layers each formed of a polyimide resin and having a thickness of 30 μm are provided as the insulator, in order to improve electrical insulation property, the thickness may be made thicker (for example, 100 μm) or the number of layers may be increased. In addition, the first insulating layer 213 and the second insulating layer 215 are preferable to have the high thermal conductivity, and thereby degradation of the heating property of the heating section 21 is able to be prevented.

The first good thermal conductor layer 216 that is interposed between the heat radiating member 210 and the first insulating layer 213, and the second good thermal conductor layer 217 that is interposed between the heat generating layer 212 and the first insulating layer 213 are layers formed for improving the thermal conductivity with which heat generated in the heat generating layer 212 is conducted to the heat radiating member 210. As a material constituting the first good thermal conductor layer 216 and the second good thermal conductor layer 217, although not particularly limited as long as the material is excellent in thermal conductivity even under the high temperature environment and hard to cause a time-dependent change, examples thereof include a heat resistant silicone grease having heat resistance of 300° C. or more. Furthermore, in order to further improve the thermal conductivity, one that powder of gold, silver, copper, platinum, carbon or graphite is added to the heat resistant silicone grease may be used, and when the substance is such as rubber, metal which is rich in elasticity, or the like, to accelerate the thermal conduction by filling a gap of a contact part, although the material is not particularly limited, nor the form of solid, liquid or gas is considered, the one whose heat capacity is small and thermal conductivity is high is preferable. Moreover, the first good thermal conductor layer 216 and the second good thermal conductor layer 217 are preferable to have the higher thermal conductivity than other that of layers constituting the heat generating member 211, and thereby degradation of the heating property of the heating section 21 is able to be prevented.

When a space is formed between the heat generating layer 212 and the first insulating layer 213, and in a overlapping part on the surface of the side that contacts the inside surface of the heat radiating member 210, a layer of air is interposed therebetween and thereby the thermal conductivity deteriorates. Therefore, by arranging the first and second good thermal conductor layers 216 and 217, the layer of air that increases resistance to heat is removed and thereby the thermal conductivity is able to be improved. Moreover, when the first good thermal conductor layer 216 is arranged between the heat generating layer 212 and the first insulating layer 213, and the second good thermal conductor layer 217 is arranged on the surface of the side that contacts the inside surface of the heat radiating member 210, since heat generated in the heat generating layer 212 is quickly transmitted to the inside surface of the heat radiating member 210 through the first and second good thermal conductor layers 216 and 217, shortening of the warm-up time or uniformity of the temperature distribution on the surface of the heat radiating member 210 is able to be ensured in a short time, and even in the high-speed printing, sufficient amount of heat is able to be supplied from the heat radiating member 210 to the fixing belt 25.

Next, description will be given for the heat generating layer 212 provided in the heat generating member 211. The heat generating layer 212 is a layer including the heat generating resistor that generates heat with the Joule heat generated by applying voltage to the power feeding terminal sections 221 to be energized.

Figure 4:
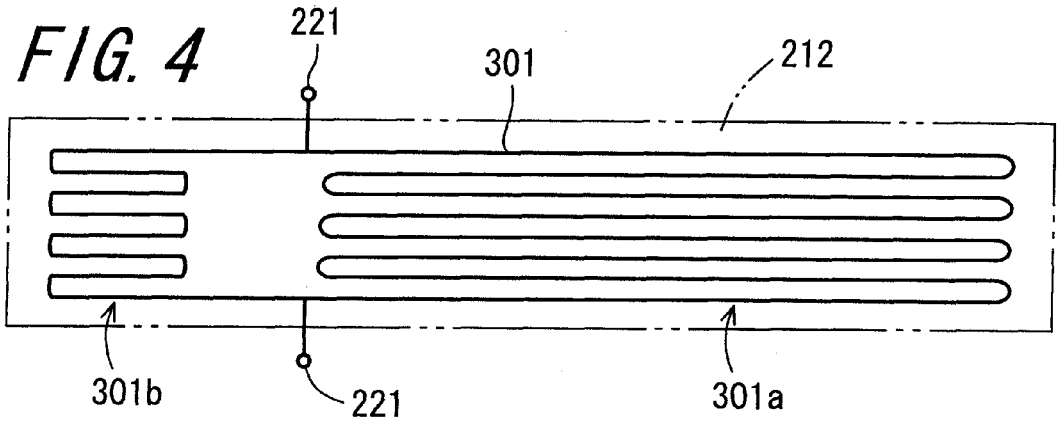
FIG. 4 is a view showing a configuration of a heat generating resistor formed on a heat generating layer.

FIG. 4 is a view showing a configuration of a heat generating resistor 301 formed on the heat generating layer 212. In the heat generating layer 212, one piece of heat generating resistor 301 repeats flexions so as to form a fixed surface as a whole. Whereby, the efficiency of heat transfer in transmitting heat of the heat generating resistor 301 generated due to electrical conduction to the heat radiating member 210 is able to be improved.

Examples of the heat generating resistor 301 constituting the heat generating layer 212 include a metal material mainly containing nickel-chromium alloy, a metal resistor having an electrically resistive component made of stainless steel, and a resistant material such as silver-palladium-based material. A ceramic heat generating element in which a resistance wire having a width of about 1 mm is formed on a ceramic substrate having a width of 12 mm by screen printing, a ceramic heat generating element in which a plurality of thin-film ceramic sheets are laminated and a fine resistance wire is formed between the sheets and fired, or a ceramic heat generating element in which an inorganic material mainly containing barium titanate-based semiconductor ceramic is fired may be used as a heat generating resistor 301. A ceramic heat generating element is a heat generating element that can realize high power density. Thus, the heat generating member 211 that has the heat generating layer 212 including a ceramic heat generating element has a high thermoresponsive rate, thereby reducing the warm-up time, and has high heating capability with respect to the heat radiating member 210.

The heat generating resistor 301 then includes a paper passing region heating section 301*a* and a detecting section 301*b*. The paper passing region heating section 301*a* of the heat generating resistor 301 is formed in a region which is the heat generating source part for heating the paper passing region of the fixing belt 25, which is on the surface of the heat generating layer 212. The detecting section 301*b* of the heat generating resistor 301 is provided on an end portion of the axial direction (longitudinal direction) of the heat generating member 211 corresponding to the paper non-contacting region of the recording paper sheet 32 (region that even the recording paper sheet 32 of a maximum size does not contact) on the fixing belt 25, and electrically connected in parallel with the paper passing region heating section 301*a*.

Note that, the paper passing region heating section 301*a* of the heat generating layer 212 is formed to have a substantially equivalent area to a contact area where the heat radiating member 210 contacts the fixing belt 25, and the detecting section 301*b* of the heat generating layer 212 is formed to have a substantially equivalent area to a heat receiving surface of an overheat preventing element 40.

Returning to FIG. 2, the overheat preventing element 40 is provided in the vicinity of the detecting section 301*b* of the heat generating resistor 301. Although the details will be described below, when the temperature of the detecting section 301*b* of the heat generating resistor 301 reaches a preset value, the overheat preventing element 40 suppresses electrical conduction to the heat generating resistor 301. The overheat preventing element 40 is, for example, a thermostat or a thermal protector. The overheat preventing element 40 including a thermostat or a thermal protector receives heat energy radiated from the detecting section 301*b* through a heat receiving surface, and when the temperature of the detecting section 301*b* reaches the predetermined value, a bimetal disposed in an interior thereof operates to open a contact circuit and to shut off electrical conduction to the heat generating resistor 301.

Further, in the fixing device 15, a heat generating element-side thermistor 24*a* serving as a temperature detection element is provided on the circumferential surface of the fixing belt 25 in contact with the heating section 21, and a pressure roller-side thermistor 24*b* is provided on the circumferential surface of the pressure roller 15*b*. The heat generating element-side thermistor 24*a* and the pressure roller-side thermistor 24*b* detect the surface temperatures of the fixing belt 25 and the pressure roller 15*b*, respectively.

In the fixing device 15, the heat generating element-side thermistor 24*a* and the pressure roller-side thermistor 24*b* are arranged not to be in contact with the fixing belt 25 and the pressure roller 15*b*. At this time, when a thermistor is used as the temperature detection element, a space of, for example, about 1.0 to 6.0 mm is preferably provided between the temperature detection element and the temperature detection-target object (the fixing belt 25 and the pressure roller 15*b*). When an infrared sensor using a thermopile is used as the temperature detection element, a space of, for example, about 30 to 100 mm is preferably provided between the temperature detection element and the temperature detection-target object. In this way, the heat generating element-side thermistor 24*a* and the pressure roller-side thermistor 24*b* are arranged not to be in contact with the fixing belt 25 and the pressure roller 15*b*, thus it is possible to prevent the surfaces of the fixing belt 25 and the pressure roller 15*b* from being damaged and to prevent occurrence of a fault in the fixed image.

Although in this embodiment, the heat generating element-side thermistor 24*a* is arranged with a space with respect to the outer circumferential surface of the fixing belt 25, a cutout or a concave portion may be formed in the heat radiating member 210, and the heat generating element-side thermistor 24*a* may be arranged to be engaged with the cutout or the concave portion.

In the fixing device 15, the control circuit 61 of the control section 60 controls electrical conduction to the heat generating member 211 of the heating section 21 and the heater lamp 26 through the power supply circuit 62 on the basis of temperature data detected by the heat generating element-side thermistor 24*a* and the pressure roller-side thermistor 24*b* and abnormal temperature rising data detected by the overheat preventing element 40 such that the surface temperature of each of the fixing belt 25 and the pressure roller 15*b* is at a predetermined temperature. The control circuit 61 rotates the fixing roller 15*a* about the rotation axis to rotate the fixing belt 25. The control section 60 having the control circuit 61 and the power supply circuit 62 is controlled overall by an apparatus control section 95 which is provided in the image forming apparatus 100 to control the entire operation of the image forming apparatus 100.

Specifically, if an image formation instruction is inputted, the apparatus control section 95 outputs a control signal to instruct power supply to the power supply circuit 62. The image formation instruction is an instruction which is inputted from an operation panel provided on the top surface in the vertical direction of the image forming apparatus 100 or an external apparatus, such as a computer, connected to the image forming apparatus 100. If the image formation instruction is inputted, the fixing device 15 starts the fixing processing operation.

When the control signal is inputted from the apparatus control section 95, the power supply circuit 62 supplies power to the heat generating resistor 301 of the heat generating member 211 to heat the fixing belt 25, and supplies power to the heater lamp 26 to heat the pressure roller 15*b*. A signal regarding surface temperature data of the fixing belt 25 detected by the heat generating element-side thermistor 24*a*, a signal regarding surface temperature data of the pressure roller 15*b* detected by the pressure roller-side thermistor 24*b*, and a signal regarding abnormal temperature rising data of the fixing belt 25 detected by the overheat preventing element 40 are inputted to the control circuit 61.

The control circuit 61 which is controlled by the apparatus control section 95 controls power to be supplied from the power supply circuit 62 to the heat generating resistor 301 and the heater lamp 26 on the basis of the input signals such that the surface temperature of each of the fixing belt 25 and the pressure roller 15*b* is at a predetermined temperature (fixing temperature). Specifically, the power supply circuit 62 controls power to be supplied to the heat generating resistor 301 on the basis of temperature data detected by the heat generating element-side thermistor 24*a*. Further, the power supply circuit 62 controls power to be supplied to the heater lamp 26 on the basis of temperature data detected by the pressure roller-side thermistor 24*b*.

When it is determined on the basis of the input signals that the surface temperature of each of the fixing belt 25 and the pressure roller 15*b* is at a predetermined fixing temperature, the control circuit 61 causes the fixing roller 15*a* to rotate about the rotation axis to rotate the fixing belt 25. When the fixing belt 25 rotates in such a manner, the recording paper sheet 32 on which the unfixed toner image 31 is borne is fed to the fixing nip region 15*c* formed between the fixing belt 25 and the pressure roller 15*b*. At this time, the recording paper sheet 32 is fed in a state where the surface on which the unfixed toner image 31 is borne turns toward the fixing belt 25. The unfixed toner image 31 on the recording paper sheet 32 is sandwiched and fed in a state of being in close contact with the outer circumferential surface of the fixing belt 25, such that the toner image 31 is subjected to heat from the fixing belt 25 and a pressing force, and then fixed onto the surface of the recording paper sheet 32.

Figure 5:
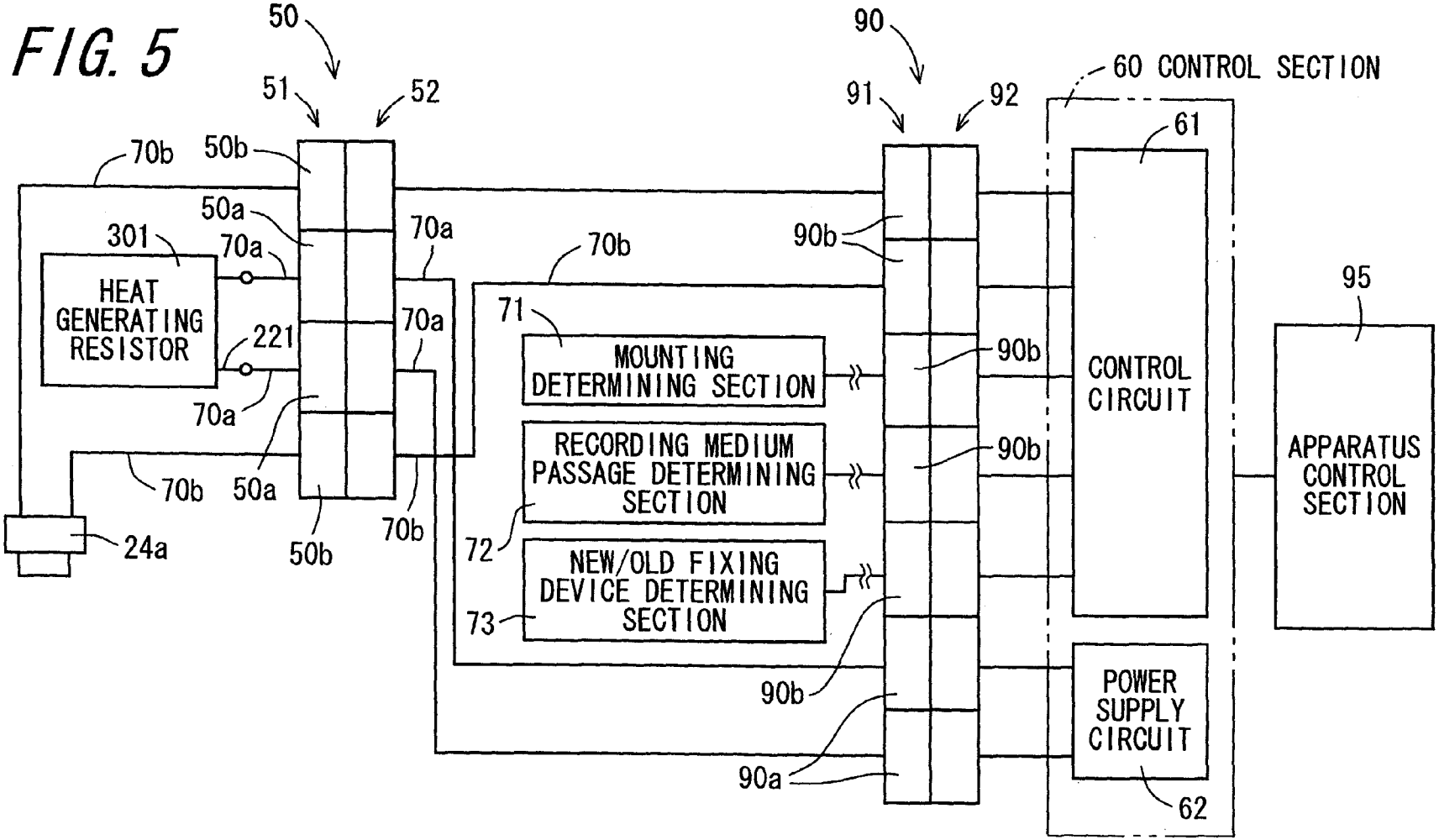
FIG. 5 is a diagram showing a connection state of wires in the fixing device.

FIG. 5 is a diagram showing a connection state of wires in the fixing device 15. In the fixing device 15, primary-side wires 70*a* each leading to the heat generating resistor 301 and secondary-side wires 70*b* including wires each leading to the heat generating element-side thermistor 24*a* as a temperature detection element are connected to the connector 50, the secondary-side wires 70*b* flowing current smaller than the primary-side wires 70*a*.

The connector 50 is configured such that a first connector piece 51 and a second connector piece 52 with a plurality of connector terminals (for example, four connector terminals) arranged are detachably engaged with each other. The connector 50 comprises integrally primary-side wiring connector terminals 50*a* to be connected to the primary-side wires 70*a* and the secondary-side wiring connector terminals 50*b* to be connected to the secondary-side wires 70*b*. In the fixing device 15, the connector 50 is configured such that the primary-side wiring connector terminals 50*a* are sandwiched between the secondary-side wiring connector terminals 50*b*. That is, in the connector 50, the primary-side wiring connector terminals 50*a* are arranged at a central portion and the secondary-side wiring connector terminals 50*b* are arranged at opposite sides thereof.

The primary-side wires 70*a* to be connected to the primary-side wiring connector terminals 50*a* of the connector 50 are connected to the power supply circuit 62 of the control section 60 through an apparatus main body connector 90 provided in the image forming apparatus 100. The secondary-side wires 70*b* to be connected to the secondary-side wiring connector terminals 50*b* of the connector 50 are connected to the control circuit 61 of the control section 60 through the apparatus main body connector 90. The apparatus main body connector 90 is configured such that a first apparatus main body connector piece 91 and a second apparatus main body connector piece 92 with a plurality of connector terminals arranged are detachably engaged with each other. A first apparatus main body connector terminals 90*a* to be connected to the primary-side wires 70*a* and a second apparatus main body connector terminals 90*b* to be connected to the secondary-side wires 70*b* are provided integrally.

As described above, in the fixing device 15, the primary-side wires 70*a* each leading to the heat generating resistor 301 with a large current flowing therein and the secondary-side wires 70*b* including the wires each leading to the heat generating element-side thermistor 24*a* with a small current flowing therein are connected to the same connector 50. Thus, in a state where the heat generating element-side thermistor 24*a* is not operated normally due to the wire of the heat generating element-side thermistor 24*a* being loosened, and electrical conduction to the heat generating resistor 301 is not controlled normally, it is possible to prevent electrical conduction to the heat generating resistor 301. For this reason, in the fixing device 15, it is possible to suppress abnormal electrical conduction to the heat generating resistor 301 even in a short time, preventing the heat generating resistor 301 from being an overheat state. Therefore, in the fixing device 15, it is possible to prevent the heat generating resistor 301 from resulting in smoke generation or burnout, and high safety is able to be secured. Further, in the fixing device 15, it is possible to suppress abnormal electrical conduction to the heat generating resistor 301 even in a short time, preventing the overheat state of the heat generating resistor 301 from being continued due to repetitive abnormal electrical conduction to the heat generating resistor 301 in a short time. Therefore, it is possible to prevent the fixing belt 25 from being thermally damaged and then deteriorated, or to prevent the fixing belt 25 from resulting in smoke generation or burnout.

In the connector 50 of the fixing device 15, the primary-side wiring connector terminals 50*a* are arranged to be sandwiched between the secondary-side wiring connector terminals 50*b*. When it is detected that there is a connection fault between the secondary-side wires 70*b* and the secondary-side wiring connector terminals 50*b*, the control section 60 controls such that electrical conduction to the heat generating resistor 301 is suppressed. Thus, even when the connector 50 is inserted obliquely, there is a connection fault between the secondary-side wires 70*b* and the secondary-side wiring connector terminals 50*b* arranged outside the primary-side wiring connector terminals 50*a* in the connector 50, and the heat generating element-side thermistor 24*a* is not operated normally, since the control section 60 suppresses electrical conduction to the heat generating resistor 301, it is possible to prevent the heat generating resistor 301 from being the overheat state.

For example, in the connector 50, in a case where the secondary-side wiring connector terminals 50*b* are arranged to be sandwiched between the primary-side wiring connector terminals 50*a*, even though the connector 50 is inserted obliquely and the outward primary-side wires 70*a* are in a half-short-circuit state, since the inward secondary-side wires 70*b* are normally connected, the control section 60 controls such that electrical conduction to the heat generating resistor 301 starts. Thus, when electrical conduction is provided to the primary-side wires 70*a* in the half-short-circuit state, an obliquely inserted half-short-circuit portion has high contact resistance, and a large current flows in the half-short-circuit portion at the time of electrical conduction, and therefore this makes it possible to result in heat generation, smoke generation, or ignition in the half-short-circuit portion.

In contrast, with the connector 50 in which the primary-side wiring connector terminals 50*a* are arranged to be sandwiched between the secondary-side wiring connector terminals 50*b*, it is possible to suppress electrical conduction to the primary-side wires 70*a* in the half-short-circuit state with a large current flowing therein, thereby preventing heat generation, smoke generation, or ignition.

When there are a plurality of primary-side wires 70*a*, the primary-side wires 70*a* are connected to the inward terminals from among the primary-side wiring connector terminals 50*a* in descending order of priority, thereby improving safety. For example, a primary-side wire in which a current flowing at the time of electrical conduction is larger may have a higher priority, a primary-side wire to be connected to a member with a higher occurrence frequency of an abnormal operation may have a higher priority, or a primary-side wire to be connected to a member temporally earlier operating in a control sequence may have a higher priority. With regard to a plurality of secondary-side wires 70*b*, a secondary-side wire related to the primary-side wire 70*a* with a high priority is preferably connected to the outward terminal from among the secondary-side wiring connector terminals 50*b*.

Figure 18:
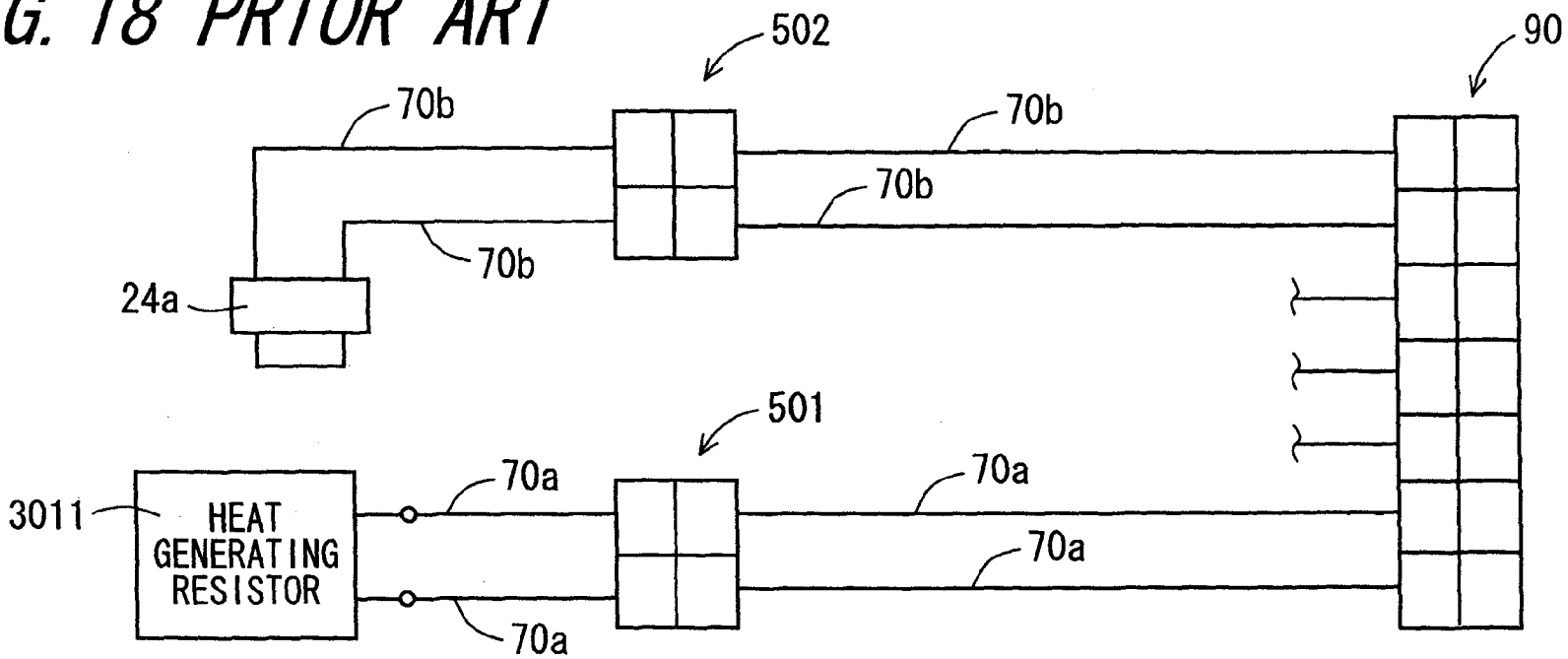
FIG. 18 PRIOR ART
FIG. 18 is a diagram showing a connection state of wires in the fixing device of the related art.

In the fixing device of the related art, primary-side wires 70*a* and secondary-side wires 70*b* in the fixing device are connected to separate connectors. FIG. 18 is a diagram showing a connection state of wires in the fixing device of the related art. In the fixing device of the related art, the primary-side wires 70*a* leading to a heat generating resistor 3011 with a large current flowing therein are connected to a connector 501 for a heat generating resistor, and the secondary-side wires 70*b* leading to a heat generating element-side thermistor 24*a* with a small current flowing therein are connected to a connector 502 for a thermistor.

Thus, when the primary-side wires 70*a* and the secondary-side wires 70*b* in the fixing device are connected to the separate connectors 501 and 502, even though the secondary-side wires 70*b* are loosened with respect to the connector 502 for a thermistor and disconnected, when the primary-side wires 70*a* are normally connected to the connector 501 for a heat generating resistor, abnormal electrical conduction is provided to the heat generating resistor 3011 in a state where the heat generating element-side thermistor 24*a* is not operated normally. In such a case, since the high-power-density heat generating resistor 3011 has a high temperature rising speed, when abnormal electrical conduction is provided to the heat generating resistor 3011 even in a short time, the heat generating resistor 3011 is in the overheat state and results in smoke generation or burnout.

In the fixing device 15 of this embodiment, the primary-side wires 70*a* and the secondary-side wires 70*b* are connected to the same connector 50. Thus, it is possible to prevent abnormal electrical conduction to the heat generating resistor 301 in a state where the heat generating element-side thermistor 24*a* is not operated normally, securing high safety.

The fixing device 15 may further include a mounting determining section 71 which determines whether or not the fixing device 15 is mounted in the main body of the image forming apparatus 100. A loop-wired terminal is provided in the fixing device 15 by using some of the terminals of the apparatus main body connector 90 which connects the image forming apparatus 100 and the fixing device 15. The mounting determining section 71 can be realized by a configuration in which a change in voltage of the terminal is monitored. When the state of the change in voltage matches a preset determination condition or when it is confirmed that a plurality of secondary-side wires are connected without problems and the output is normal, the mounting determining section 71 is configured to determine that the fixing device 15 is mounted. The mounting determining section 71 may be configured to determine whether the fixing device 15 is mounted or not on the basis of the change in the output value of an optical sensor, or may be configured to determine whether the fixing device 15 is mounted or not under multiple determination conditions including the change in voltage and the change in the output value of the optical sensor.

Wires to be connected to the mounting determining section 71 are connected to the secondary-side wiring connector terminals 50*b* as the secondary-side wires 70*b*. When it is detected that there is a connection fault between the secondary-side wires 70*b* and the secondary-side wiring connector terminals 50*b*, the control section 60 suppresses electrical conduction to the heat generating resistor 301. Therefore, when the mounting determining section 71 is not operated normally due to a connection fault of the wire of the mounting determining section 71, and it is not determined accurately whether or not the fixing device 15 is mounted in the main body of the image forming apparatus 100, it is possible to prevent electrical conduction to the heat generating resistor 301.

The fixing device 15 may further include a recording medium passage determining section 72 which determines whether or not the recording paper sheet 32 has passed through the fixing nip region 15*c*. The recording medium passage determining section 72 is realized by a method in which the recording paper sheet 32 itself or an actuator which is provided in advance to operate in response to the passage of the recording paper sheet 32 blocks or reflects the optical path of the optical sensor to detect whether or not the recording paper sheet 32 has passed through, or a method in which a change in an output of a magnetic/electrical sensor is monitored.

Wires to be connected to the recording medium passage determining section 72 are connected to the secondary-side wiring connector terminals 50*b* as the secondary-side wires 70*b*. When it is detected that there is a connection fault between the secondary-side wires 70*b* and the secondary-side wiring connector terminals 50*b*, the control section 60 suppresses electrical conduction to the heat generating resistor 301. Therefore, when the recording medium passage determining section 72 is not operated normally due to a connection fault of the wire of the recording medium passage determining section 72, and it is not determined accurately whether or not the recording paper sheet 32 has passed through the fixing nip region 15*c*, it is possible to prevent electrical conduction to the heat generating resistor 301.

The fixing device 15 may further include a new/old fixing device determining section 73 which determines whether the fixing device itself is new or old. A loop-wired terminal is provided through a resistance line or fuse provided in the fixing device 15 by using some of the terminals of the apparatus main body connector 90 which connects the image forming apparatus 100 and the fixing device 15. The new/old fixing device determining section 73 can be realized by a configuration in which a change in an electrical resistance value when electrical conduction is provided to the resistance line or fuse or the burned-out state of the resistance line or fuse is monitored. The new/old fixing device determining section 73 may be configured such that a protrusion piece is provided at a portion of the image forming apparatus 100 where the fixing device 15 is mounted, and the elastically deformed state of the protrusion piece is monitored mechanically/optically.

Wires to be connected to the new/old fixing device determining section 73 are connected to the secondary-side wiring connector terminals 50*b* as the secondary-side wires 70*b*. When it is detected that there is a connection fault between the secondary-side wires 70*b* and the secondary-side wiring connector terminals 50*b*, the control section 60 suppresses electrical conduction to the heat generating resistor 301. Therefore, when the new/old fixing device determining section 73 is not operated normally due to a connection fault of the wire of the new/old fixing device determining section 73, and it is not determined accurately whether the fixing device itself is new or old, it is possible to prevent electrical conduction to the heat generating resistor 301.

Figure 6:
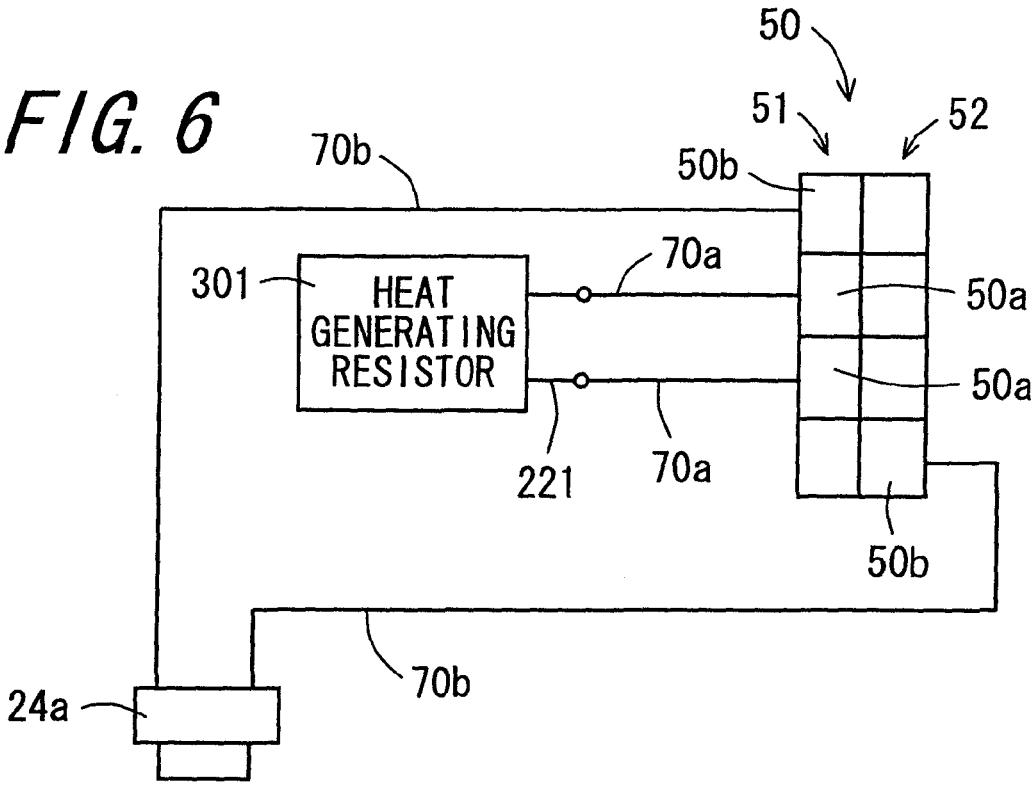
FIG. 6 is a diagram showing another example of the connection state of the wires in the fixing device.

In the fixing device 15, when the primary-side wires 70*a* are connected to the connector 50 so as to be sandwiched between the secondary-side wires 70*b*, the configuration may be made as shown in FIG. 6. FIG. 6 is a diagram showing another example of the connection state of the wires in the fixing device 15. In the connection example of the wires shown in FIG. 6, the wires which are connected to the heat generating element-side thermistor 24*a* are connected to a pair of secondary-side wiring connector terminals 50*b* which are arranged at point-symmetrical positions with respect to the center of the connector 50. Therefore, even when the connector 50 is inserted obliquely, there is a connection fault between the secondary-side wires 70*b* and the secondary-side wiring connector terminals 50*b* arranged outside the primary-side wiring connector terminals 50*a* in the connector 50, and the heat generating element-side thermistor 24*a* is not operated normally, it is possible to suppress abnormal electrical conduction to the heat generating resistor 301, thereby preventing the heat generating resistor 301 from being in the overheat state.

FIGS. 7A to 7E are diagrams showing a position where the overheat preventing element 40 is provided in the vicinity of the detecting section 301*b* of the heat generating resistor 301. As described above, when the temperature of the detecting section 301*b* of the heat generating resistor 301 reaches a preset value, the overheat preventing element 40 suppresses electrical conduction to the heat generating resistor 301.

The overheat preventing element 40 is provided in the vicinity of the detecting section 301*b* so as to detect a change in temperature due to electrical conduction in the detecting section 301*b* of the heat generating resistor 301. Here, since the temperature rising speed, the thermal conductivity or the radiation condition varies depending on factors such as curvature of the surface (detecting surface) of a target object arranged opposite to the overheat preventing element 40, the area, the structure and the material of the heat receiving surface of the overheat preventing element 40 itself, or the structure and the material of each of layers of the heat generating member 211, the arranging position of the overheat preventing element 40 is decided in consideration of these points.

Figure 7A:
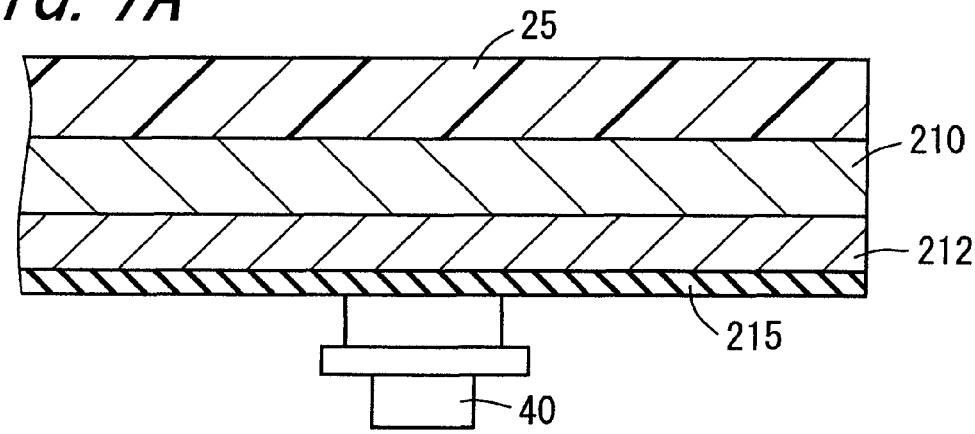
FIGS. 7A to 7E are diagrams showing a position where an overheat preventing element is provided in the vicinity of a detecting section of the heat generating resistor.
Figure 7B:
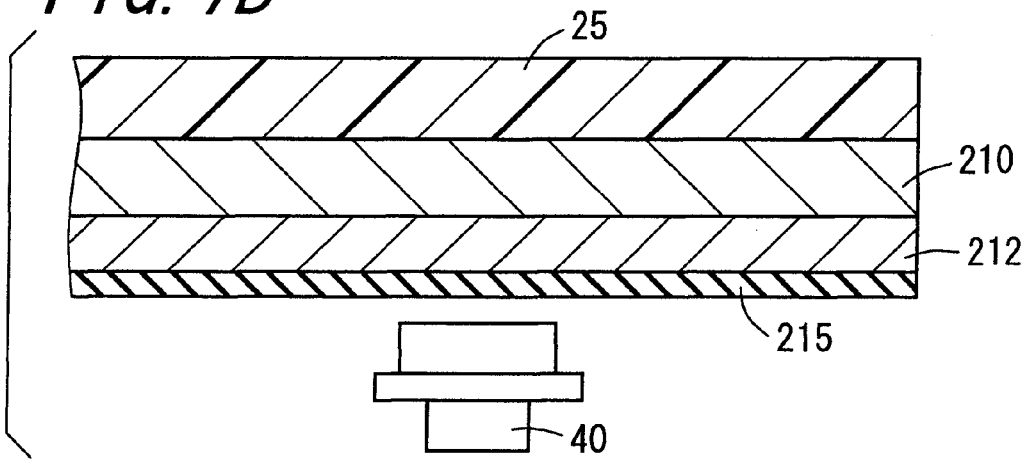

The overheat preventing element 40 may be arranged opposite to the second insulating layer 215 in a contact manner as shown in FIG. 7A, or in a non-contact manner as shown in FIG. 7B, the second insulating layer 215 corresponding to a region part of the heat generating layer 212 in which the detecting section 301*b* of the heat generating resistor 301 is provided, the region part being an end portion of the axial direction (longitudinal direction) of the heat radiating member 210 in contact with the fixing belt 25.

Figure 7C:
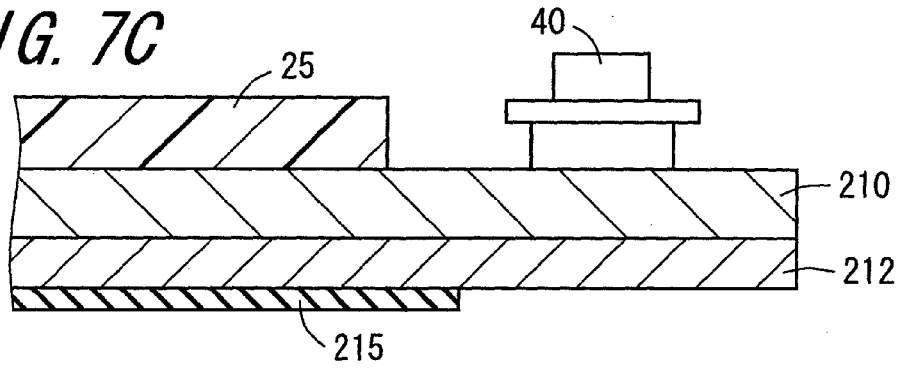
Figure 7D:
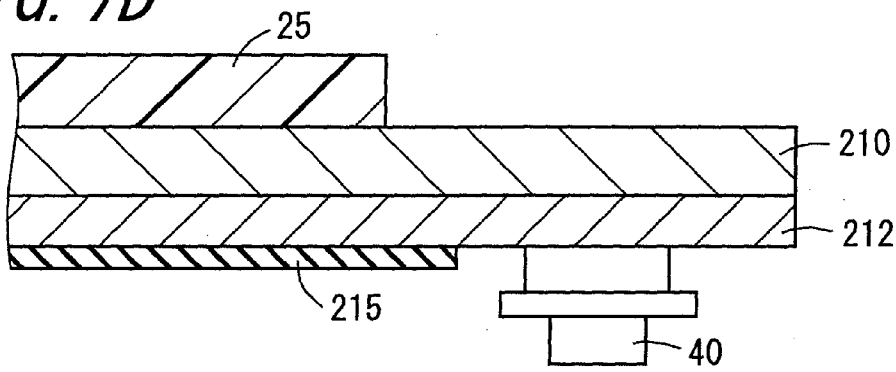
Figure 7E:
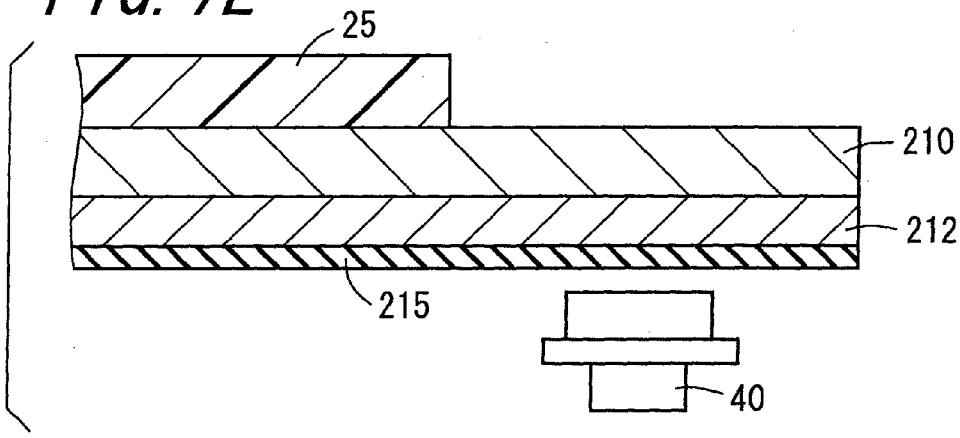

Furthermore, the overheat preventing element 40 may be arranged opposite to the heat radiating member 210 in a contact manner as shown in FIG. 7C, or may be arranged opposite to the heat generating member 212 in a contact manner as shown in FIG. 7D, corresponding to a region part, in which the second insulating layer 215 is not formed, of the heat generating layer 212 in which the detecting section 301*b* of the heat generating resistor 301 is provided, the region part being an end portion of the axial direction (longitudinal direction) of the heat radiating member 210 in non-contact with the fixing belt 25. Moreover, as shown in FIG. 7E, the overheat preventing element 40 may be arranged opposite to the second insulating layer 215 in a non-contact manner, the second insulating layer 215 corresponding to a region part of the heat generating layer 212 in which the detecting section 301*b* of the heat generating resistor 301 is provided, the region part being an end portion of the axial direction (longitudinal direction) of the heat radiating member 210 in non-contact with the fixing belt 25.

When the heat generating layer 212 generates heat by applying voltage to the heat generating resistor 301 from the power feeding terminal sections 221, and the fixing belt 25 coming into contact with the heat radiating member 210 is heated by using the generated heat, in a case where the control of electrical conduction to the heat generating resistor 301 constituting the heat generating layer 212 is not able to be performed because of the failure of the control circuit, an unexpected control program behavior, or the failure of the switching element, there is a case where the heat generating resistor 301 becomes an overheated state and results in smoke generation, ignition, or burnout.

The overheat preventing element 40 detects the temperature abnormality under which the heat generating resistor 301 becomes the overheated state, and by suppressing the electrical conduction to the heat generating resistor 301 based on the detection result, it is possible to prevent that the heat generating resistor 301 results in smoke generation, ignition, or burnout.

Additionally, since the heat generating resistor 301 of high power density has high temperature rising speed due to electrical conduction, in order to prevent the heat generating resistor 301 from becoming overheated state, the temperature abnormality under which the heat generating resistor 301 becomes the overheated state should be detected further earlier. Furthermore, unless the temperature abnormality detection is executed by the overheat preventing element 40 at a place where temperature rising speed is high or a place where power density is high in the heat generating resistor 301, it is impossible to prevent the heat generating resistor 301 to result in smoke generation, ignition or burnout when there is a part which has greater change in temperature than the detected part.

In order to detect the temperature abnormality under which the heat generating resistor 301 becomes the overheated state further earlier, the overheat preventing element 40 may be arranged to be in contact with the fixing belt 25 or the heating section 21, however, in such a case, there is a possibility that as well as a failure occurs in a fixed image on the recording paper sheet 32, the temperature distribution of the surface of the fixing belt 25 becomes non-uniform. Moreover, when the overheat preventing element 40 is arranged to be in contact with the fixing belt 25 or the heating section 21, there is a possibility that detection sensitivity of the overheat preventing element 40 becomes poor and thereby the temperature abnormality itself is not possible to be detected.

Moreover, in the fixing device 15, a width of a paper non-passing region on the surface of the fixing belt 25 varies depending on a size of the recording paper sheet 32 to be supplied to the fixing nip region 15*c*. In the paper non-passing region on the surface of the fixing belt 25, which the recording paper sheet 32 does not contact, since heat generated from the heat generating layer 212 will not be taken by the recording paper sheet 32, a regional part of the heat generating resistor 301 that corresponds to the paper non-passing region becomes an excessive temperature rising state. In this way, when the heat generating resistor 301 becomes the excessive temperature rising state regionally corresponding to the paper non-passing region, there is a case where the overheat preventing element 40 that detects the overheated state of the heat generating resistor 301 operates erroneously.

Contrary to this, in the fixing device 15, since the configuration is such that electrical conduction to the heat generating resistor 301 is controlled by the overheat preventing element 40 provided in the vicinity of the detecting section 301*b* arranged on the end portion of the axial direction of the heat generating member 211 corresponding to the paper non-contacting region of the recording paper sheet 32 of the fixing belt 25, irrespective of the size of the recording paper sheet 32 to be supplied to the fixing nip region 15*c*, the overheated state of the paper passing region heating section 301*a* is able to be indirectly detected from the temperature change in the detecting section 301*b* corresponding to the paper non-passing region of the fixing belt 25 which the recording paper sheet 32 does not contact all the time, and thereby it is possible to prevent that the overheat preventing element 40 operates erroneously.

Furthermore, since the paper passing region heating section 301*a* and the detecting section 301*b* are electrically connected in parallel, the heat generating resistor 301 that generates heat due to electrical conduction is prevented from being subjected to a disturbance factor such as variation in applied voltage to the paper passing region heating section 301*a* and the detecting section 301*b*. Thereby, when the heat generating resistor 301 is energized, the temperature changes in the paper passing region heating section 301*a* and the detecting section 301*b* are the same, and the overheated state of the paper passing region heating section 301*a* is able to be indirectly detected by the overheat preventing element 40 accurately from the temperature change in the detecting section 301*b* due to electrical conduction. Therefore, it is possible to prevent the paper passing region heating section 301*a* of the heat generating resistor 301 from becoming an overheated state and resulting in smoke generation, ignition or burnout, and high safety is able to be secured.

Moreover, in the heat generating resistor 301 that generates heat due to electrical conduction, the paper passing region heating section 301*a* and the detecting section 301*b* preferably have an equivalent power density. Thereby, when the heat generating resistor 301 is energized, the temperature changes in the paper passing region heating section 301*a* and the detecting section 301*b* are the same, and thereby the overheated state of the paper passing region heating section 301*a* is able to be indirectly detected by the overheat preventing element 40 accurately from the temperature change in the detecting section 301*b* due to electrical conduction.

Here, the configuration in which the paper passing region heating section 301*a* and the detecting section 301*b* have an equivalent power density is that the power density of the detecting section 301*b* to the power density of the paper passing region heating section 301*a* is adjusted to be in a range of (power density of the paper passing region heating section±10%), preferably (power density of the paper passing region heating section+10%). By adjusting the power density of the detecting section 301*b* to the power density of the paper passing region heating section 301*a* to be in a range of (power density of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to electrical conduction, it is possible to detect the overheated state of the paper passing region heating section 301*a* further earlier.

Additionally, in the heat generating resistor 301 that generates heat due to electrical conduction, the paper passing region heating section 301*a* and the detecting section 301*b* may be configured to have an equivalent temperature rising speed in generating heat due to electrical conduction. Whereby, when the heat generating resistor 301 is energized, the temperature changes in the paper passing region heating section 301*a* and the detecting section 301*b* are the same, and thereby the overheated state of the paper passing region heating section 301*a* is able to be indirectly detected by the overheat preventing element 40 accurately from the temperature change in the detecting section 301*b* due to electrical conduction.

Here, the configuration in which the paper passing region heating section 301*a* and the detecting section 301*b* have an equivalent temperature rising speed is that the temperature rising speed of the detecting section 301*b* to the temperature rising speed of the paper passing region heating section 301*a* is adjusted to be in a range of (temperature rising speed of the paper passing region heating section±10%), preferably (temperature rising speed of the paper passing region heating section+10%). By adjusting the temperature rising speed of the detecting section 301*b* to the temperature rising speed of the paper passing region heating section 301*a* to be in a range of (temperature rising speed of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to electrical conduction, it is possible to detect the overheated state of the paper passing region heating section 301*a* further earlier.

Furthermore, in the heat generating resistor 301 that generates heat due to electrical conduction, the paper passing region heating section 301*a* and the detecting section 301*b* may be configured to have an equivalent specific heat capacity. Whereby, when the heat generating resistor 301 is energized, the temperature changes in the paper passing region heating section 301*a* and the detecting section 310*b* are the same, and the overheated state of the paper passing region heating section 301*a* is able to be indirectly detected by the overheat preventing element 40 accurately from the temperature change in the detecting section 301*b* due to electrical conduction.

Here, the configuration in which the paper passing region heating section 301*a* and the detecting section 301*b* have an equivalent specific heat capacity is that the specific heat capacity of the detecting section 301*b* to the specific heat capacity of the paper passing region heating section 301*a* is adjusted to be in a range of (specific heat capacity of the paper passing region heating section±10%), preferably (specific heat capacity of the paper passing region heating section+10%). By adjusting the specific heat capacity of the detecting section 301*b* to the specific heat capacity of the paper passing region heating section 301*a* to be in a range of (specific heat capacity of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to electrical conduction, it is possible to detect the overheated state of the paper passing region heating section 301*a* further earlier.

As described above, the configuration in which the power density is equivalent, the configuration in which the temperature rising speed is equivalent, and the configuration in which the specific heat capacity is equivalent, where the temperature changes in the paper passing region heating section 301*a* and the detecting section 301*b* are the same, are able to be realized by adjusting an amount of generating heat, electrical resistance, a material, a thickness, an area and the like of the detecting section 301*b* to the paper passing region heating section 301*a* in consideration of the surrounding environment in which the overheat preventing element 40 is arranged. Furthermore, temperature detecting capability of the detecting section 301*b* by the overheat preventing element 40 may be adjusted by coating (or attaching) a material which is able to adjust (increase or reduce) the thermal conductivity on the surface of the detecting section 301*b* (detecting surface).

In addition, as the heat generating resistor 301, it is preferable to use one having positive resistance-temperature property (Positive Temperature Coefficient, abbreviated as PTC property). In the heat generating resistor 301 having the positive resistance-temperature property, electrical resistance increases as temperature rises. In such a heat generating resistor 301 having the positive resistance-temperature property, when the temperature thereof becomes a predetermined temperature or more, the electrical resistance sharply increases and the current value becomes small, thereby becoming the overheated state is prevented. Moreover, in the heat generating resistor 301 having the positive resistance-temperature property, since the current value becomes small as the temperature rises, amount of power consumption is able to be reduced and the energy saving is able to be realized. Moreover, since the heat generating resistor 301 has the paper passing region heating section 301*a* and the detecting section 301*b*, even though the heat generating resistor 301 is the heat generating element having the positive resistance-temperature property, it is possible to indirectly detect the overheated state of the paper passing region heating section 301*a* accurately from the temperature change in the detecting section 301*b* due to electrical conduction.

In addition, as the heat generating resistor 301, one having negative resistance-temperature property (Negative Temperature Coefficient, abbreviated as NTC property) may be used. In the heat generating resistor 301 having negative resistance-temperature property, electrical resistance decreases as temperature rises. Here, since the heat generating resistor 301 has the paper passing region heating section 301*a* and the detecting section 301*b*, even though the heat generating resistor 301 is the heat generating element having the negative resistance-temperature property, it is possible to indirectly detect the overheated state of the paper passing region heating section 301*a* accurately from the temperature change in the detecting section 301*b* due to electrical conduction.

Moreover, as the heat generating resistor 301, one having the positive resistance-temperature property and the negative resistance-temperature property may be used. Here, since the heat generating resistor 301 has the paper passing region heating section 301*a* and the detecting section 301*b*, even though the heat generating resistor 301 is the heat generating element having the positive resistance-temperature property and the negative resistance-temperature property, it is possible to indirectly detect the overheated state of the paper passing region heating section 301*a* accurately from the temperature change in the detecting section 301*b* due to electrical conduction. The heat generating resistor 301 having the positive resistance-temperature property and the negative resistance-temperature property is, for example, a heat generating element (also referred to as a PTC ceramic heater) which has the negative resistance-temperature property around the normal temperature, and has the positive resistance-temperature property from around a predetermined temperature, and in which when the temperature rises further, a change rate of the electrical resistance is great even with the positive resistance-temperature property.

Figure 8:
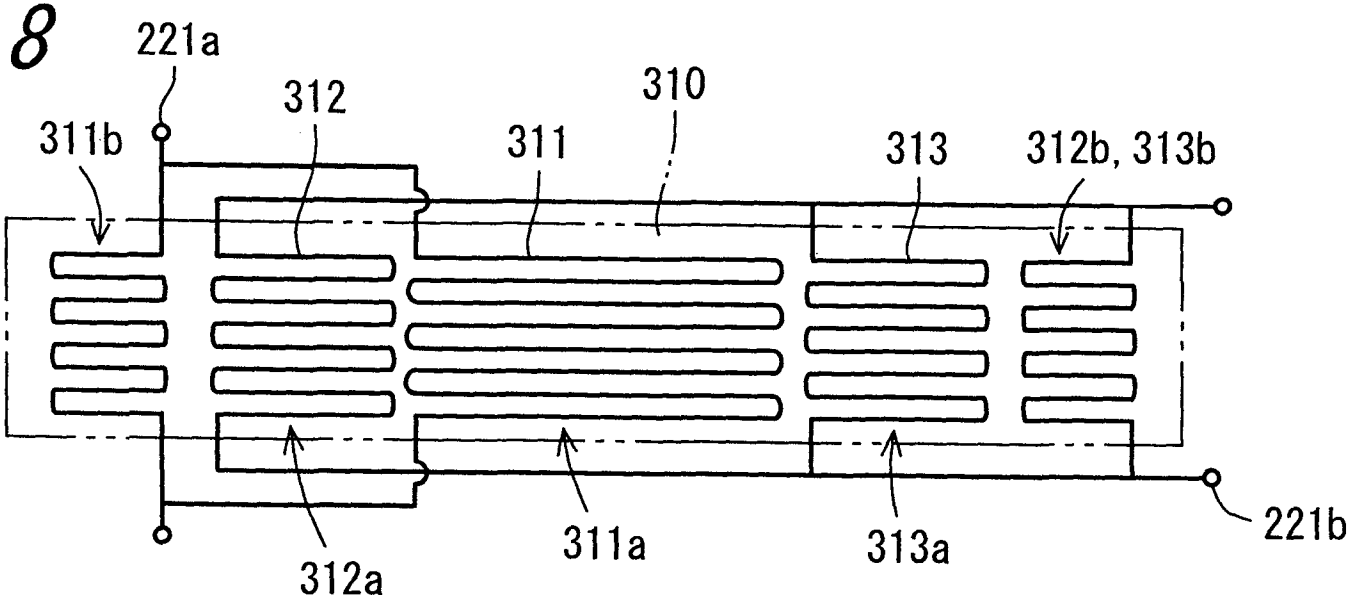
FIG. 8 is a diagram showing a configuration of a heat generating layer which is formed of a plurality of heat generating resistors.

Next, a case will be described where the heat generating layer of the heat generating member 211 of the heating section 21 is formed of a plurality of heat generating resistors. FIG. 8 is a diagram showing a configuration of a heat generating layer 310 which is formed of a plurality of heat generating resistors.

The heat generating layer of the heat generating member 211 may be configured as the heat generating layer 310 in which the heat generating portion which generates heat due to electrical conduction is divided into multiple regions. The heat generating layer 310 shown in FIG. 8 has a plurality of heat generating resistors 311, 312, and 313. Each of the heat generating resistors 311, 312, and 313 repeats flexions so as to form a fixed surface as a whole. To correspond to the multiple regions of the surface of the heat radiating member 210, the heat generating layer 310 is divided into a first heat generating region which has a paper passing region heating section 312*a* of the heat generating resistor 312, a second heat generating region which has a paper passing region heating section 313*a* of the heat generating resistor 313, and a third heat generating portion which has a paper passing region heating section 311*a* of the heat generating resistor 311. In this embodiment, assuming that printing is performed while passing the recording paper sheets 32 of different sizes, the surface of the heat radiating member 210 which heats the fixing belt 25 in contact with the recording paper sheets 32 is divided into three regions of both end portions and a central portion in the longitudinal direction. The first heat generating region and the second heat generating region of the heat generating layer 310 correspond to both end portions of the heat radiating member 210 in the longitudinal direction, and the third heat generating region corresponds to the central portion of the heat radiating member 210 in the longitudinal direction.

The detecting section 312*b* that is electrically connected in parallel with the paper passing region heating section 312*a* of the heat generating resistor 312, and the detecting section 313*b* that is electrically connected in parallel with the paper passing region heating section 313*a* of the heat generating resistor 313 are provided on another end portion of the axial direction (longitudinal direction) of the heat generating member 211 corresponding to the non-contact region of the recording paper sheet 32 of the fixing belt 25. Note that, in the embodiment, the detecting section 312*b* and the detecting section 313*b* are common. Furthermore, the detecting section 311*b* that is electrically connected in parallel with the paper passing region heating section 311*a* of the heat generating resistor 311, is provided on one end portion of the axial direction (longitudinal direction) of the heat generating member 211 corresponding to the non-contact region of the recording paper sheet 32 of the fixing belt 25. Then, the overheat preventing element 40 is respectively provided in a vicinity of the detecting sections 312*b* and 313*b* which are common to the heat generating resistor 312 and the heat generating resistor 313, and of the detecting section 311*b* of the heat generating resistor 311.

The heat generating resistor 311 is connected to the power feeding terminal section 221*a*, the heat generating resistor 312 and the heat generating resistor 313 are connected to the power feeding terminal section 221*b*, and thereby it is possible to energize the respective heat generating regions separately. Whereby, on/off of electrical conduction can be switched for the respective heat generating resistors 311, 312, and 313 corresponding to the respective divisions of the heat generating part, and the temperature distribution on the surface of the heat radiating member 210 coming into contact with the fixing belt 25 is able to be adjusted to desired temperature distribution. For example, in a case or the like where the recording paper sheet 32 of different dimension, width, or thickness is supplied to the fixing nip region 15*c* to fix the toner image 31, by switching on/off of electrical conduction so that only the heat generating resistor corresponding to a desired specific region on the surface of the heat radiating member 210 generates heat corresponding to the different sizes (dimension, width, or thickness) of the recording paper sheet 32, the surface of the heat radiating member 210 is able to have the desired temperature distribution. Whereby, it is possible to suppress the regional abnormal temperature rise of the heat generating resistor corresponding to the non-contact part of the recording paper sheet 32 on the surface of the fixing belt 25.

Furthermore, each of the plurality of heat generating resistors 311, 312, and 313 has a paper passing region heating section and a detecting section to be electrically connected in parallel. Whereby, it is possible to indirectly detect an overheat state of the paper passing region heating section by the overheat preventing element 40 accurately from the temperature change in the detecting section due to electrical conduction for the heat generating resistors 311, 312 and 313 corresponding to the respective divisions of the heat generating part. Therefore, it is possible to prevent that the paper passing region heating section of each of the heat generating resistors 311, 312, and 313 becomes the overheated state and results in smoke generation or burnout, and high safety is able to be secured.

As described above, when the heating section 21 includes the heat generating layer 310 which has the plurality of heat generating resistors 311, 312, and 313, and in which the heat generating portion which generates heat due to electrical conduction is divided into multiple regions, the wires in the fixing device 15 are preferably configured as follows.

Figure 9:
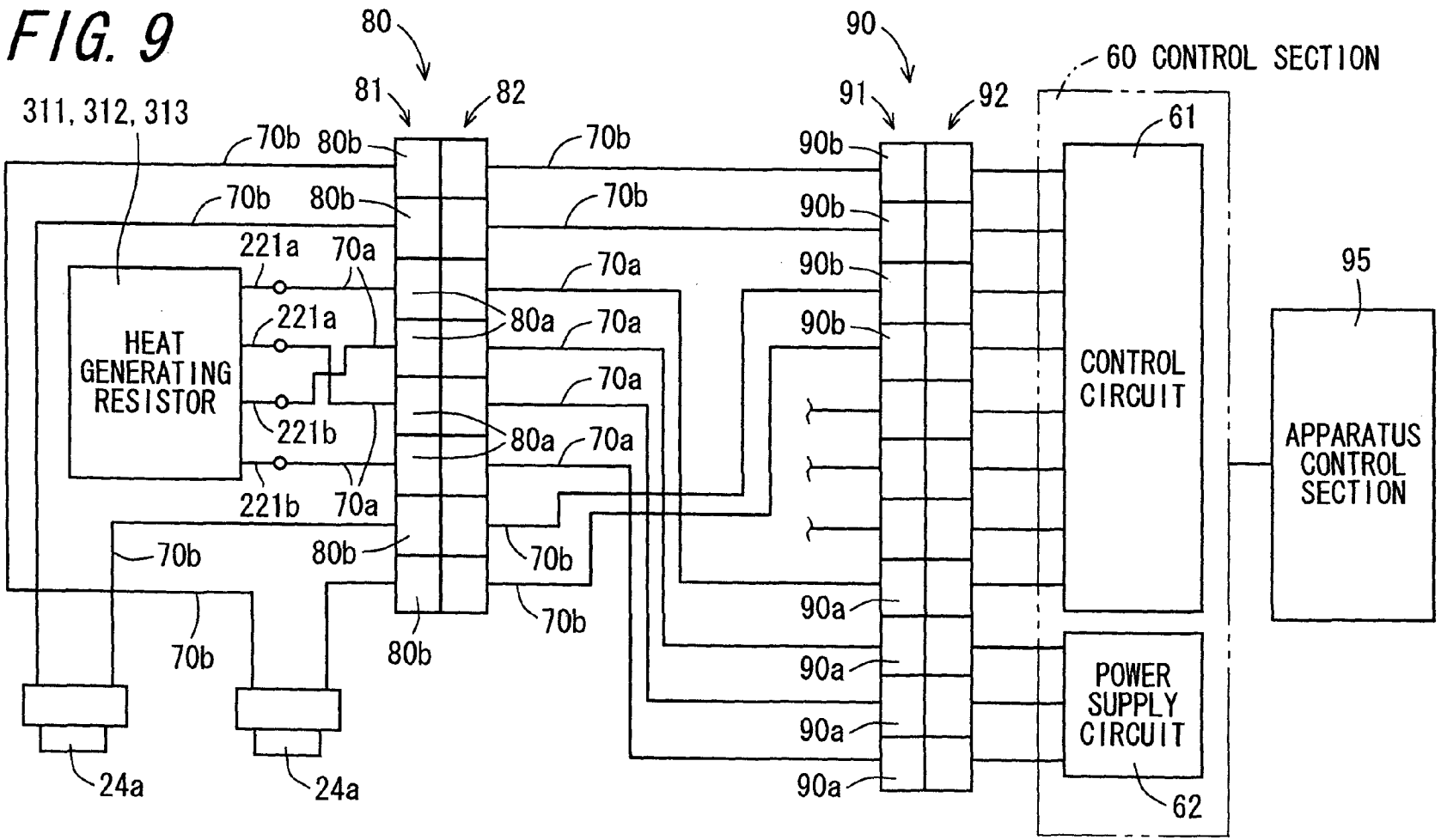
FIG. 9 is a diagram showing a connection state of wires when a plurality of heat generating resistors are used.

FIG. 9 is a diagram showing a connection state of wires when a plurality of heat generating resistors are used. In the fixing device 15, primary-side wires 70*a* leading to the plurality of heat generating resistors 311, 312, and 313, and secondary-side wires 70*b* including wires leading to a plurality of heat generating element-side thermistors 24*a* corresponding to the plurality of heat, generating resistors are connected to a same connector 80, the secondary-side wires 70*b* flowing current smaller than the primary-side wires 70*a*.

The connector 80 is configured such that a first connector piece 81 and a second connector piece 82 with a plurality of connector terminals (for example, eight connector terminals) arranged are detachably engaged with each other. The connector 80 comprises integrally primary-side wiring connector terminals 80*a* to be connected to the primary-side wires 70*a* and secondary-side wiring connector terminals 80*b* to be connected to the secondary-side wires 70*b*. In the connector 80, the primary-side wiring connector terminals 80*a* are sandwiched between the secondary-side wiring connector terminals 80*b*. That is, in the connector 80, the primary-side wiring connector terminals 80*a* are arranged at a central portion, and the secondary-side wiring connector terminals 80*b* are arranged at opposite sides thereof.

The primary-side wires 70*a* to be connected to the primary-side wiring connector terminals 80*a* of the connector 80 are connected to the power supply circuit 62 of the control section 60 through the apparatus main body connector 90 provided in the image forming apparatus 100. The secondary-side wires 70*b* to be connected to the secondary-side wiring connector terminals 80*b* of the connector 80 are connected to the control circuit 61 of the control section 60 through the apparatus main body connector 90. The apparatus main body connector 90 is configured such that a first apparatus main body connector piece 91 and a second apparatus main body connector piece 92 with a plurality of connector terminals arranged are detachably engaged with each other. The apparatus main body connector 90 comprises integrally first apparatus main body connector terminals 90*a* to be connected to the primary-side wires 70*a* and second apparatus main body connector terminals 90*b* to be connected to the secondary-side wires 70*b*.

As described above, while the heating section 21 includes the heat generating layer 310 which has the plurality of heat generating resistors 311, 312, and 313 and in which the heat generating portion which generates heat due to electrical conduction is divided into multiple regions, in the fixing device 15, the primary-side wires 70*a* leading to the heat generating resistors 311, 312, and 313 with a large current flowing therein and the secondary-side wires 70*b* including the wires leading to the plurality of heat generating element-side thermistors 24*a* with a small current flowing therein are connected to the same connector 80. Thus, in a state where the heat generating element-side thermistors 24*a* are not operated normally due to connection faults of the wires of the plurality of heat generating element-side thermistors 24*a*, and electrical conduction to the heat generating resistors 311, 312, and 313 are not controlled normally, it is possible to prevent electrical conduction to the heat generating resistors 311, 312, and 313. For this reason, in the fixing device 15, even when the heating section 21 has the plurality of heat generating resistors 311, 312, and 313, it is possible to suppress abnormal electrical conduction to the heat generating resistors 311, 312, and 313, preventing the heat generating resistors 311, 312, and 313 from being in an overheat state. Therefore, in the fixing device 15, it is possible to prevent the heat generating resistors 311, 312, and 313 from resulting in smoke generation or burnout, and high safety is able to be secured.

In the connector 80, the primary-side wiring connector terminals 80*a* are arranged to be sandwiched between the secondary-side wiring connector terminals 80*b*. If it is detected that there is a connection fault between the secondary-side wires 70*b* and the secondary-side wiring connector terminals 80*b*, the control section 60 controls such that electrical conduction to the heat generating resistors 311, 312, and 313 is suppressed. Thus, even when the connector 80 is inserted obliquely, there is a connection fault between the secondary-side wires 70*b* and the secondary-side wiring connector terminals 80*b* arranged outside the primary-side wiring connector terminals 80*a* in the connector 80, and a plurality of heat generating element-side thermistors 24*a* are not operated normally, since the control section 60 suppresses electrical conduction to the heat generating resistors 311, 312, and 313, it is possible to prevent the heat generating resistors 311, 312, and 313 from being in the overheat state.

Figure 10:
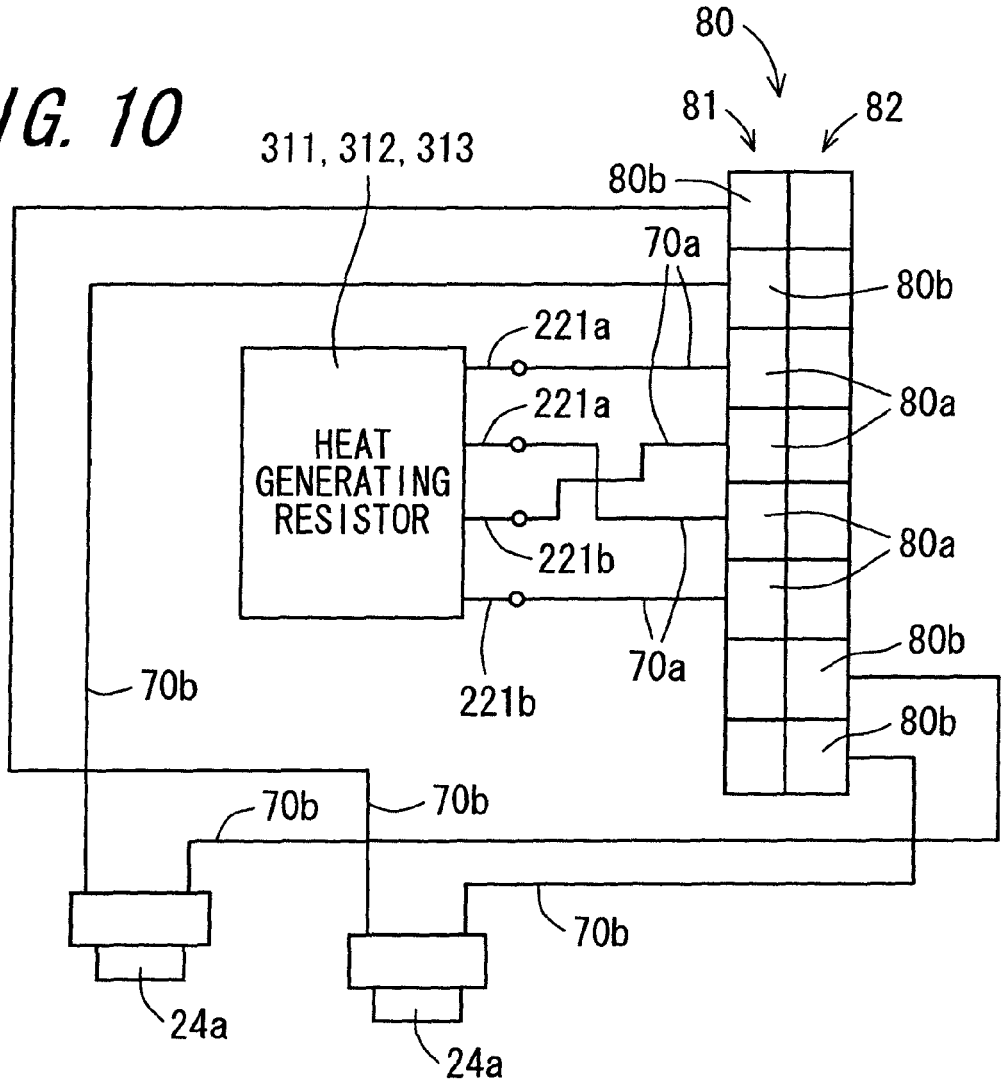
FIG. 10 is a diagram showing another example of the connection state of the wires when the plurality of heat generating resistors are used.

When the heating section 21 has the plurality of heat generating resistors 311, 312, and 313, and when the primary-side wires 70*a* are connected to the connector 80 so as to be sandwiched between the secondary-side wires 70*b*, the configuration may be made as shown in FIG. 10. FIG. 10 is a diagram showing another example of the connection state of the wires when a plurality of heat generating resistors are used. In the connection example of the wires shown in FIG. 10, the wires which are connected to the plurality of heat generating element-side thermistors 24*a* are connected to a pair of secondary-side wiring connector terminals 80*b* which are arranged at point-symmetrical positions with respect to the center of the connector 80. Therefore, even when the connector 80 is inserted obliquely, there is a connection fault between the secondary-side wires 70*b* and the secondary-side wiring connector terminals 80*b* arranged outside the primary-side wiring connector terminals 80*a* in the connector 80, and the plurality of heat generating element-side thermistors 24*a* are not operated normally, it is possible to suppress abnormal electrical conduction to the heat generating resistors 311, 312, and 313, preventing the heat generating resistors 311, 312, and 313 from being in the overheat state.

The configuration of the paper passing region heating section of each of the heat generating resistors in the heat generating layer of the heat generating member 211 is not limited to the above-described configuration, but the following configuration may be made, for example. Although specific description will be provided with reference to FIGS. 11A and 11B, FIGS. 12A to 12D, FIGS. 13A and 13B, and FIGS. 14A and 14B, the following configuration of a heat generating layer is a modification of a paper passing region heating section, and other parts are the same as those in the above-described heat generating layer 212.

Figure 11A:
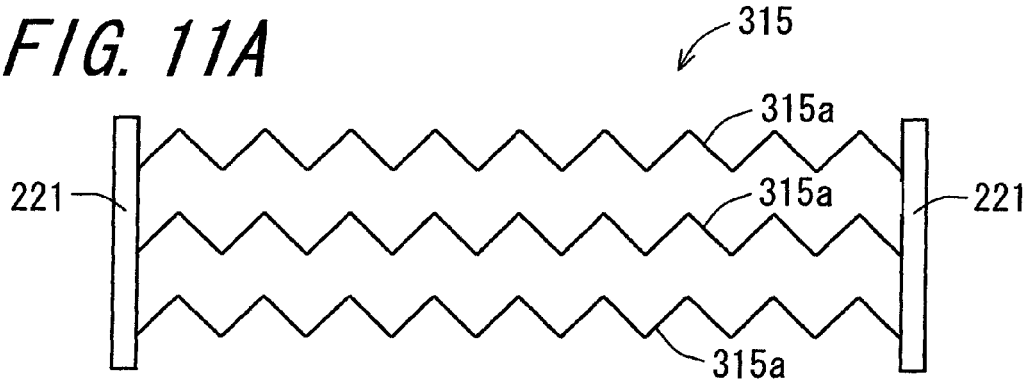
FIGS. 11A and 11B are diagrams showing a divided state of a paper passing region heating section of each of heat generating resistors in a heat generating layer.
Figure 11B:
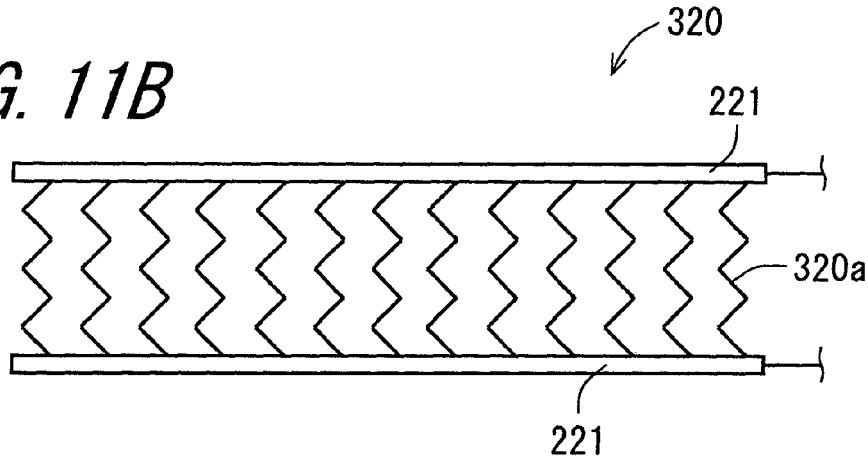

FIGS. 11A and 11B are diagrams showing a divided state of a paper passing region heating section of each of heat generating resistors in a heat generating layer. In a heat generating layer 315 of FIG. 11A, paper passing region heating sections 315*a* corresponding to a plurality of heat generating resistors extending in the longitudinal direction of the heat radiating member 210 are arranged at gaps in the circumferential direction (short-side direction) of the heat radiating member 210. When a voltage is applied to the power feed terminal 221, the plurality of paper passing region heating sections 315*a* generate heat individually. That is, the heat generating portion at the surface of the heat generating layer 315 is divided to correspond to the paper passing region heating sections 315*a* which generate heat individually. Heat generated from the paper passing region heating sections 315*a* which generate heat individually is transmitted to the heat radiating member 210, and then transmitted from the heat radiating member 210 to the fixing belt 25, such that the fixing belt 25 is heated.

In a heat generating layer 320 shown in FIG. 11B, paper passing region heating sections 320*a* corresponding to a plurality of heat generating resistors extending in the short-side direction of the heat radiating member 210 are arranged at gaps in the longitudinal direction of the heat radiating member 210. When a voltage is applied to the power feeding terminal sections 221, the plurality of paper passing region heating sections 320*a* generate heat individually.

Figure 12A:
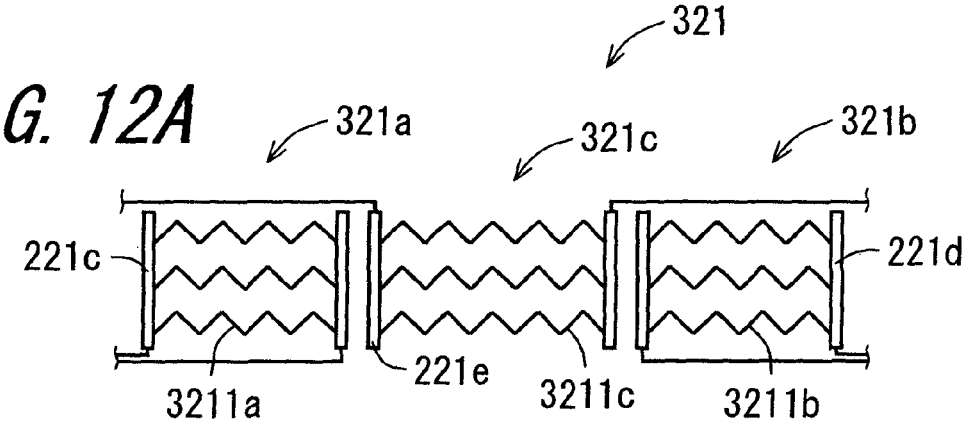
FIGS. 12A to 12D are diagram showing another example of the divided state of the paper passing region heating section.

FIGS. 12A to 12D are diagram showing another example of the divided state of the paper passing region heating section. A heat generating layer 321 shown in FIG. 12A is divided into a first heat generating region 321*a*, a second heat generating region 321*b*, and a third heat generating region 321*c* to correspond to multiple regions at the surface of the heat radiating member 210. In this embodiment, assuming that printing is performed while passing the recording paper sheets 32 of different sizes, the surface of the heat radiating member 210 which heats the fixing belt 25 in contact with the recording paper sheet 32 is divided into three regions of both end portions and a central portion in the longitudinal direction. The first heat generating region 321*a* and the second heat generating region 321*b* of the heat generating layer 321 correspond to both end portions of the heat radiating member 210 in the longitudinal direction, and the third heat generating portion 321*c* corresponds to the central portion of the heat radiating member 210 in the longitudinal direction.

In the first heat generating region 321*a*, paper passing region heating sections 3211*a* that correspond to the plurality of heat generating resistors extending in the longitudinal direction of the heat radiating member 210 are provided side by side so as to be spaced mutually in the short-side direction of the heat radiating member 210, and both end portions in the longitudinal direction of each of the paper passing region heating sections 3211*a* are connected to a pair of power feeding terminal sections 221*c*. In the second heat generating region 321*b*, paper passing region heating sections 3211*b* that correspond to the plurality of heat generating resistors extending in the longitudinal direction of the heat radiating member 210 are provided side by side so as to be spaced mutually in the short-side direction of the heat radiating member 210, and both end portions in the longitudinal direction of each of the paper passing region heating sections 3211*b* are connected to a pair of power feeding terminal sections 221*d*. In the third heat generating region 321*c*, paper passing region heating sections 3211*c* that correspond to the plurality of heat generating resistors extending in the longitudinal direction of the heat radiating member 210 are provided side by side so as to be spaced mutually in the short-side direction of the heat radiating member 210, and both end portions in the longitudinal direction of each of the paper passing region heating sections 3211*c* are connected to a pair of power feeding terminal sections 221*e*.

That is, the respective paper passing region heating sections 3211*a* in the first heat generating region 321*a*, the respective paper passing region heating sections 3211*b* in the second heat generating region 321*b*, and the respective paper passing region heating sections 3211*c* in the third heat generating region 321*c*, are respectively connected to different power feeding terminal sections 221*c*, 221*d*, and 221*e*, and thereby it is possible to energize the respective heat generating regions separately. Whereby, when the recording paper sheet 32 of different sizes is passed to perform printing, in order to obtain desired temperature distribution on the surface of the heat generating layer 321 corresponding to the different passing paper sizes, on/off of the respective heat generating regions 321*a*, 321*b*, and 321*c* is switched to perform sub-control of heating so that only a desired specific region on the surface of the heat generating layer 321 generates heat, and thereby it is possible to suppress the regional abnormal temperature rise of the paper passing region heating section in the heat generating region corresponding to the both end portions of the passing paper width of the recording paper sheet 32. In this way, by switching on/off of electrical conduction for the respective divided heat generating regions to perform sub-control of heating, and suppressing the regional abnormal temperature rise of the paper passing region heating section of the heat generating resistor, fixing failure and degradation in fixed image are able to be prevented as well as the breakage of the heat generating resistor itself is prevented, and an increase of power consumption is able to be prevented. Moreover, since it is possible to switch on/off of electrical conduction of the heat generating region to be divided in association with a region that needs heating on the surface of the fixing belt 25 and perform sub-control of heating for a different operation mode, it is possible to suppress a temperature ripple or sharp lowering of temperature after shifted to an operation mode.

Figure 12B:
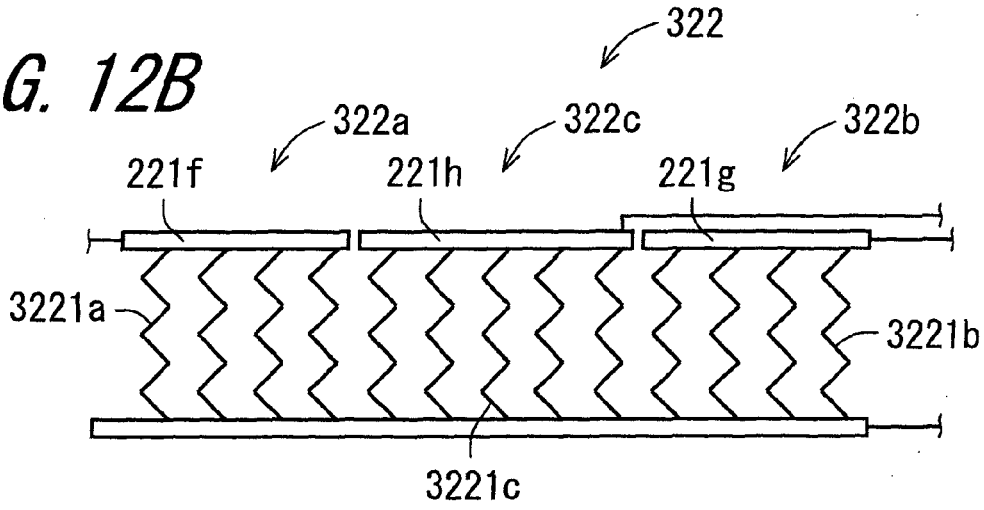

A heat generating layer 322 shown in FIG. 12B is divided into a first heat generating region 322*a*, a second heat generating region 322*b*, and a third heat generating region 322*c*, corresponding to the plurality of regions on the surface of the heat radiating member 210. In the embodiment, assuming a case where the recording paper sheet 32 of different sizes is passed to perform printing, the surface of the heat radiating member 210 that heats the fixing belt 25 which contacts the recording paper sheet 32 is divided into three regions which are both end portions and a central portion in the longitudinal direction thereof. Then, the first heat generating region 322*a* and the second heat generating region 322*b* of the heat generating layer 322 respectively correspond to the both end portions in the longitudinal direction of the heat radiating member 210, and the third heat generating region 322*c* corresponds to the central portion in the longitudinal direction of the heat radiating member 210.

In the first heat generating region 322*a*, paper passing region heating sections 3221*a* that correspond to the plurality of heat generating resistors extending in the short-side direction of the heat radiating member 210 are provided side by side so as to be spaced mutually in the longitudinal direction of the heat radiating member 210, and both end portions in the short-side direction of each of the paper passing region heating sections 3221*a* are connected to a pair of power feeding terminal sections 221*f*. In the second heat generating region 322*b*, paper passing region heating sections 3221*b* that correspond to the plurality of heat generating resistors extending in the short-side direction of the heat radiating member 210 are provided side by side so as to be spaced mutually in the longitudinal direction of the heat radiating member 210, and both end portions in the short-side direction of each of the paper passing region heating sections 3221*b* are connected to a pair of power feeding terminal sections 221*g*. In the third heat generating region 322*c*, paper passing region heating sections 3221*c* that correspond to the plurality of heat generating resistors extending in the short-side direction of the heat radiating member 210 are provided side by side so as to be spaced mutually in the longitudinal direction of the heat radiating member 210, and both end portions in the short-side direction of each of the paper passing region heating sections 3221*c* are connected to a pair of power feeding terminal sections 221*h*.

That is, the respective paper passing region heating sections 3221*a* in the first heat generating region 322*a*, the respective paper passing region heating sections 3221*b* in the second heat generating region 322*b*, and the respective paper passing region heating sections 3221*c* in the third heat generating region 322*c*, are respectively connected to different power feeding terminal sections 221*f*, 221*g*, and 221*h*, and thereby it is possible to energize the respective heat generating regions separately. Whereby, when the recording paper sheet 32 of different sizes is passed to perform printing, in order to obtain the desired temperature distribution on the surface of the heat generating layer 322 corresponding to the different passing paper sizes; on/off of electrical conduction is switched for the respective heat generating regions 322*a*, 322*b*, and 322*c* to perform sub-control of heating so that only a desired specific region on the surface of the heat generating layer 322 generates heat, and thus it is possible to suppress the regional abnormal temperature rise of the paper passing region heating section of the heat generating resistor in the heat generating region corresponding to the both end portions of the passing paper width of the recording paper sheet 32.

Figure 12C:
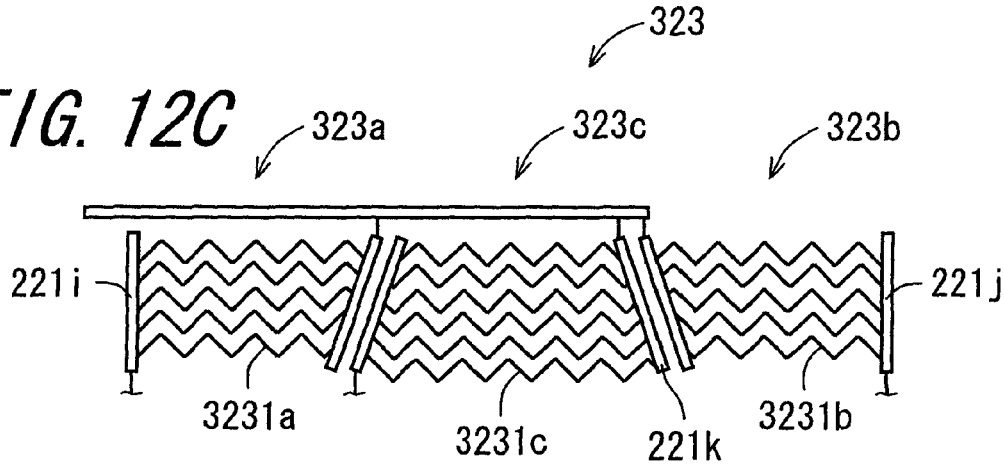

A heat generating layer 323 shown in FIG. 12C is divided into a first heat generating region 323*a*, a second heat generating region 323*b*, and a third heat generating region 323*c*, corresponding to the plurality of regions on the surface of the heat radiating member 210. In the embodiment, assuming a case where the recording paper sheet 32 of different sizes is passed to perform printing, the surface of the heat radiating member 210 that heats the fixing belt 25 which contacts the recording paper sheet 32 is divided into three regions which are both end portions and a central portion in the longitudinal direction thereof. Then, the first heat generating region 323*a* and the second heat generating region 323*b* of the heat generating layer 323 respectively correspond to the both end portions in the longitudinal direction of the heat radiating member 210, and the third heat generating region 323*c* corresponds to the central portion in the longitudinal direction of the heat radiating member 210.

In the first heat generating region 323*a*, paper passing region heating sections 3231*a* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3231*a* are connected to a pair of power feeding terminal sections 221*i*. At this time, the power feeding terminal section 221*i* on an end portion side is formed as extending in the short-side direction of the heat radiating member 210, and the power feeding terminal section 221*i* on a center side is formed as extending in a direction of inclining at a predetermined angle with respect to the longitudinal direction of the heat radiating member 210. In the second heat generating region 323*b*, paper passing region heating sections 3231*b* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3231*b* are connected to a pair of power feeding terminal sections 221*j*. At this time, the power feeding terminal section 221*j* on an end portion side is formed as extending in the short-side direction of the heat radiating member 210, and the power feeding terminal section 221*j* on a center side is formed as extending in a direction of inclining at a predetermined angle with respect to the longitudinal direction of the heat radiating member 210. In the third heat generating region 323*c*, paper passing region heating sections 3231*c* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3231*c* are connected to a pair of power feeding terminal sections 221*k*. At this time, the power feeding terminal sections 221*k* are provided to be parallel with the terminals on the center sides of the power feeding terminal section 221*i* and the power feeding terminal section 221*j*.

That is, the respective paper passing region heating sections 3231*a* in the first heat generating region 323*a*, the respective paper passing region heating sections 3231*b* in the second heat generating region 323*b*, and the respective paper passing region heating sections 3231*c* in the third heat generating region 323*c*, are respectively connected to different power feeding terminal sections 221*i*, 221*j*, and 221*k*, and thereby it is possible to energize the respective heat generating regions separately. Whereby, when the recording paper sheet 32 of different sizes is passed to perform printing, in order to obtain desired temperature distribution on the surface of the heat generating layer 323 corresponding to the different passing paper sizes, on/off of electrical conduction is switched for the respective heat generating regions 323*a*, 323*b*, and 323*c* to perform sub-control of heating so that only a desired specific region on the surface of the heat generating layer 323 generates heat, and thus it is possible to suppress the regional abnormal temperature rise of the paper passing region heating section of the heat generating resistor in the heat generating region corresponding to the both end portions of the passing paper width of the recording paper sheet 32.

Figure 12D:
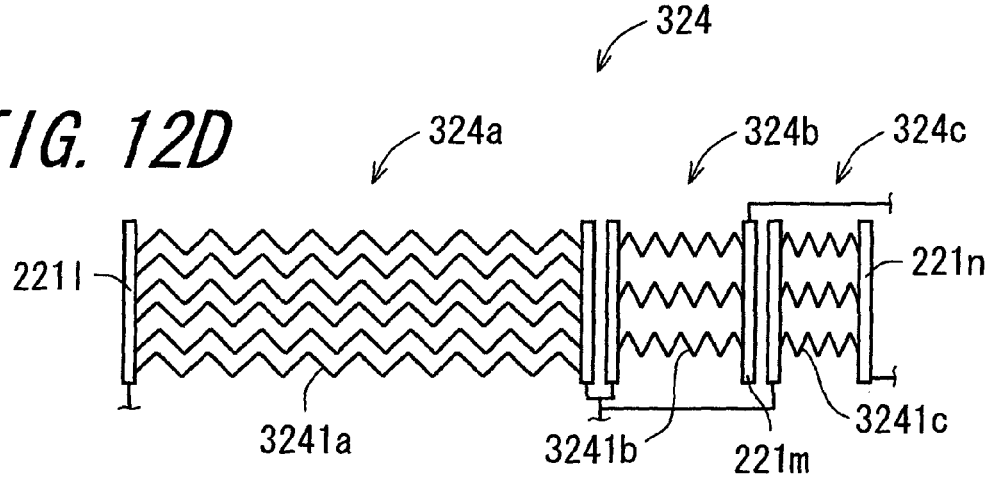

A heat generating layer 324 shown in FIG. 12D is divided into a first heat generating region 324*a*, a second heat generating region 324*b*, and a third heat generating region 324*c*, corresponding to the plurality of regions on the surface of the heat radiating member 210. In the embodiment, the surface of the heat radiating member 210 is divided into three regions which are two regions on an end side in the longitudinal direction thereof and the remaining region. Then, the first heat generating region 324*a* of the heat generating layer 324 corresponds to the remaining region of the heat radiating member 210, and the second heat generating region 324*b* corresponds to a center-side region among two regions on the end side in the longitudinal direction of the heat radiating member 210, and the third heat generating region 324*c* corresponds to an end portion-side region among the two regions on the end side in the longitudinal direction of the heat radiating member 210.

In the first heat generating region 324*a*, paper passing region heating sections 3241*a* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3241*a* are connected to a pair of power feeding terminal sections 221*l*. In the second heat generating region 324*b*, paper passing region heating section 3241*b* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3241*b* are connected to a pair of power feeding terminal sections 221*m*. In the third heat generating region 324*c*, paper passing region heating sections 3241*c* that correspond to the plurality of heat generating resistors extending in the longitudinal direction of the heat radiating member 210 are provided side by side so as to be spaced mutually in the short-side direction of the heat radiating member 210, and both end portions in the short-side direction of each of the paper passing region heating sections 3241*c* are connected to a pair of power feeding terminal sections 221*n*.

That is, the respective paper passing region heating sections 3241*a* in the first heat generating region 324*a*, the respective paper passing region heating sections 3241*b* in the second heat generating region 324*b*, and the respective paper passing region heating sections 3241*c* in the third heat generating region 324*c*, are respectively connected to different power feeding terminal sections 221*l*, 221*m*, and 221*n*, and thereby it is possible to energize the respective heat generating regions separately. Whereby, in order to obtain desired temperature distribution on the surface of the heat generating layer 324, on/off of electrical conduction is switched for the respective heat generating regions 324*a*, 324*b*, and 324*c* and it is possible to perform sub-control of heating so that only a desired specific region on the surface of the heat generating layer 324 generates heat.

In the above embodiments, although descriptions have been given for the divided state of the heat generating part on the surface of the heat generating layer that the paper passing region heating sections corresponding to the plurality of heat generating resistors are formed on a same layer, hereinafter, using FIGS. 13A and 13B, description will be given for a divided state of a heat generating part on a surface of a heat generating layer having a layered structure in which a plurality of heat generating resistors are layered.

Figure 13A:
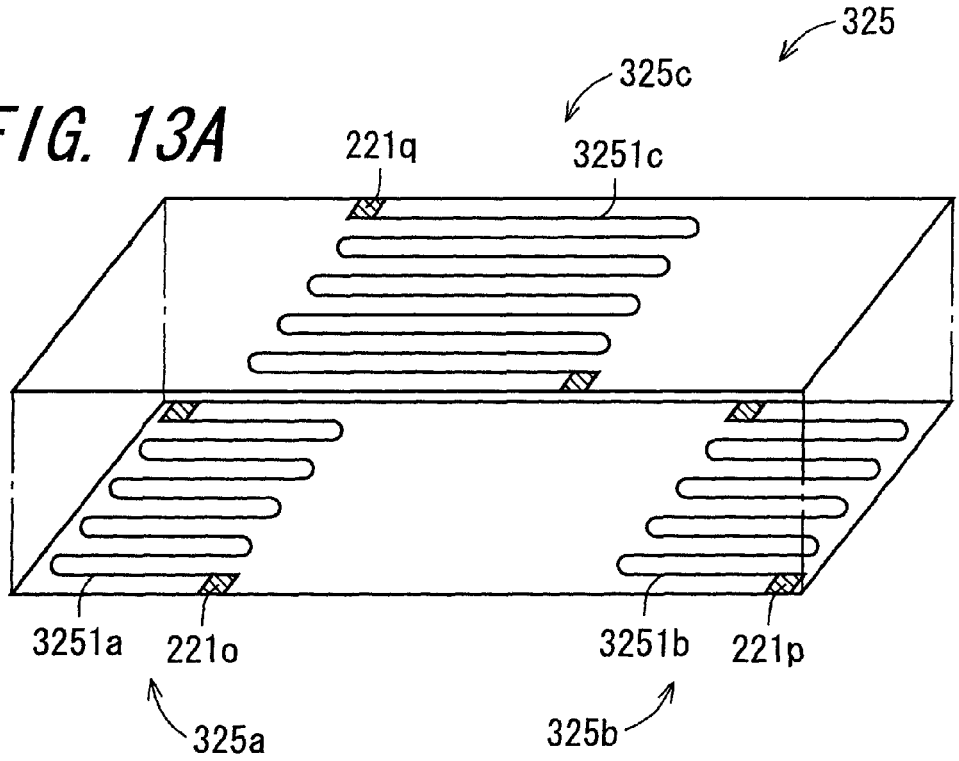
FIGS. 13A and 13B are views showing a divided state of a paper passing region heating section in a heat generating layer having a layered structure in which a plurality of heat generating resistors are layered.
Figure 13B:
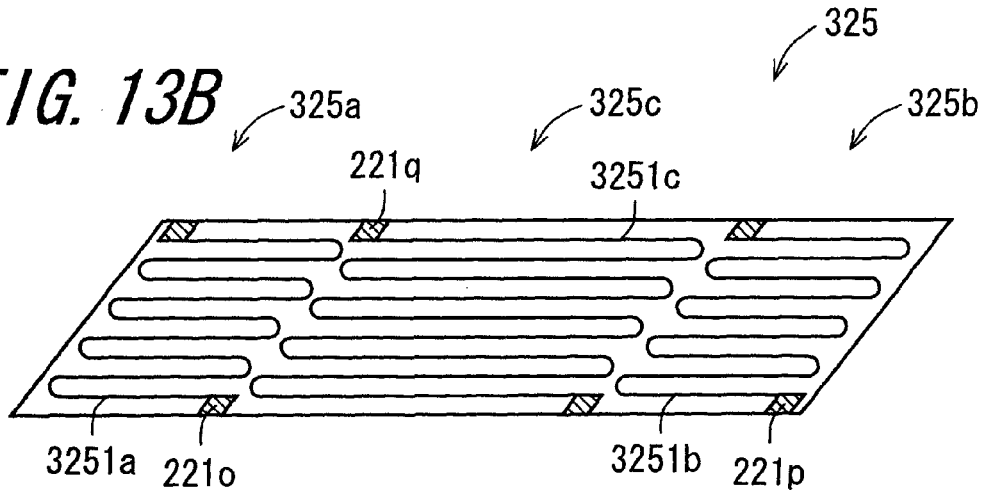

FIGS. 13A and 13B are views showing a divided state of a paper passing region heating section in a heat generating layer having a layered structure in which a plurality of heat generating resistors are layered. FIG. 9A shows a configuration of a heat generating layer 325 having a layered structure in which a plurality of heat generating resistors are layered, and FIG. 9B shows an arranged state of the paper passing region heating section of each of the heat generating resistors in a plan view of the layered structure of the heat generating resistors in the heat generating layer 325.

The heat generating layer 325 shown in FIGS. 13A and 13B is formed by laminating a plurality of ceramic sheets having a width of 12 mm corresponding to the circumferential direction of the heat radiating member 325, providing a silver-palladium-based thin-film heat generating resistor having a line width of 1 mm on the matching surface of each ceramic sheet so as to reciprocate and turn back 2.5 times by printing, and firing the thin-film heat generating resistor. The size of the respective ceramic sheets, and the material, width, thickness, and the turnback pattern at the time of printing of the thin-film heat generating resistor are appropriately set in accordance with the necessary heat generation capability of the heat generating layer 325. The heat generating layer 325 including a ceramic heat generating element laminated with ceramic sheets can be rapidly heated, and even when the heat generating layer 325 itself is in the overheated state, safety is secured since smoke generation or ignition does not occur while damages occur.

The heat generating layer 325 is divided into a first heat generating region 325*a*, a second heat generating region 325*b*, and a third heat generating region 325*c*, corresponding to the plurality of regions of the surface of the heat radiating member 210. In this embodiment, on the assumption that printing is performed on the recording paper sheets 32 of different sizes, the surface of the heat radiating member 210, which heats the fixing belt 25 in contact with the recording paper sheets 32, is divided into three regions which are both end portions and a central portion in the longitudinal direction thereof. Then, the first heat generating region 325*a* and the second heat generating region 325*b* of the heat generating layer 325 correspond to both end portions in the longitudinal direction of the heat radiating member 210, and the third heat generating region 325*c* corresponds to the central portion in the longitudinal direction of the heat radiating member 210.

The heat generating layer 325 has the layered structure in which the first heat generating region 325*a* and the second heat generating region 325*b* are formed in a same layer, and the third heat generating region 325*c* is formed in another layer. In the first heat generating region 325*a*, a paper passing region heating section 3251*a* that corresponds to the heat generating resistor extending as a wave-shape in the short-side direction of the heat radiating member 210, and both end portions in the short-side direction of the paper passing region heating section 3251*a* are connected to a pair of power feeding terminal sections 221*o*. In the second heat generating region 325*b*, a paper passing region heating section 3251*b* that corresponds to the heat generating resistor extending as a wave-shape in the short-side direction of the heat radiating member 210, and both end portions in the short-side direction of the paper passing region heating section 3251*b* are connected to a pair of power feeding terminal sections 221*p*. In the third heat generating region 325*c*, a paper passing region heating section 3251*c* that corresponds to the heat generating resistor extending as a wave-shape in the short-side direction of the heat radiating member 210, and both end portions in the short-side direction of the paper passing region heating section 3251*c* are connected to a pair of power feeding terminal sections 221*q*.

That is, the paper passing region heating section 3251*a* in the first heat generating region 325*a*, the paper passing region heating section 3251*b* in the second heat generating region 325*b*, and the paper passing region heating section 3251*c* in the third heat generating region 325*c*, are respectively connected to different power supply terminal sections 221*o*, 221*p*, and 221*q*, and thereby it is possible to energize the respective heat generating regions separately. Whereby, when the recording paper sheet 32 of different sizes is passed to perform printing, in order to obtain desired temperature distribution on the surface of the heat generating layer corresponding to the different passing paper sizes, on/off of electrical conduction is switched for the respective heat generating regions 325*a*, 325*b*, and 325*c* to perform sub-control of heating so that only a desired specific region on the surface of the heat generating layer 325 generates heat, and thus it is possible to suppress the regional abnormal temperature rise of the paper passing region heating section of the heat generating resistor in the heat generating region corresponding to the both end portions of the passing paper width of the recording paper sheet 32.

Figure 14A:
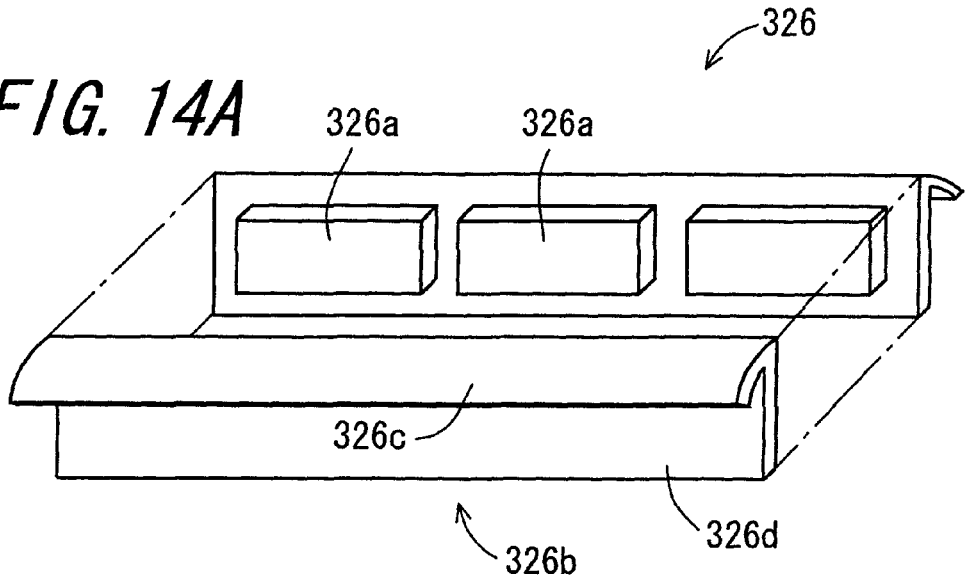
FIGS. 14A and 14B are views showing a configuration of a heating section having a structure in which a plurality of semiconductor ceramic elements are held by a heat radiating member.
Figure 14B:
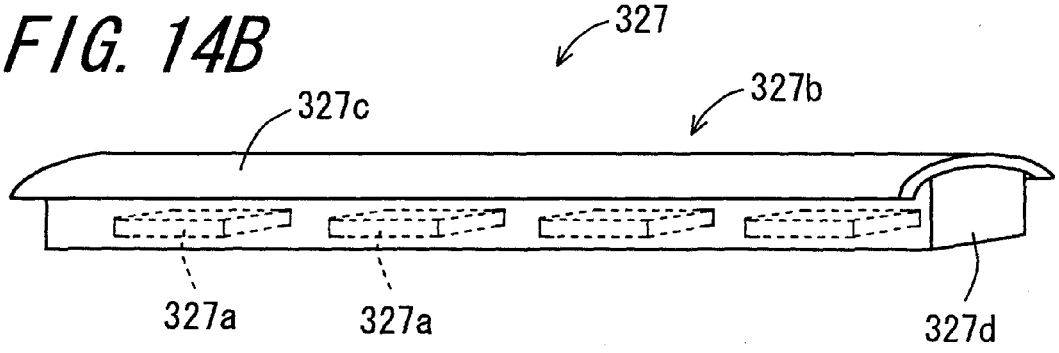

FIGS. 14A and 14B are views showing a configuration of the heating section having a structure in which a plurality of semiconductor ceramic elements are held by a heat radiating member.

A heating section 326 shown in FIG. 14A has a structure in which a plurality of semiconductor ceramic elements 326*a* are sandwiched by two heat radiating members 326*b*. Each of the semiconductor ceramic elements 326*a* is a heat generating resistor that generates heat due to electrical conduction. In the embodiment, a detecting section of the heat generating resistor is provided by being electrically connected in parallel with each semiconductor ceramic element 326*a*. Each of the heat radiating members 326*b* has a curved section 326*c* which is curved and a bent section 326*d* which is formed by bending the curved section 326*c* from an end portion of the circumferential direction thereof. In the heating section 326, in a state of sandwiching the semiconductor ceramic elements 326*a* with the bent sections 326*d* of the two heat radiating members 326*b*, the curved sections 326*c* of the two heat radiating members 326*b* are to form a semi-cylinder shape as a whole. Then, the surface of the curved sections 326*c* formed to be a semi-cylinder shape as a whole is a surface of contacting the fixing belt 25. Each of the semiconductor ceramic elements 326*a* is one obtained by molding inorganic powder whose chief component is barium titanate into a thin block shape and firing the molded product. It is possible to obtain the amount of heat generation of more than ten watts to hundreds of watts per each of the semiconductor ceramic elements 326*a*.

A heating section 327 shown in FIG. 14B has a structure in which a plurality of semiconductor ceramic elements 327*a* are fit into the heat radiating member 327*b*. Each of the semiconductor ceramic elements 327*a* is a heat generating resistor that generates heat due to electrical conduction. In the embodiment, a detecting section of the heat generating resistor is provided by being electrically connected in parallel with each semiconductor ceramic element 327*a*. The heat radiating member 327*b* includes a curved section 327*c* which is curved and formed to be a semi-cylinder shape, and a protruding section 327*d* which protrudes from the inner circumferential surface of the curved section 327*c* and has a recess. In the heating section 327, each of the semiconductor ceramic elements 327*a* is fit into the recess provided in the protruding section 327*d* of the heat radiating member 327*b*. Then, the outer circumferential surface of the curved section 327*c* of the heat radiating member 327*b* is a surface of contacting the fixing belt 25.

Figure 15:
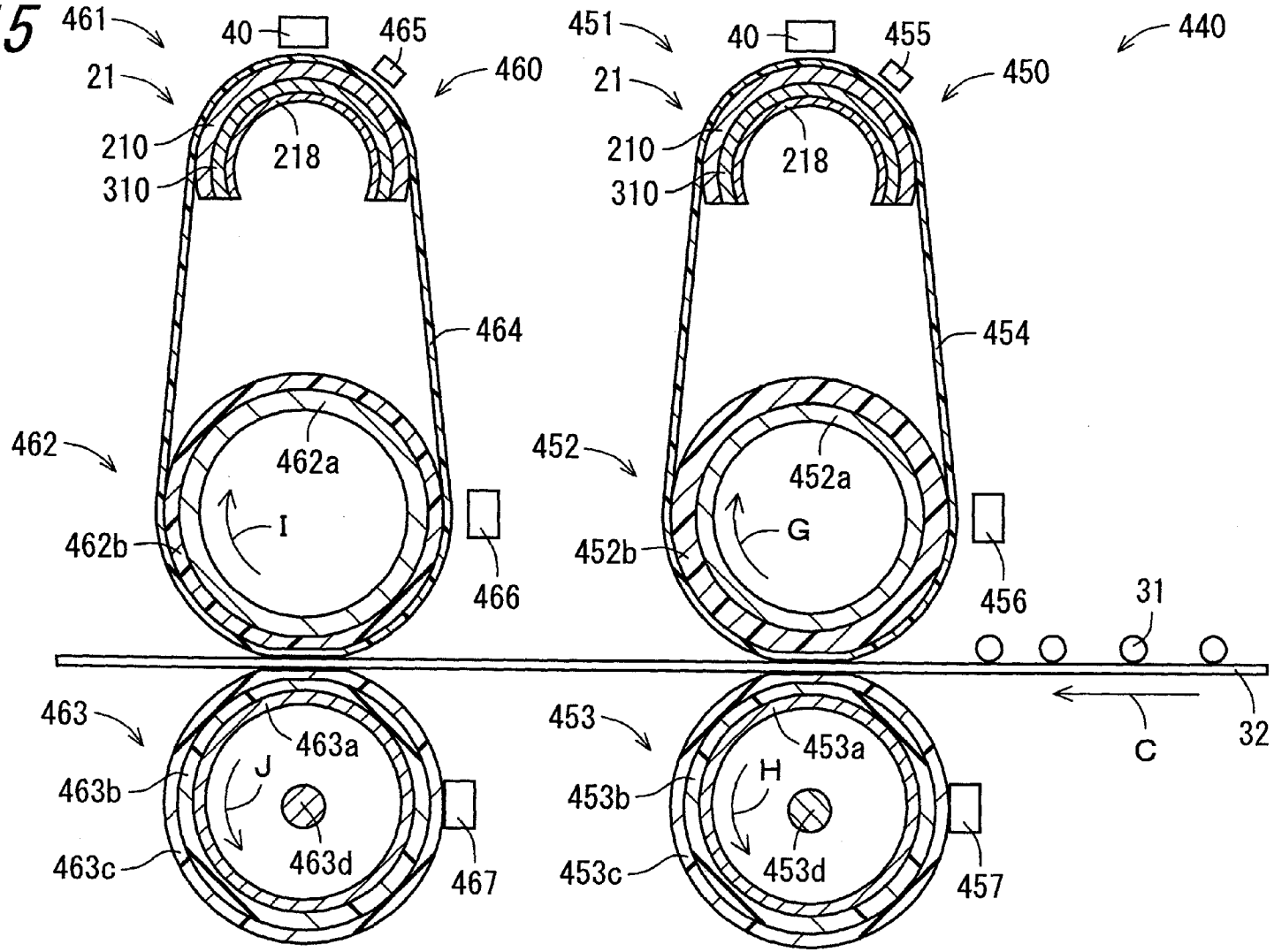
FIG. 15 is a diagram showing a configuration of a fixing device according to a second embodiment of the invention.

FIG. 15 is a diagram showing the configuration of a fixing device 440 according to a second embodiment of the invention. The fixing device 440 is a fixing device of two-stage fixing type, and is configured such that a first fixing unit 450 and a second fixing unit 460 are arranged in parallel in the horizontal direction. The first fixing unit 450 performs primary fixing in which the unfixed toner image 31 is fixed on the recording paper sheet 32 under application of heat and pressure. The second fixing unit 460 is arranged on the downstream side in the feeding direction C of the recording paper sheet 32 from the first fixing unit 450, and performs secondary fixing in which the toner image 31 after the primary fixing is fixed on the recording paper sheet 32 under application of heat and pressure. The first fixing unit 450 and the second fixing unit 460 in the fixing device 440 are the fixing device 15 of the above-described embodiment which includes the connector 50 comprising integrally the primary-side wiring connector terminals and the secondary-side wiring connector terminals.

In the fixing device 440 of two-stage fixing type configured as above, in a state where a first heat generating element-side thermistor 455 serving as a temperature detection element of the first fixing unit 450 and a second heat generating element-side thermistor 465 serving as a temperature detection element of the second fixing unit 460 are not operated normally, and electrical conduction to the heat generating resistors is not controlled normally, it is possible to prevent electrical conduction to the heat generating resistors. For this reason, it is possible to suppress abnormal electrical conduction to the heat generating resistors in the first fixing unit 450 and the second fixing unit 460, thereby preventing the heat generating resistors from being in an overheat state. Therefore, it is possible to prevent the heat generating resistors in the first fixing unit 450 and the second fixing unit 460 from resulting in smoke generation or burnout, and high safety is able to be secured.

A guide member such as a feeding guide plate or a feeding roller, is provided between the first fixing unit 450 and the second fixing unit 460. The recording paper sheet 32 that is subjected to fixing in the fixing nip region of the first fixing unit 450, is fed along the guide member, is subjected to fixing in the fixing nip region of the second fixing unit 460, and then discharged. The fixing device 440 can be mounted in the image forming apparatus 100, instead of the fixing device 15.

The first fixing unit 450 includes a first heating section 451, a first fixing roller 452, a first pressure roller 453, and a first fixing belt 454 which is the same as the above-described fixing belt 25. In the first fixing unit 450, the first fixing belt 454 is supported around the first fixing roller 452 and the first heating section 451 with tension, and the first pressure roller 453 is arranged to face the first fixing roller 452 with the first fixing belt 454 interposed therebetween.

The first heating section 451 has the above-described heating section 21. The heating section 21 of the first heating section 451 includes the above-described heat radiating member 210, a heat generating member having the above-described heat generating layer 310 in which the heat generating region is divided into three regions which are the both end portions and the central portion in the longitudinal direction of the heat radiating member 210, and the above-described inside securing member 218.

The heat radiating member 210 in the embodiment is made by curving a metallic thin plate formed of aluminum and having a thickness of 0.5 mm such that a diameter in section is to be 40 mm and an opening angle of an opening section is to be 125°, and contacts the first fixing belt 454 on the outer circumferential surface thereof so as to transmit heat generated by the heat generating layer 310 to the first fixing belt 454.

As described above, the heat generating layer 310 is divided into a first heat generating region 310*a* and a second heat, generating region 310*b* corresponding to the both end portions in the longitudinal direction of the heat radiating member 210, and a third heat generating region 212*c* corresponding to the central portion in the longitudinal direction of the heat radiating member 210, and the respective heat generating regions can be energized separately. By controlling electrical conduction of the heat generating regions appropriately in accordance with the size or thickness of the recording paper sheet 32, the heat generating layer 310 generates heat. In this embodiment, the heat generating layer 310 generates heat with the amount of heat generation of 1100 W, the amount of heat generation of the third heat generating region 310*c* is 600 W, and the amount of heat generation of each of the first heat generating region 310*a* and the second heat generating region 310*b* is 250 W.

The inside securing member 218, as described above, is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating member 310 to be in surface-contact with the inside surface of the heat radiating member 210.

Further, a first heat generating element-side thermistor 455 is arranged around the circumferential surface of the first fixing belt 454 wound around the first heating section 451 and detects temperature of the circumferential surface in a non-contact manner.

The first fixing roller 452 comes into pressure-contact with the first pressure roller 453 with the first fixing belt 454 interposed therebetween to form the fixing nip region, and is driven to rotate in a rotation direction G about the rotation axis by a drive motor (not shown), thereby feeding the first fixing belt 454. The first fixing roller 452 has a two-layered structure consisting of a core metal 452*a* and an elastic layer 452*b*, which are formed in this order from inside. For the core metal 452*a*, for example, a metal such as iron, stainless steel, aluminum, or copper, or an alloy thereof is used. In this embodiment, the core metal 452*a* is a member formed of aluminum and having an outer diameter of 40 mm. For the elastic layer 452*b*, a heat resistant rubber material such as silicone rubber or fluorine rubber is appropriately used. In this embodiment, the elastic layer 452*b* is a member formed of silicone foaming sponge having small thermal conductivity and having a thickness of 5 mm. The surface hardness of the first fixing roller 452 thus configured is 68 degrees (Asker C hardness).

Furthermore, a first fixing roller-side thermistor 456 is arranged around the circumferential surface of the winding portion (heating nip region) of the first fixing roller 452, at which the first fixing belt 454 is wound, and detects temperature of the circumferential surface of the first fixing belt 454 wound around the first fixing roller 454 in a non-contact manner.

The first pressure roller 453 is opposite to and in pressure-contact with the first fixing roller 452 with the first fixing belt 454 interposed therebetween, and is driven to rotate in a rotation direction H around the rotation axis by a drive motor (not shown). The first fixing belt 454 and the first fixing roller 452, and the first pressure roller 453 rotate reversely with respect to each other. The first pressure roller 453 has a three-layered structure consisting of a core metal 453*a*, an elastic layer 453*b*, and a release layer 453*c*, which are formed in this order from inside. For the core metal 453*a*, for example, a metal such as iron, stainless steel, aluminum, or copper, or an alloy thereof is used. In this embodiment, the core metal 453*a* is a member formed of aluminum and having an outer diameter of 46 mm. For the elastic layer 453*b*, a heat resistant rubber material such as silicone rubber or fluorine rubber is appropriately used. In this embodiment, the elastic layer 453*b* is a member formed of silicone rubber and having a thickness 2 mm. For the release layer 453*c*, fluorine resin such as PFA (a copolymer of tetrafluoroethylene and perfluoroalkyl vinyl ether) or PTFE (polytetrafluoroethylene), is appropriately used. Further, the release layer 453*c* is a member formed of PFA and having a thickness of about 30 μm. The surface hardness of the first pressure roller 453 thus configured is 75 degrees (Asker C hardness).

Furthermore, a first heater lamp 453*d* (for example, rated power 400 W) is arranged in an interior of the first pressure roller 453 and heats the first pressure roller 453. The control circuit 61 causes power to be supplied (energized) from the power supply circuit 62 to the first heater lamp 453*d*, the first heater lamp 453*d* emits light, and infrared rays are radiated from the first heater lamp 453*d*. Thus, the inner circumferential surface of the first pressure roller 453 absorbs the infrared rays and is heated, such that the entire first pressure roller 453 is heated. Further, a first pressure roller-side thermistor 457 is arranged on the circumferential surface of the first pressure roller 453 and detects temperature of the circumferential surface of the first pressure roller 453 in a contact manner. Furthermore, an external heater for rapidly heating the surface of the first pressure roller 453, a cleaning roller, and an oil coating roller may be provided in the first pressure roller 453.

The first fixing roller 452 and the first pressure roller 453 have an outer diameter of 50 mm and are in pressure-contact with each other by an elastic member (spring member) (not shown) with a predetermined load (in this case, 600 N). Thus, the fixing nip region is formed between the circumferential surface of the first fixing belt 454 which is supported around the first fixing roller 452 and the first heating section 451, and the circumferential surface of the first pressure roller 453. The fixing nip region refers to a region where the first fixing belt 454 and the first pressure roller 453 come into contact with each other. In this embodiment, the fixing nip region is 9 mm. The first fixing roller 452 is heated to a predetermined temperature (in this case, 180° C.), and the recording paper sheet 32 passes through the fixing nip region, such that the unfixed toner images 31 are heated and molten, and the images are fixed. When the recording paper sheet 32 passes through the fixing nip region, the first fixing belt 454 comes into contact with the toner image forming surface of the recording paper sheet 32, and the first pressure roller 453 comes into contact with the surface of the recording paper sheet 32 opposite to the toner image forming surface.

The recording paper sheet 32 is fed to the fixing nip region at a predetermined fixing speed and a copy speed in accordance with the rotation speed of the first fixing roller 452 and the first pressure roller 453, and the unfixed toner images 31 are fixed onto the recording paper sheet 32 under application of heat and pressure. The fixing speed refers to a so-called process speed. In the case of monochrome printing, the fixing speed is 355 mm/sec, and in the case of color printing, the fixing speed is 220 mm/sec. The copy speed refers to the number of copies per minute. In the case of monochrome printing, the copy speed is 70 sheets/minute, and in the case of color printing, the copy speed is 60 sheets/minute.

A web cleaner for cleaning the surface of the first fixing belt 454 is arranged in the first fixing unit 450.

The control circuit 61 controls electrical conduction to the heat generating layer 310 and the first heater lamp 453*d* through the power supply circuit on the basis of temperature data detected by the respective thermistors 455, 456, and 457, such that the heat radiating member 210 of the first heating section 451, the first fixing belt 454, and the first pressure roller 453 are at a predetermined temperature.

Next, the second fixing unit 460 will be described. The second fixing unit 460 includes a second heating section 461, a second fixing roller 462, a second pressure roller 463, and a second fixing belt 464 which is the same as the above-described fixing belt 25. In the second fixing unit 460, the second fixing belt 464 is supported around the second fixing roller 462 and the second heating section 461 with tension, and the second pressure roller 463 is arranged to face the second fixing roller 462 with the second fixing belt 464 interposed therebetween. The second fixing unit 460 has the same basic configuration as the first fixing unit 450, except that the second heating section 461 is different from the first heating section 451, and the second fixing roller 462 is different from the first fixing roller 452.

The second heating section 461 has the above-described heating section 21. The heating section 21 of the second heating section 461 includes the above-described heat radiating member 210 and a heat generating member having a heat generating layer 310 in which the heat generating region is divided into three regions which are the both end portions and the central portion in the longitudinal direction of the heat radiating member 210 and two regions in the short-side direction of the heat radiating member 210, that is, six regions in total, and the above-described inside securing member 218.

The heat radiating member 210 contacts the second fixing belt 464 on the outer circumferential surface thereof so as to transmit heat generated by the heat generating layer 310 to the second fixing belt 464.

As described above, the heat generating layer 310 is divided into first to six heat generating regions. The first heat generating region and the second heat generating region are both end portions in the longitudinal direction of the heat radiating member 210 and correspond to the downstream side in the rotation direction of the second fixing belt 464. The third heat generating region and the fourth heat generating region are both end portions in the longitudinal direction of the heat radiating member 210 and correspond to the upstream side in the rotation direction of the second fixing belt 464. The fifth heat generating region is the central portion in the longitudinal direction of the heat radiating member 210 and corresponds to the downstream side in the rotation direction of the second fixing belt 464. The sixth heat generating region is the central portion in the longitudinal direction of the heat radiating member 210 and corresponds to the upstream side in the rotation direction of the second fixing belt 464. The respective heat generating regions can be energized separately. By controlling electrical conduction of the heat generating regions appropriately in accordance with the size or thickness of the recording paper sheet 32, the heat generating layer 310 generates heat. In this embodiment, the heat generating layer 310 generates heat with the amount of heat amount of 900 W, the amount of heat generation of the fifth heat generating region is 400 W, the amount of heat generation of the sixth heat generating region is 200 W, the amount of heat generation of each of the first heat generating region and the second heat generating region is 100 W, and the amount of heat generation of each of the third heat generating region and the fourth heat generating region is 50 W.

The inside securing member 218, as described above, is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating member 310 to be in surface-contact with the inside surface of the heat radiating member 210.

Further, a second heat generating element-side thermistor 465 is arranged around the circumferential surface of the second fixing belt 464 wound around the second heating section 461 and detects temperature of the circumferential surface in a non-contact manner.

The second fixing roller 462 comes into pressure-contact with the second pressure roller 463 with the second fixing belt 464 interposed therebetween to form the fixing nip region, and is driven to rotate in a rotation direction I about the rotation axis by a drive motor (not shown), thereby feeding the second fixing belt 464. The second fixing roller 462 has a two-layered structure consisting of a core metal 462*a* and an elastic layer 462*b*, which are formed in this order from inside. For the core metal 462*a*, for example, a metal such as iron, stainless steel, aluminum, or copper, or an alloy thereof is used. In this embodiment, the core metal 462*a* is a member formed of aluminum and having an outer diameter of 46 mm. For the elastic layer 462*b*, a heat resistant rubber material such as silicone rubber or fluorine rubber is appropriately used. In this embodiment, the elastic layer 462*b* is a member formed of silicone rubber and having a thickness of 2 mm. The surface hardness of the second fixing roller 462 thus configured is 68 degrees (Asker C hardness).

Furthermore, a second fixing roller-side thermistor 466 is arranged around the circumferential surface of the winding portion (heating nip region) of the second fixing roller 462, at which the second fixing belt 464 is wound, and detects temperature of the circumferential surface of the second fixing belt 464 wound around the second fixing roller 462 in a non-contact manner.

The second pressure roller 463 is opposite to and in pressure-contact with the second fixing roller 462 with the second fixing belt 464 interposed therebetween, and is driven to rotate in a rotation direction J about the rotation axis by a drive motor. The second fixing belt 464 and the second fixing roller 462, and the second pressure roller 463 rotate reversely with each other. The second pressure roller 463 has a three-layered structure consisting of a core metal 463*a*, an elastic layer 463*b*, and a release layer 463*c*, which are formed in this order from inside. For the core metal 463*a*, for example, a metal such as iron, stainless steel, aluminum, or copper, or an alloy thereof is used. In this embodiment, the core metal 463*a* is a member formed of aluminum and having an outer diameter of 46 mm. For the elastic layer 463*b*, heat resistant rubber material such as silicone rubber or fluorine rubber is appropriately used. In this embodiment, the elastic layer 463*b* is a member formed of silicone rubber and having a thickness of 2 mm. For the release layer 463*c*, fluorine resin such as PFA or PTFE is appropriately used. In this embodiment, the release layer 463*c* is a member formed of PFA and having a thickness of about 30 μm. The surface hardness of the second pressure roller 463 thus configured is 75 degrees (Asker C hardness).

Furthermore, a second heater lamp 463*d* (for example, rated power 400 W) for heating the second pressure roller 463 is arranged inside the second pressure roller 463. A control circuit 61 causes power to be supplied (energized) from the power supply circuit 62 to the second heater lamp 463*d*, the second heater lamp 463*d* emits light, and infrared rays are radiated from the second heater lamp 463*d*. Thus, the inner circumferential surface of the second pressure roller 463 absorbs the infrared rays and is heated, such that the entire second pressure roller 463 is heated. Further, a second pressure roller-side thermistor 467 is arranged on the circumferential surface of the second pressure roller 463 and detects temperature of the circumferential surface of the second pressure roller 463 in a contact manner.

The second fixing roller 462 and the second pressure roller 463 have an outer diameter of 50 mm and are in pressure-contact with each other by an elastic member (spring member) (not shown) with a predetermined load (in this case, 550 N). Thus, the fixing nip region is formed between the circumferential surface of the second fixing belt 464 which is supported around the second fixing roller 462 and the second heating section 461, and the circumferential surface of the second pressure roller 463. The fixing nip region refers to a portion where the second fixing belt 464 and the second pressure roller 463 come into contact with each other. In this embodiment, the fixing nip region is 8 mm.

The control circuit 61 controls electrical conduction to the heat generating layer 310 and the second heater lamp 463*d* through the power supply circuit 62 on the basis of temperature data detected by the thermistors 465, 466, and 467 such that the heat radiating member 210, the second fixing belt 464, and the second pressure roller 463 of the second heater 461 are at a predetermined temperature.

In the above-described fixing device 440 including the first fixing unit 450 and the second fixing unit 460, as described in Japanese Unexamined Patent Publication JP-A 2005-352389, control is performed such that the temperature of the second fixing unit 460 is controlled so as to compensate for the changes in temperature of the first fixing unit 450 (gloss compensation mode), whereby substantially uniform image gloss is obtained when the sheet passes successively therethrough (successive fixing processing).

First, the relational expression about temperature between the first fixing belt 454 and the second fixing belt 464 is calculated in advance such that a plurality of output images have substantially uniform gloss. That is, the temperature of the second fixing belt 464 is controlled so as to be at temperature calculated by the relational expression with respect to the change in temperature of the first fixing belt 454, such that images with uniform gloss are obtained, regardless of the temperature of the first fixing roller 452.

The temperature control section of the first fixing unit 450 calculates the difference (T1−T2) between the surface temperature T1 of the first fixing belt 454 detected by the first fixing roller-side thermistor 456 and a target temperature set value T2 of the first fixing belt 454 as a temperature change value a of the first fixing belt 454. When the temperature change value a exceeds a temperature ripple for temperature control of the first fixing belt 454 when the sheet does not pass therethrough, control by the gloss correction temperature control mode is performed. When a target set temperature of the second fixing belt 464 is referred to as T4, in the gloss correction temperature control mode, temperature control of the second fixing belt 464 is performed by means of a value (T4+β) which is obtained by adding a temperature correction value β of the second fixing belt 464 to the target set temperature T4 of the second fixing belt 464. The temperature control section of the second fixing unit 460 substitutes the surface temperature (T2+α) of the first fixing belt 454 into the relational expression to calculate the control temperature (T4+β) of the second fixing belt 464 and then performs temperature control. The gloss correction temperature control mode ends when the successive fixing processing ends or when the temperature change value α of the first fixing belt 454 is equal to or lower than a predetermined value, and control by the normal mode is carried out.

Figure 16:
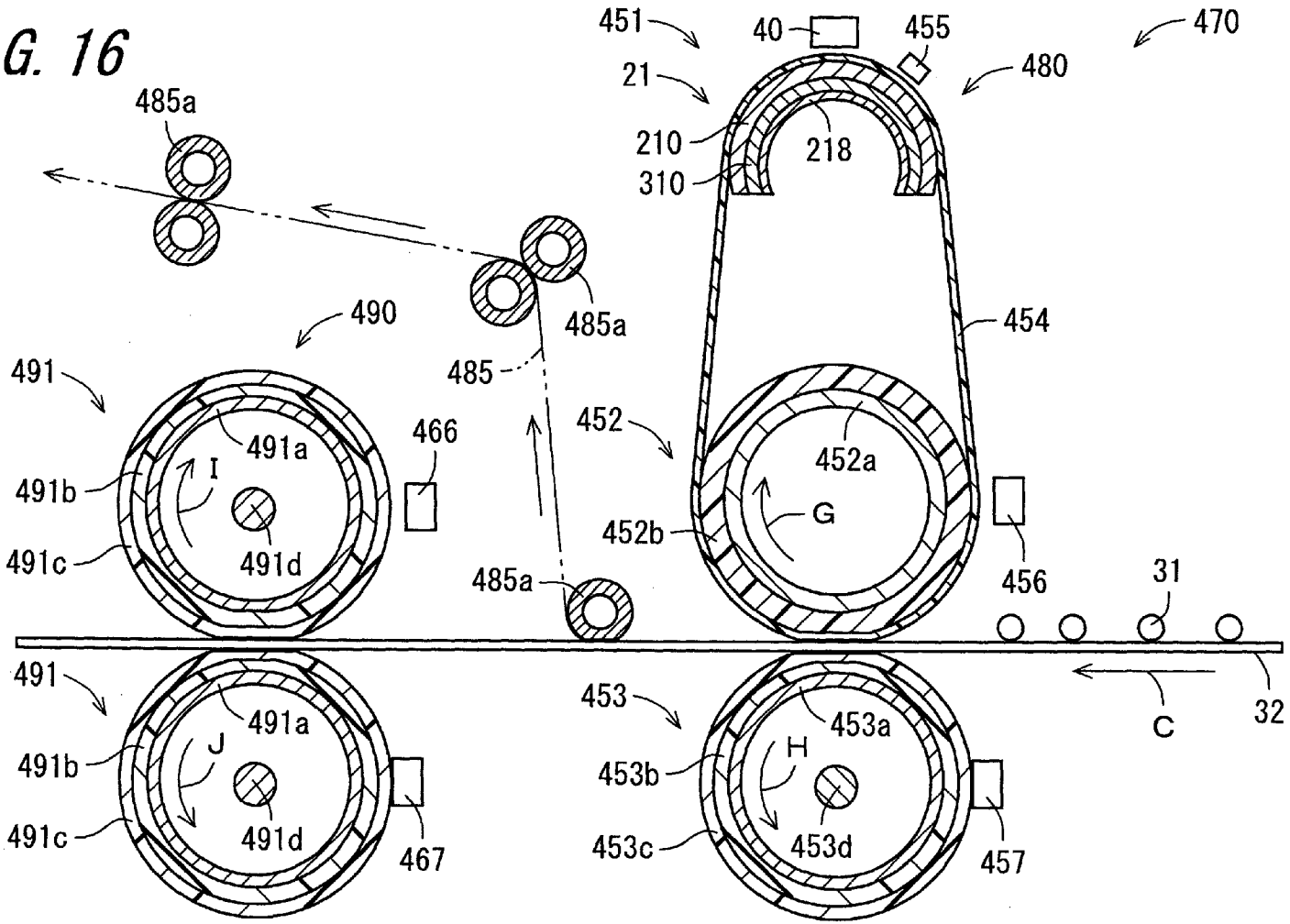
FIG. 16 is a diagram showing a configuration of a fixing device according to a third embodiment of the invention.

FIG. 16 is a diagram showing a configuration of a fixing device 470 according to a third embodiment of the invention. The fixing device 470 is a fixing device of two-stage fixing type, and is configured such that a first fixing unit 480 and a second fixing unit 490 are arranged in parallel in the horizontal direction. The first fixing unit 480 performs primary fixing in which the unfixed toner image 31 is fixed on the recording paper sheet 32 under application of heat and pressure. The second fixing unit 490 is configured such that a pair of eating and pressure rollers 491 provided with a heating section in an interior thereof are in pressure-contact with each other, and is arranged on the downstream side in the feeding direction C of the recording paper sheet 32 from the first fixing unit 480 and performs secondary fixing in which the toner image 31 after the primary fixing is fixed on the recording paper sheet 32 under application of heat and pressure. The first fixing unit 480 of the fixing device 470 is the fixing device 15 of the above-described embodiment which includes the connector 50 comprising integrally the primary-side wiring connector terminals and the secondary-side wiring connector terminals.

In the fixing device 470 of two-stage fixing type configured as above, in a state where a first heat generating element-side thermistor 455 serving as a temperature detection element in the first fixing unit 480 is not operated normally, and electrical conduction to the heat generating resistor is not controlled normally, it is possible to prevent electrical conduction to the heat generating resistor. For this reason, it is possible to suppress abnormal electrical conduction to the heat generating resistor of the first fixing unit 480, thereby preventing the heat generating resistor from being in an overheat state. Therefore, it is possible to prevent the heat generating resistor of the first fixing unit 480 from resulting in smoke generation or burnout, and high safety is able to be secured.

A guide member such as a feeding guide plate or a feeding roller, is provided between the first fixing unit 480 and the second fixing unit 490. The recording paper sheet 32 that is subjected to fixing in the fixing nip region of the first fixing unit 480, is fed along the guide member, is subjected to fixing in the fixing nip region of the second fixing unit 490, and then discharged. The fixing device 470 can be mounted in the image forming apparatus 100, instead of the fixing device 15.

The first fixing unit 480 provided in the fixing device 470 has the same configuration as the first fixing unit 450 provided in the fixing device 440 described above, and thus description thereof will not be repeated.

The second fixing unit 490 provided in the fixing device 470 is a fixing unit of roller fixing type, in which the pair of heating and pressure rollers 491 are in pressure-contact with each other to form the fixing nip region. The rollers are driven to rotate reversely with respect to each other.

The pair of heating and pressure rollers 491 have a three-layered structure consisting of a core metal 491*a*, an elastic layer 491*b*, and a release layer 491*c*, which are formed in this order from inside. For the core metal 491*a*, for example, a metal such as iron, stainless steel, aluminum, or copper, or an alloy thereof is used. For the elastic layer 491*b*, a heat resistant rubber material such as silicone rubber or fluorine rubber is appropriately used. For the release layer 491*c*, fluorine resin such as PFA or PTFE is appropriately used.

Further, each of the pair of heating and pressure rollers 491 is provided with a heater lamp 491*d* which is a heating member in an interior thereof to heat the corresponding heating and pressure roller 491. The control circuit 61 causes power to be supplied (energized) from the power supply circuit 62 to the heater lamps 491*d*, the heater lamps 491*d* emit light, and infrared rays are radiated from the heater lamps 491*d*. Thus, the inner circumferential surfaces of the heating and pressure rollers 491 absorb the infrared rays and are heated, such that the entire heating and pressure rollers 491 are heated. The configuration for heating the heating and pressure rollers 491 is not limited to that described above, an induction heating method using induction heating may be used or a heater lamp and an induction heating method may be appropriately combined.

In the above-described fixing device 470 including the first fixing unit 480 and the second fixing unit 490, the first fixing unit 480 has a mechanism that is capable of carrying out rapid heating, and the second fixing unit 490 has a large heat capacity.

In the fixing device 470 thus configured, the first fixing unit 480 is warmed up in advance. Then, when rising is satisfactory, and a copy operation should be rapidly carried out, after the recording paper sheet 32 has passed through the fixing nip region of the first fixing unit 480 and has been subjected to fixing, the recording paper sheet 32 is fed to a bypass route 485 through the guide member and discharged by a plurality of feeding rollers 485*a* provided in the bypass route 485. In this case, the recording paper sheet 32 is subjected to fixing only by the first fixing unit 480. When the recording paper sheet 32 is thin paper, in the same manner as described above, fixing may be carried out only by the first fixing unit 480.

Meanwhile, when the recording paper sheet 32 is thick paper, to improve image gloss or to improve the fixing speed, the recording paper sheet 32 which is subjected to fixing in the fixing nip region of the first fixing unit 480, may be fed along the guide member and further subjected to fixing in the fixing nip region of the second fixing unit 490. As described above, by carrying out fixing in the fixing nip regions of the first fixing unit 480 and the second fixing unit 490, fixing performance and image gloss can be improved.

Figure 17:
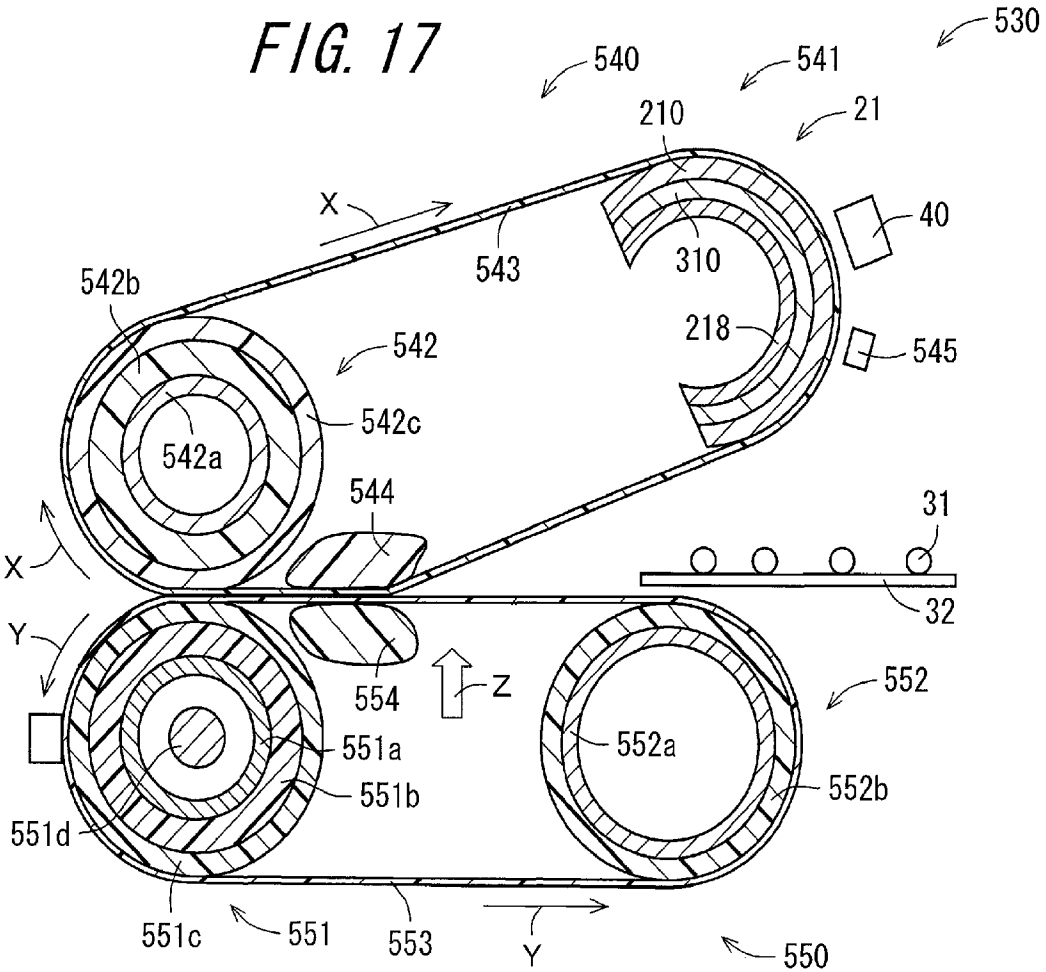
FIG. 17 is a diagram showing a configuration of a fixing device according to a fourth embodiment of the invention.

FIG. 17 is a view showing a configuration of a fixing device 530 according to a fourth embodiment of the invention. The fixing device 530 includes a fixing unit 540 and a pressure section 550. The fixing device 530 carries out fixing onto the recording paper sheet 32, on which the unfixed toner images 31 are borne, in the fixing nip region which is formed between the fixing unit 540 and the pressure section 550. The fixing device 530 can be mounted in the image forming apparatus 100, instead of the fixing device 15.

The fixing unit 540 includes a heating unit 541, a fixing roller 542, and a fixing belt 543 which is an endless-shaped belt. In the fixing unit 540, the fixing belt 543 is supported around the fixing roller 542 and the heating unit 541 with tension.

The heating unit 541 has the above-described heating section 21. The heating section 21 of the heating unit 541 includes the above-described heat radiating member 210, the heat generating member having the heat generating layer 310, and the inside securing member 218. The heat radiating member 210 contacts the fixing belt 543 on the outer circumferential surface thereof so as to transmit heat generated by the heat generating layer 310 to the fixing belt 543. The heat generating layer 310 includes the heat generating resistor in which the paper passing region heating section and the detecting section are electrically connected in parallel, as described above.

The inside securing member 218 is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating layer 310 to be in surface-contact with the inside surface of the heat radiating member 210. Furthermore, a heat generating element-side thermistor 545 is arranged around the circumferential surface of the fixing belt 543 wound around the heating unit 541 and detects temperature of the circumferential surface in a non-contacting manner.

The fixing roller 542 is a roller-like member having an outer diameter of 30 mm, which is driven to rotate in a rotation direction X about the rotation axis by a drive motor (not shown), thereby feeding the fixing belt 543. The fixing roller 542 has a three-layered structure consisting of a core metal 542*a*, an elastic layer 542*b*, and a surface layer 542*c*, which are formed in this order from inside. For the core metal 542*a*, for example, a metal having high thermal conductivity such as iron, stainless steel, aluminum, or copper, or an alloy thereof is used. Although examples of the shape of the core metal 542*a* include a cylinder and a column, the shape of the core metal 542*a* is preferably a cylinder since the amount of heat generation is small. For the elastic layer 542*b*, a heat resistant rubber material such as silicone rubber, fluorine rubber, or fluorosilicone rubber, is appropriately used. Among them, silicone rubber is preferably used which is excellent in rubber elasticity.

The material for the surface layer 542*c* is not particularly limited insofar as heat resistance and durability are excellent and slidability is high. For example, a fluorine-based resin material such as PFA or PTFE, or fluorine rubber may be used. Alternatively, a two-layered structure with no surface layer may be provided. The fixing roller 542 may be provided with a heating section for heating the fixing roller 542 in an interior thereof. This is to reduce the rising time from when the image forming apparatus 100 is powered-on until image formation is possible, and to suppress a decrease in the surface temperature of the fixing roller 542 due to heat transfer to the recording paper sheet 32 at the time of toner image fixing.

The fixing belt 543 is heated to a predetermined temperature by the heating unit 541, and comes into contact with the fixing belt 543 to heat the fed recording paper sheet 32 on which the unfixed toner images 31 are formed. The fixing belt 543, which is an endless-shaped belt, is supported around the heating unit 541 and the fixing roller 542, and wound around the fixing roller 542 at a predetermined angle. When the fixing roller 542 rotates, the fixing belt 543 is driven by rotation of the fixing roller 542 and rotates in the rotation direction X. The fixing belt 543 is provided to come into contact with a pressure belt 553 in a pressure-contact region between the fixing roller 542 and a pressure roller 551 described below.

The fixing belt 543 is an endless-shaped belt that has a three-layered structure consisting of a substrate layer, an elastic layer, and a release layer. The fixing belt 543 is formed to have a cylindrical shape of a diameter of 60 mm and a thickness of 270 μm. The material for the substrate layer is not particularly limited insofar as heat resistance and durability are excellent, and heat resistant synthetic resins may be used. Among them, polyimide (PI) or polyamide-imide resin (PAI) is preferably used. These resins have high strength and high heat resistance as well as are inexpensive. The thickness of the substrate layer is not particularly limited, and is preferably in a range of 30 to 200 μm. In this embodiment, the substrate layer is made of polyimide and has a thickness of 100 μm.

The material for the elastic layer is not particularly limited insofar as the material has rubber elasticity, and preferably the material is also excellent in heat resistance. Specific examples of such a material include, silicone rubber, fluorine rubber, and fluorosilicone rubber. Among them, silicone rubber, which is excellent in rubber elasticity and has satisfactory heat resistance, is preferably used. The surface hardness of the elastic layer is preferably in a range of 1 to 60 degrees based on the JIS-A hardness scale. When the surface hardness of the elastic layer is within this range based on the JIS-A hardness scale, deterioration of the strength of the elastic layer and defective adhesion can be prevented, and defective fixability of toner can be prevented. Specific examples of silicone rubber having such properties include one-component, two-component, or three or more-component silicone rubber, LTV, RTV, or HTV-type silicone rubber, and condensation or addition-type silicone rubber. The thickness of the elastic layer is preferably in a range of 30 to 500 μm. When the thickness of the elastic layer is within this range, the elastic effect of the elastic layer can be maintained, and thermal insulation can be minimized, thereby achieving power savings. In this embodiment, the elastic layer is made of silicone rubber having hardness of 5 degrees based on the JIS-A hardness scale and a thickness of 150 μm.

The release layer is made of a fluorine resin tube. The release layer formed on the outer circumference of the fixing belt 543 is made of a fluorine resin. Thus, the release layer is excellent in durability, as compared with a release layer which is formed by applying and baking resin containing fluorine resin. When a release layer is formed by application and baking, an accurate and expensive mold is required so as to a release layer with high dimension accuracy. Meanwhile, when a tube is used, a release layer with high dimension accuracy is obtained, even without using the above-described mold. The thickness of the release layer is preferably in a range of 5 to 50 μm. When the thickness of the release layer is within this range, the release layer can follow fine irregularities of the recording paper sheet 32 while having appropriate strength and ensuring elasticity of the elastic layer. In this embodiment, for the release layer, a PTFE tube having a thickness of about 20 μm is used.

Next, the pressure section 550 will be described. The pressure section 550 includes a pressure roller 551, a tension roller 552, and a pressure belt 553 which is an endless-shaped belt. In the pressure section 550, the pressure belt 553 is supported around the pressure roller 551 and the tension roller 552 with tension. The pressure roller 551 and the tension roller 552 are rotatably supported between left and right side plates (not shown) of the fixing device 530.

The pressure belt 553 is configured in the same manner as the above-described fixing belt 543, and rotates by rotation of the fixing belt 543 being in contact therewith.

The pressure roller 551 is a roller-like member that is rotated in a rotation direction Y about the rotation axis by rotation of the pressure belt 553 which is rotated by rotation of the fixing belt 543. The pressure roller 551 has an outer diameter of 30 mm. The pressure roller 551 has a three-layered structure consisting of a core metal 551*a*, an elastic layer 551*b*, and a surface layer 551*c*, which are formed in this order from inside. As the materials for the core metal 542*a*, the elastic layer 551*b*, and the surface layer 551*c* of the pressure roller 551, the same materials as those for the core metal 542*a*, the elastic layer 542*b*, and the surface layer 542*c* of the above-described fixing roller 542 may be used. The pressure roller 551 is provided with a heating section 551*d* for heating the pressure roller 551 in an interior thereof. This is to reduce the rising time from when the image forming apparatus 100 is powered-on until image formation is possible, and to suppress a rapid decrease in the surface temperature of the pressure roller 551 due to heat transfer to the recording paper sheet 32 at the time of toner image fixing. In this embodiment, for the heating section 551*d*, a halogen lamp is used.

The tension roller 552 is configured such that a silicone sponge layer 552*b* is provided on an iron-alloy core metal 552*a* having an outer diameter of 30 mm and an inner diameter of 26 mm so as to decrease thermal conductivity, thereby decreasing thermal conduction from the pressure belt 553.

The fixing device 530 is a so-called twin-belt fixing type fixing device in which the fixing nip region is formed at a region where the fixing belt 543 and the pressure belt 553 come into contact with each other, and fixing is carried out in the fixing nip region. In the fixing device 530, the pressure-contact region where the fixing roller 542 and the pressure roller 551 come into pressure-contact with each other with the fixing belt 543 and the pressure belt 553 interposed therebetween becomes the lowermost stream portion of the fixing nip region. Of the entire fixing nip region formed at the portion where the fixing belt 543 and the pressure belt 553 are in contact with each other, the lowermost stream portion is a portion where the pressure distribution in the feeding direction of the recording paper sheet becomes the maximum. As described above, by making the configuration such that the pressure distribution at the lowermost stream portion of the fixing nip region becomes the maximum, the fixing belt 543 and the pressure belt 553 can be prevented from slipping at the time of rotation.

The fixing device 530 is also provided with a fixing pad 544 and a pressure pad 554 so as to ensure a wide fixing nip region, without increasing the size of the device. The fixing pad 544 serves as a first pressure pad that presses the fixing belt 543 toward the pressure belt 553. The pressure pad 554 serves a second pressure pad that presses the pressure belt 553 toward the fixing belt 543. The fixing pad 544 and the pressure pad 554 are arranged to be supported between left and right side plates (not shown) of the fixing device 530. The pressure pad 554 is pressed toward the fixing pad 544 with a predetermined pressing force in a direction Z close to the fixing pad 544 by a pressing mechanism (not shown). As the materials for the fixing pad 544 and the pressure pad 554, PPS (polyphenylene sulfide resin) may be used.

When the fixing nip region is formed by the fixing pad 544 and the pressure pad 554 which are not rotators, the inner circumferential surfaces of the fixing belt 543 and the pressure belt 553 frictionally slide on the respective pads. Then, when the friction coefficient between the inner circumferential surfaces of the respective belts 543 and 553 and the respective pads 544 and 554 increases, slide resistance increases. As a result, image slippage, gear damages, an increase in power consumption of the drive motor, and the like occur. In particular, in the twin-belt system, these problems become conspicuous. For this reason, low friction sheet layers are provided on the contact surfaces of the fixing pad 544 and the pressure pad 554 with the respective belts 543 and 553. Therefore, the respective pads 544 and 554 can be prevented from being abraded due to friction to the respective belts 543 and 553, and slide resistance can be reduced. As a result, satisfactory belt running property and durability are obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device which is detachably provided in a main body of an image forming apparatus for forming an image on a recording medium, and applies heat and pressure to a toner image borne on the recording medium to fix the toner image onto the recording medium, the fixing device comprising:

a first fixing member;

a heating section having a heat generating layer including a heat generating resistor which generates heat due to electrical conduction;

a fixing belt which is an endless belt member, the fixing belt being supported around the first fixing member and the heating section with tension;

a second fixing member provided to be opposite to the first fixing member with the fixing belt interposed therebetween;

a temperature detection element which detects a temperature of a surface of the fixing belt;

a control section which controls electrical conduction to the heat generating resistor on a basis of the temperature detected by the temperature detection element such that a surface temperature of the fixing belt is at a predetermined temperature; and a connector which connects the heat generating resistor and the temperature detection element to the control section, the connector comprising integrally primary-side wiring connector terminals to be connected to primary-side wires each leading to the heat generating resistor, and secondary-side wiring connector terminals to be connected to secondary-side wires including wires each leading to the temperature detection element, the secondary-side wires flowing current smaller than the primary-side, wherein the connector is arranged such that the primary-side wiring connector terminals are sandwiched between the secondary-side wiring connector terminals, and when it is detected that there is a connection fault between the secondary-side wires and the secondary-side wiring connector terminals, the control section controls such that electrical conduction to the heat generating resistor is suppressed.

2. The fixing device of claim 1, wherein the secondary-side wiring connector terminals are arranged at point-symmetrical positions with respect to a center of the connector.

3. The fixing device of claim 1, further comprising a mounting determining section which determines whether or not the fixing device is mounted in a main body of an image forming apparatus, wherein wires to be connected to the mounting determining section are connected to secondary-side wiring connector terminals as the secondary-side wires.

4. The fixing device of claim 1, further comprising a recording medium passage determining section which determines whether or not a recording medium has passed through a fixing nip region which is formed in an area where the second fixing member comes into contact with the fixing belt, wherein wires to be connected to the recording medium passage determining section are connected to the secondary-side wiring connector terminals as the secondary-side wires.

5. The fixing device of claim 1, wherein the second fixing member comprises a pressure belt which is an endless belt member supported around a pressure member and a support member with tension, and the pressure member is provided to be opposite to the first fixing member with the fixing belt and the pressure belt interposed therebetween.

6. A fixing device of two-stage fixing type, comprising:

a first fixing unit that performs primary fixing in which a toner image borne on a recording medium being fed is fixed on the recording medium under application of heat and pressure; and a second fixing unit which performs secondary fixing in which the toner image after the primary fixing is fixed on the recording medium under application of heat and pressure, the second fixing unit being arranged on a downstream side in a feeding direction of the recording medium with respect to the first fixing unit, at least one of the first fixing unit and the second fixing unit being the fixing device of claim 1.

7. An image forming apparatus comprising the fixing device of claim 6.

8. A fixing device of two-stage fixing type; comprising:

a first fixing unit that performs primary fixing in which a toner image borne on a recording medium being fed is fixed on the recording medium under application of heat and pressure; and a second fixing unit that performs secondary fixing in which the toner image after the primary fixing is fixed on the recording medium under application of heat and pressure, the second fixing unit being configured by a pair of heating and pressure rollers that are provided with a heating section in an interior thereof, and are in pressure-contact with each other, and being arranged on a downstream side of a feeding direction of the recording medium with respect to the first fixing unit, and the first fixing unit being the fixing device of claim 1.

9. An image forming apparatus comprising the fixing device of claim 8.

10. An image forming apparatus comprising the fixing device of claim 1.

* * * * *